US010041230B2

(12) United States Patent
Renski et al.

(10) Patent No.: US 10,041,230 B2
(45) Date of Patent: Aug. 7, 2018

(54) IMPLEMENT TOOTH ASSEMBLY WITH TIP AND ADAPTER

(71) Applicant: Caterpillar Inc., Peoria, IL (US)

(72) Inventors: William J. Renski, Peoria, IL (US); James Robert Lahood, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/290,720

(22) Filed: Oct. 11, 2016

(65) Prior Publication Data

US 2017/0081827 A1 Mar. 23, 2017

Related U.S. Application Data

(62) Division of application No. 14/578,159, filed on Dec. 19, 2014, now Pat. No. 9,528,248, which is a division of application No. 13/644,555, filed on Oct. 4, 2012, now Pat. No. 8,943,717.

(60) Provisional application No. 61/545,109, filed on Oct. 8, 2011.

(51) Int. Cl.
*E02F 9/28* (2006.01)

(52) U.S. Cl.
CPC ..... *E02F 9/2825* (2013.01); *E02F 9/2808* (2013.01); *E02F 9/2858* (2013.01)

(58) Field of Classification Search
CPC ..... E02F 9/28; E02F 9/2825; E02F 9/2858; E02F 9/2841; E02F 9/2833; E02F 9/2883; E02F 9/2808
USPC ..... 37/446, 452–460; 172/701.1–701.3
See application file for complete search history.

(56) References Cited

U.S. PATENT DOCUMENTS

| | | | |
|---|---|---|---|
| 64,914 | A | 5/1867 | Selden |
| 784,116 | A | 3/1905 | McCaskey |
| 821,215 | A | 5/1906 | Cantlebery et al. |
| 915,809 | A | 3/1909 | Thomas |
| 1,218,841 | A | 3/1917 | Dietz |
| 1,363,189 | A | 12/1920 | Mulroney |
| 1,438,001 | A | 12/1922 | Buskirk et al. |
| 1,485,879 | A | 8/1923 | Page |
| 1,860,338 | A | 5/1932 | Taylor, Jr. |
| 1,868,247 | A | 7/1932 | Page |
| 2,040,085 | A | 5/1936 | Fykse et al. |
| 2,050,014 | A | 8/1936 | Morrison |
| 2,064,059 | A | 12/1936 | Fellmeth |
| 2,167,425 | A | 7/1939 | Page |
| 2,433,001 | A | 12/1947 | Mork |
| 2,435,846 | A | 2/1948 | Robertson |
| 2,435,847 | A | 2/1948 | Robertson |
| 2,483,032 | A | 9/1949 | Baer |

(Continued)

FOREIGN PATENT DOCUMENTS

| | | |
|---|---|---|
| AU | 652524 | 8/1994 |
| AU | 2005203574 | 3/2007 |

(Continued)

*Primary Examiner* — Robert E Pezzuto
(74) *Attorney, Agent, or Firm* — Finnegan, Henderson, Farabow, Garrett & Dunner, LLP

(57) ABSTRACT

A ground engaging tip of a tooth assembly for a base edge of a ground engaging implement, is provided, wherein the tooth assembly includes an adapter configured for attachment to a base edge of the ground engaging implement and having a forwardly extending adapter nose. The ground engaging tip may have a substantially keystone-shaped contour providing additional wear material at the top surface for use in top-wearing earth moving applications.

8 Claims, 28 Drawing Sheets

(56) References Cited

U.S. PATENT DOCUMENTS

| | | | |
|---|---|---|---|
| 2,603,009 | A | 7/1952 | Smith |
| 2,688,475 | A | 9/1954 | Small |
| 2,689,419 | A | 9/1954 | Daniels et al. |
| 2,738,602 | A | 3/1956 | Meeks |
| 2,740,212 | A | 4/1956 | Werkheiser et al. |
| 2,752,702 | A | 7/1956 | Nelson |
| D182,143 | S | 2/1958 | Petersen |
| 2,846,790 | A | 8/1958 | Davis et al. |
| 2,874,491 | A | 2/1959 | Larsen |
| 2,904,909 | A | 9/1959 | Ratkowski |
| 2,915,290 | A | 12/1959 | Petersen |
| 2,919,506 | A | 1/1960 | Larsen |
| D190,335 | S | 5/1961 | Livermore |
| 2,982,035 | A | 5/1961 | Stephenson |
| 2,990,633 | A | 7/1961 | Buskirk |
| 2,994,141 | A | 8/1961 | Stephenson |
| 3,012,346 | A | 12/1961 | Larsen |
| 3,019,537 | A | 2/1962 | Stephenson |
| D193,016 | S | 6/1962 | Phillips |
| 3,063,176 | A | 11/1962 | Larson |
| D194,508 | S | 2/1963 | Cain |
| 3,079,710 | A | 3/1963 | Larsen et al. |
| D199,133 | S | 9/1964 | Wilson |
| D200,721 | S | 3/1965 | Wilson |
| D200,722 | S | 3/1965 | Wilson |
| 3,277,592 | A | 10/1966 | Launder et al. |
| D207,451 | S | 4/1967 | Wilson |
| 3,325,926 | A | 6/1967 | Wilson |
| 3,331,637 | A | 7/1967 | Krekeler |
| 3,371,437 | A | 3/1968 | Wilson et al. |
| 3,425,117 | A | 2/1969 | Hill |
| 3,444,633 | A | 5/1969 | Hensley |
| 3,455,040 | A | 7/1969 | Ratkowski |
| D215,953 | S | 11/1969 | Edwards et al. |
| 3,530,601 | A | 9/1970 | Steil |
| 3,623,247 | A | 11/1971 | Stepe |
| 3,624,827 | A | 11/1971 | Liess et al. |
| 3,650,053 | A | 3/1972 | Baer |
| 3,675,350 | A | 7/1972 | Mulcahy et al. |
| 3,708,895 | A | 1/1973 | Griffith et al. |
| 3,774,324 | A | 11/1973 | Lafond |
| 3,897,642 | A | 8/1975 | Helton et al. |
| 3,959,901 | A | 6/1976 | Klett |
| 3,982,339 | A | 9/1976 | Nilsson |
| 4,027,408 | A | 6/1977 | Ramella et al. |
| 4,050,172 | A | 9/1977 | Petersen |
| 4,083,605 | A | 4/1978 | College et al. |
| 4,317,300 | A | 3/1982 | Emrich et al. |
| 4,319,415 | A | 3/1982 | Mayerböck et al. |
| 4,329,798 | A | 5/1982 | Edwards |
| 4,335,532 | A | 6/1982 | Hahn et al. |
| 4,404,760 | A | 9/1983 | Hahn et al. |
| D274,434 | S | 6/1984 | Nilsson |
| 4,470,210 | A | 9/1984 | Hahn |
| D275,859 | S | 10/1984 | Nilsson |
| 4,481,728 | A | 11/1984 | Mulder et al. |
| 4,510,706 | A | 4/1985 | Berchem |
| 4,577,423 | A | 3/1986 | Hahn |
| 4,611,418 | A | 9/1986 | Launder |
| 4,625,439 | A | 12/1986 | Johansson et al. |
| 4,727,663 | A | 3/1988 | Hahn |
| 4,736,533 | A | 4/1988 | May et al. |
| 4,744,692 | A | 5/1988 | Olsen et al. |
| D296,442 | S | 6/1988 | Broomhall |
| 4,751,785 | A | 6/1988 | Johansson et al. |
| 4,761,900 | A | 8/1988 | Emrich |
| 4,811,505 | A | 3/1989 | Emrich |
| 4,813,491 | A | 3/1989 | Gross |
| 4,823,486 | A | 4/1989 | Diekevers et al. |
| 4,848,013 | A | 7/1989 | Bowman et al. |
| RE33,042 | E | 9/1989 | Emrich |
| 4,932,145 | A | 6/1990 | Reeves, Jr. |
| D309,460 | S | 7/1990 | Gross |
| 4,949,481 | A | 8/1990 | Fellner |
| 4,965,945 | A | 10/1990 | Emrich |
| 5,009,017 | A | 4/1991 | Diekevers et al. |
| 5,018,283 | A | 5/1991 | Fellner |
| 5,074,062 | A | 12/1991 | Hahn et al. |
| 5,111,600 | A | 5/1992 | Lukavich et al. |
| D328,466 | S | 8/1992 | Robinson |
| D329,243 | S | 9/1992 | Robinson |
| 5,144,762 | A | 9/1992 | Robinson |
| 5,152,088 | A | 10/1992 | Hahn |
| 5,177,886 | A | 1/1993 | Klett |
| 5,188,680 | A | 2/1993 | Hahn et al. |
| 5,205,057 | A | 4/1993 | Garman |
| 5,210,965 | A | 5/1993 | Funk et al. |
| D336,304 | S | 6/1993 | Robinson |
| D339,593 | S | 9/1993 | Johansson |
| D345,364 | S | 3/1994 | Robinson |
| 5,350,022 | A | 9/1994 | Launder et al. |
| D352,044 | S | 11/1994 | Hahn |
| D354,291 | S | 1/1995 | Edwards |
| 5,386,653 | A | 2/1995 | Cornelius |
| 5,423,138 | A | 6/1995 | Livesay et al. |
| D363,074 | S | 10/1995 | Ruvang |
| 5,456,029 | A | 10/1995 | Cornelius |
| 5,469,648 | A | 11/1995 | Jones et al. |
| D365,577 | S | 12/1995 | Ruvang |
| 5,561,925 | A | 10/1996 | Livesay |
| 5,653,048 | A | 8/1997 | Jones et al. |
| D385,286 | S | 10/1997 | Moreno |
| D389,843 | S | 1/1998 | Moreno |
| D389,844 | S | 1/1998 | Moreno |
| 5,709,043 | A | 1/1998 | Jones et al. |
| D391,583 | S | 3/1998 | Moreno |
| D391,584 | S | 3/1998 | Moreno |
| D392,292 | S | 3/1998 | Moreno |
| D395,661 | S | 6/1998 | Moreno |
| 5,778,570 | A | 7/1998 | Eichelberger |
| D397,697 | S | 9/1998 | Launder et al. |
| 5,802,752 | A | 9/1998 | Quarfordt |
| 5,852,888 | A | 12/1998 | Cornelius |
| D408,422 | S | 4/1999 | Moreno |
| 5,918,391 | A | 7/1999 | Viñas Peya |
| D413,338 | S | 8/1999 | Pueyo Molina |
| 5,937,550 | A | 8/1999 | Emrich |
| D414,193 | S | 9/1999 | Launder et al. |
| D417,877 | S | 12/1999 | Launder et al. |
| D420,014 | S | 2/2000 | Karlsson |
| 6,047,487 | A | 4/2000 | Clendenning |
| 6,108,950 | A | 8/2000 | Ruvang et al. |
| 6,151,812 | A | 11/2000 | Bierwith |
| D435,567 | S | 12/2000 | Clendenning |
| D436,116 | S | 1/2001 | Clendenning |
| 6,240,663 | B1 | 6/2001 | Robinson |
| 6,247,255 | B1 | 6/2001 | Clendenning |
| D446,224 | S | 8/2001 | Clendenning |
| D447,154 | S | 8/2001 | Clendenning |
| 6,321,471 | B2 | 11/2001 | Fernandez Muñoz et al. |
| D454,891 | S | 3/2002 | Ketting et al. |
| 6,393,738 | B1 | 5/2002 | Bierwith |
| D460,464 | S | 7/2002 | Ketting et al. |
| D460,764 | S | 7/2002 | Ketting et al. |
| D461,198 | S | 8/2002 | Ketting et al. |
| D461,832 | S | 8/2002 | Ketting et al. |
| 6,430,851 | B1 | 8/2002 | Clendenning |
| 6,439,796 | B1 | 8/2002 | Ruvang et al. |
| D463,460 | S | 9/2002 | Siebeck et al. |
| 6,477,796 | B1 | 11/2002 | Cornelius |
| D471,212 | S | 3/2003 | Toral Rodriguez |
| D471,565 | S | 3/2003 | Toral Rodriguez |
| 6,619,883 | B2 | 9/2003 | Livesay et al. |
| 6,675,509 | B2 | 1/2004 | Bierwith |
| D486,836 | S | 2/2004 | Launder et al. |
| 6,708,431 | B2 | 3/2004 | Robinson et al. |
| 6,729,052 | B2 | 5/2004 | Ollinger, IV et al. |
| 6,735,890 | B2 | 5/2004 | Carpenter et al. |
| 6,745,503 | B1 | 6/2004 | Pallas Moreno et al. |
| 6,745,709 | B2 | 6/2004 | Rowlett et al. |
| 6,799,386 | B2 | 10/2004 | Robinson et al. |
| 6,836,983 | B2 | 1/2005 | Pallas Moreno et al. |
| 6,837,649 | B2 | 1/2005 | Livesay et al. |
| 6,839,990 | B2 | 1/2005 | Leslie et al. |

(56) References Cited

U.S. PATENT DOCUMENTS

| | | | |
|---|---|---|---|
| 6,865,828 | B1 | 3/2005 | Molino et al. |
| 6,871,426 | B2 | 3/2005 | Keech et al. |
| 6,959,506 | B2 | 11/2005 | Adamic et al. |
| 6,976,325 | B2 | 12/2005 | Robinson et al. |
| 7,032,334 | B2 | 4/2006 | Pippins |
| 7,069,676 | B2 | 7/2006 | Robinson et al. |
| D527,029 | S | 8/2006 | Launder et al. |
| 7,100,315 | B2 | 9/2006 | Carpenter et al. |
| 7,114,272 | B2 | 10/2006 | Clendenning et al. |
| 7,121,023 | B2 | 10/2006 | Robinson et al. |
| 7,168,193 | B2 | 1/2007 | Pallas Moreno et al. |
| 7,174,661 | B2 | 2/2007 | Briscoe |
| 7,178,274 | B2 | 2/2007 | Emrich |
| D546,350 | S | 7/2007 | De Martiis |
| D552,632 | S | 10/2007 | De Martiis |
| D560,232 | S | 1/2008 | De Martiis |
| D560,691 | S | 1/2008 | Launder et al. |
| 7,367,144 | B2 | 5/2008 | Jones et al. |
| D576,183 | S | 9/2008 | De Martiis |
| 7,523,572 | B2 | 4/2009 | Pasqualini |
| 7,578,081 | B2 | 8/2009 | Bearden et al. |
| D600,723 | S | 9/2009 | Bartolome |
| D602,505 | S | 10/2009 | Ruvang |
| 7,640,684 | B2 | 1/2010 | Adamic et al. |
| 7,640,685 | B2 | 1/2010 | Emrich |
| 7,658,025 | B2 | 2/2010 | Bentley |
| D614,206 | S | 4/2010 | Ruvang |
| D614,207 | S | 4/2010 | Ruvang |
| 7,703,224 | B2 | 4/2010 | Karlsson et al. |
| 7,707,755 | B2 | 5/2010 | Lopez Almendros et al. |
| 7,730,651 | B2 | 6/2010 | Carpenter |
| 7,739,814 | B2 | 6/2010 | Carpenter et al. |
| 7,757,778 | B2 | 7/2010 | Calderwood |
| 7,762,015 | B2 | 7/2010 | Smith et al. |
| 7,788,830 | B2 | 9/2010 | Woerman et al. |
| D624,943 | S | 10/2010 | Gibbon |
| 7,818,902 | B2 | 10/2010 | Launder et al. |
| 7,832,129 | B2 | 11/2010 | Briscoe |
| 7,874,086 | B2 | 1/2011 | Briscoe et al. |
| 7,882,649 | B2 | 2/2011 | Carpenter et al. |
| 7,926,207 | B2 | 4/2011 | Lopez Almendros et al. |
| 7,980,011 | B2 | 7/2011 | Ruvang |
| 8,061,064 | B2 | 11/2011 | Ollinger, IV et al. |
| 8,104,200 | B2 | 1/2012 | Briscoe |
| 8,117,772 | B2 | 2/2012 | Harder et al. |
| 8,122,621 | B2 | 2/2012 | Carpenter et al. |
| 8,122,622 | B2 | 2/2012 | Smith et al. |
| 8,122,623 | B1 | 2/2012 | Hughes |
| 8,127,475 | B2 | 3/2012 | Harder et al. |
| 8,166,678 | B2 | 5/2012 | Martinez et al. |
| 8,943,717 | B2 | 2/2015 | Renski et al. |
| 2001/0001352 | A1 | 5/2001 | Fernandez Munoz et al. |
| 2002/0133986 | A1 | 9/2002 | Bierwith |
| 2003/0005606 | A1 | 1/2003 | Carpenter et al. |
| 2003/0024139 | A1 | 2/2003 | Jones et al. |
| 2003/0041486 | A1 | 3/2003 | Creighton |
| 2003/0070330 | A1 | 4/2003 | Olds et al. |
| 2003/0101627 | A1 | 6/2003 | Robinson et al. |
| 2004/0010949 | A1 | 1/2004 | Laguarda et al. |
| 2004/0093771 | A1 | 5/2004 | Carpenter et al. |
| 2004/0107608 | A1 | 6/2004 | Meyers et al. |
| 2004/0111927 | A1 | 6/2004 | Livesay et al. |
| 2004/0118021 | A1 | 6/2004 | Renski |
| 2004/0244235 | A1 | 12/2004 | Molino et al. |
| 2005/0050775 | A1 | 3/2005 | Clendenning |
| 2005/0055853 | A1 | 3/2005 | Livesay et al. |
| 2005/0120596 | A1 | 6/2005 | Kasim |
| 2005/0132619 | A1 | 6/2005 | Robinson |
| 2006/0010725 | A1 | 1/2006 | Jackson |
| 2006/0013648 | A1 | 1/2006 | Bernstein |
| 2006/0236567 | A1 | 10/2006 | Adamic |
| 2007/0227051 | A1 | 10/2007 | Carpenter et al. |
| 2007/0245601 | A1 | 10/2007 | Beardon et al. |
| 2007/0256335 | A1 | 11/2007 | De Martiis |
| 2008/0000114 | A1 | 1/2008 | Bentley |
| 2008/0028644 | A1 | 2/2008 | Lopez Almendros et al. |
| 2008/0066351 | A1 | 3/2008 | Simmons et al. |
| 2008/0148608 | A1 | 6/2008 | Harder et al. |
| 2008/0196281 | A1 | 8/2008 | Livesay et al. |
| 2008/0201997 | A1 | 8/2008 | Armstrong |
| 2008/0209772 | A1 | 9/2008 | Cui |
| 2008/0256832 | A1 | 10/2008 | Esti |
| 2009/0165339 | A1 | 7/2009 | Watanabe |
| 2009/0277050 | A1 | 11/2009 | Ollinger, IV et al. |
| 2010/0115804 | A1 | 5/2010 | Lopez Almendros et al. |
| 2010/0170119 | A1 | 7/2010 | Lopez Almendros et al. |
| 2011/0000109 | A1 | 1/2011 | Woerman et al. |
| 2011/0058894 | A1 | 3/2011 | Heaphy et al. |
| 2011/0099861 | A1 | 5/2011 | Ollinger et al. |
| 2011/0099862 | A1 | 5/2011 | Snyder |
| 2012/0017474 | A1 | 1/2012 | Rol Corredor et al. |
| 2012/0023788 | A1 | 2/2012 | Ollinger, IV et al. |
| 2012/0055052 | A1 | 3/2012 | Campomanes et al. |
| 2012/0102790 | A1 | 5/2012 | Ruvang |
| 2013/0086825 | A1 | 4/2013 | Renski |
| 2013/0086826 | A1 | 4/2013 | Renski |
| 2013/0086827 | A1 | 4/2013 | Renski |

FOREIGN PATENT DOCUMENTS

| | | |
|---|---|---|
| CA | 2 686 897 | 6/2010 |
| CN | 101535574 | 9/2009 |
| CN | 101851943 | 6/2010 |
| DE | 1912098 | 9/1970 |
| DE | 2439094 | 2/1975 |
| DE | 3140436 | 4/1983 |
| DE | 3442747 | 5/1986 |
| DE | 3538156 | 7/1986 |
| DE | 3720855 | 2/1988 |
| DE | 9419318 | 3/1995 |
| DE | 202011101484 | 1/2012 |
| EP | 0270325 | 6/1988 |
| EP | 0411486 | 2/1991 |
| EP | 1154082 | 11/2001 |
| EP | 1174546 | 1/2002 |
| EP | 1239088 | 9/2002 |
| EP | 1331314 | 7/2003 |
| EP | 1361313 | 11/2003 |
| EP | 1710358 | 10/2006 |
| EP | 1852557 | 11/2007 |
| EP | 2011927 | 1/2009 |
| FR | 2209871 | 7/1974 |
| FR | 2240988 | 3/1975 |
| FR | 2669658 | 5/1992 |
| GB | 1349442 | 4/1974 |
| GB | 2132980 | 7/1984 |
| GB | 2151207 | 7/1985 |
| GB | 2157650 | 10/1985 |
| GB | 2106075 | 4/1993 |
| JP | 53089203 | 8/1978 |
| JP | Sho57058740 | 4/1982 |
| JP | 59106629 | 6/1984 |
| JP | Sho60047128 | 3/1985 |
| JP | 61176724 | 8/1986 |
| JP | 3059229 | 3/1991 |
| JP | 4306329 | 10/1992 |
| JP | 8253958 | 10/1996 |
| JP | 10183698 | 7/1998 |
| JP | 2002517646 | 6/2002 |
| JP | Sho62129467 | 8/2002 |
| JP | 2003511587 | 3/2003 |
| SU | 883286 | 11/1981 |
| WO | WO 87/03316 | 6/1987 |
| WO | WO 88/05483 | 7/1988 |
| WO | WO 95/29298 | 11/1995 |
| WO | WO 97/21880 | 6/1997 |
| WO | WO 01/29331 | 4/2001 |
| WO | WO 02/04750 | 1/2002 |
| WO | WO 2004/035945 | 4/2004 |
| WO | WO 2005/056934 | 6/2005 |
| WO | WO 2005/080695 | 9/2005 |
| WO | WO 2006/012689 | 2/2006 |
| WO | WO 2007/123653 | 11/2007 |
| WO | WO 2008/021376 | 2/2008 |

(56) References Cited

FOREIGN PATENT DOCUMENTS

| | | |
|---|---|---|
| WO | WO 2008/140993 | 11/2008 |
| WO | WO 2009/127016 | 10/2009 |
| WO | WO 2010/006382 | 1/2010 |
| WO | WO 2010/031124 | 3/2010 |
| WO | WO 2010/089423 | 8/2010 |
| WO | WO 2011/074983 | 6/2011 |
| WO | WO 2011/088506 | 7/2011 |
| WO | WO 2011/088507 | 7/2011 |
| WO | WO 2011/088511 | 7/2011 |
| WO | WO 2011/134014 | 11/2011 |
| WO | 2013052810 | 4/2013 |

FIG. 12
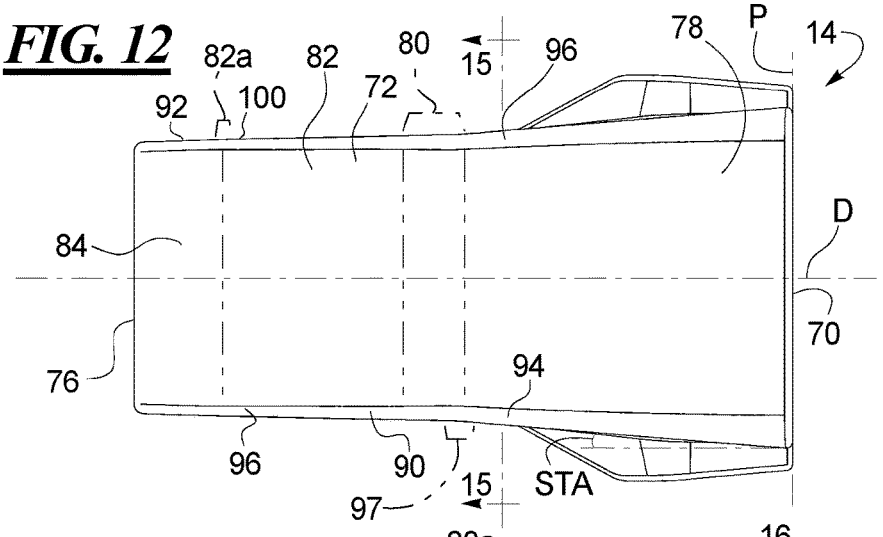
FIG. 13
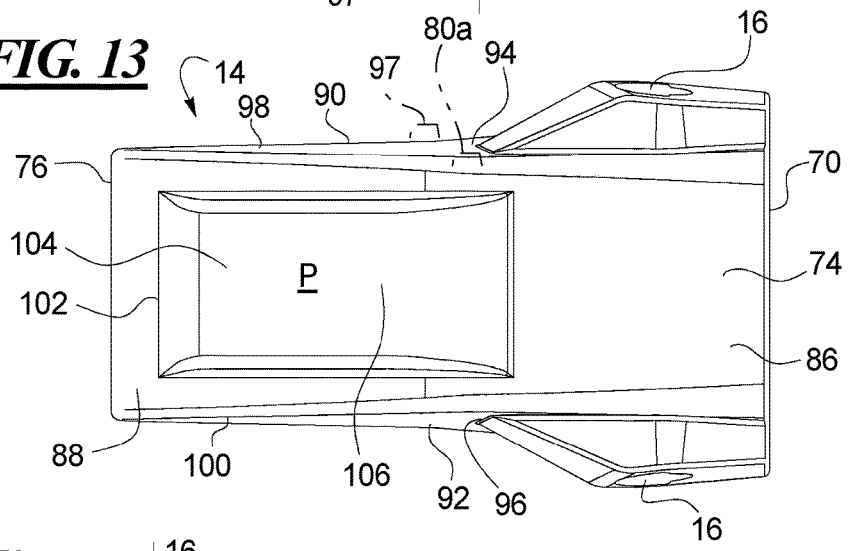
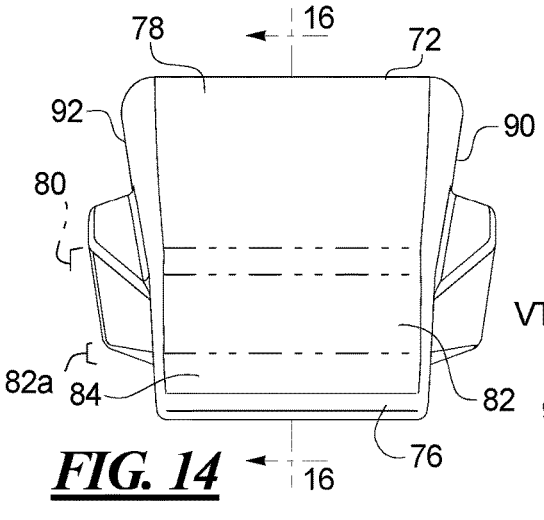
FIG. 14
FIG. 15
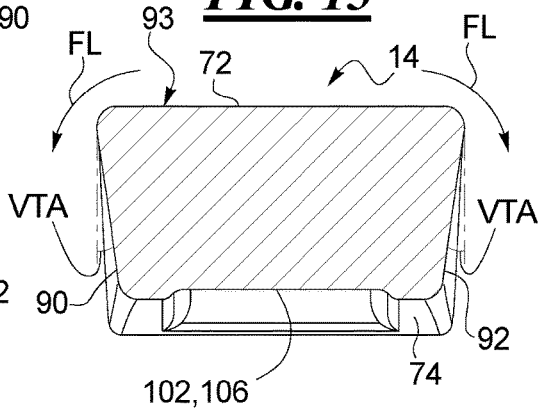

180
78
70
70a
72
92
90
80
186
82
82a
16
70b
84
74
80a
76
184
182
P
FDA
SDA
TDA
88
d3
86
VTA
188
30
STA
120
128
124
130
122
140

IMPLEMENT TOOTH ASSEMBLY WITH TIP AND ADAPTER

CROSS-REFERENCE TO RELATED APPLICATIONS

This application is a division of U.S. patent application Ser. No. 14/578,159 entitled "IMPLEMENT TOOTH ASSEMBLY WITH TIP AND ADAPTER," filed Dec. 19, 2014, which is a division of U.S. patent application Ser. No. 13/644,555 entitled "IMPLEMENT TOOTH ASSEMBLY WITH TIP AND ADAPTER," filed Oct. 4, 2012 (now U.S. Pat. No. 8,943,717), which is based upon and claims the benefit of priority under 35 U.S.C. §119(e) of U.S. Provisional Application No. 61/545,109 to Renski et al. filed on Oct. 8, 2011, the disclosures of both of which are incorporated herein by reference.

TECHNICAL FIELD

This disclosure relates generally to earth working machines with ground engaging implements and, in particular, to tooth assemblies with replaceable tip and adapter systems attached to the leading or base edges of such ground engaging implements.

BACKGROUND

Earth moving machines known in the art are used for digging into the earth or rock and moving loosened work material from one place to another at a worksite. These machines and equipment typically include a body portion housing the engine and having rear wheels, tracks or similar components driven by the engine, and an elevated cab for the operator. The machines and equipment further include articulating mechanical arms or other types of linkages, such as Z-bar linkages, for manipulating one or more implements of the machine. The linkages are capable of raising and lowering the implements and rotating the implements to engage the ground or other work material in a desired manner. In the earth moving applications, the implements of the machines or other equipment are buckets provided with a beveled lip or blade on a base edge for moving or excavating dirt or other types of work material.

To facilitate the earth moving process, and to prolong the useful life of the implement, a plurality of tooth assemblies are spaced along the base edge of the implement and attached to the surface of the implement. The tooth assemblies project forward from the base edge as a first point of contact and penetration with work material, and to reduce the amount of wear of the base edge. With this arrangement, the tooth assemblies are subjected to the wear and breakage caused by repetitive engagement with the work material. Eventually, the tooth assemblies must be replaced, but the implement remains usable through multiple cycles of replacement tooth assemblies. Depending on the variety of uses and work material for the equipment, it may also be desirable to change the type or shape of the tooth assemblies to most effectively utilize the implement.

In many implementations, installation and replacement of the tooth assemblies may be facilitated by providing the tooth assemblies as a two-part system. The system may include an adapter that is attached to the base edge of the implement, a ground-engaging tip configured to be attached to the adapter, and a retention mechanism securing the tip to the adapter during use. The adapter may be welded, bolted or otherwise secured to the base edge, and then the tip may be attached to the adapter and held in place by the retention mechanism. The tip endures the majority of the impact and abrasion caused by engagement with the work material, and wears down more quickly and breaks more frequently than the adapter. Consequently, multiple tips may be attached to the adapter, worn down, and replaced before the adapter itself must be replaced. Eventually, the adapter may wear down and require replacement before the base edge of the implement wears out.

One example of a digging tooth assembly is illustrated and described in U.S. Pat. No. 4,949,481 to Fellner. The digging tooth for a bucket has a concave top surface and a convex bottom surface which intersect forming a forward cutting edge. Sidewalls connect the two surfaces and are concave having a moldboard shape. The rear portion of the tooth is provided with a mounting assembly for mounting the digging tooth to a bucket. The bottom surface continuously diverges from the forward cutting edge to the rear portion; whereas the top surface first converges then diverges from the forward cutting edge to the rear portion. The rear portion includes a shank receiving cavity with top and bottom walls that converge as the cavity extends forwardly within the tooth to give the cavity a triangular or wedge shape when viewed in profile.

An example of a loader bucket tooth is provided in U.S. Pat. No. 5,018,283 to Fellner. The digging tooth for a loader bucket includes a top surface having a concave configuration and a bottom surface having a flat forward portion and a convex rear portion. The flat forward portion and the top surface intersect to form a forward cutting edge. Sidewalls connect the two surfaces and are concave having a plowshare shape. The rear portion of the tooth is provided with a mounting assembly for mounting it to a bucket. The bottom surface continuously converges from the forward cutting edge to the rear portion; whereas the top surface first converges then diverges from the forward cutting edge to the rear portion. The rear portion includes a shank receiving cavity with bottom wall extending inwardly, and a top wall having a first portion extending approximately parallel to the bottom wall and a second portion angled toward the bottom wall and extending to a rounded front portion.

U.S. Pat. No. 2,982,035 to Stephenson provides an example of an excavator tooth having an adapter that attaches to the leading edge of a dipper body, and a tip that attaches to the adapter. The tip includes an upper surface and a lower surface that converge into a relatively sharp point, with the tip having a horizontal plane of symmetry. Upper and lower surfaces of the adapter have recessed central surfaces, with the upper central surface having a forward surface that diverges upwardly from the plane of symmetry and rounds into a forward surface of the adapter. The interior of the tip has corresponding planar surfaces that are received by the central surfaces of the adapter, and include forward surfaces diverging from the plane of symmetry as they approach a forward surface, with one of the forward surfaces of the tip abutting the forward surface of the adapter when the parts are appropriately assembled.

The implements as discussed may be used in a variety of applications having differing operating conditions. In loader applications, buckets installed on the front of wheel or track loaders have the bottom surfaces and base edges scrape along the ground and dig into the earth or pile of work material as the loader machine is driven forward. The forces on the tooth assembly as the bucket enters the pile push the tip into engagement with the corresponding adapter. The bucket is then raised and racked with the load of work material, and the loader moves and dumps the work material in another location. As the bucket is raised through the work material, force is exerted downwardly on the tooth assembly. With the combination of scraping and engagement with the work material, and in other types of bottom-wearing applications in which the bottom surface typically wears more quickly due to more frequent engagement with the work material, the wear material of the tip wears away from the front of the tip and from the bottom surface of the tip and adapter. The loss of wear material at the front of the tip converts the initially pointed front end of the tip into a rounded, blunt surface, similar to changing the hand from having extended fingers to having a closed fist. The worn down shape is less efficient at digging through the work material as the loader moves forward, though the tip may still have sufficient wear material to be used on the implement for a time before replacement.

In excavator applications and other types of top-wearing applications where the top surface typically wears more quickly due to more frequent engagement with the work material, the buckets engage and pass through the ground or work material at different angles than in bottom-wearing applications such as loader applications described above, and therefore cause wear material of the tooth assemblies to wear away in a different manner. An excavator device, such as a backhoe, initially engages the work material with the base edge and tooth assemblies oriented close to perpendicular with respect to the surface of the work material and generally enter the work material in a downward motion. After the initial penetration into the work material, the mechanical arm further breaks up the work material and collects a load of work material in the bucket by drawing the bucket back toward the excavator machine and rotating the bucket inwardly to scoop the work material into the bucket. The complex motion of the bucket causes wear at the tip of the tooth assembly during the downward penetration motion when the forces act to push the tip into engagement with the adapter. After the initial penetration, the bucket is drawn toward the machine and rotated to further in a scooping motion to break up the work material and begin to load the implement. During this motion, the forces initially act in a direction that is initially mostly normal to the top surface of the tooth assembly, and the work material passes over and around the top of the tooth causing wear on the top surface of the tooth. As the implement rotates further and is drawn through the work material, the forces and work material again act on the tip of the tooth to cause wear at the tip. As with the loader tooth assemblies, the excavator tooth assemblies wear down to less efficient shapes after repeated forays into the work material, but may still retain sufficient wear material for continued use without replacement. In view of this, a need exists for improved tooth assembly designs for loader and excavator implements that distribute the wear material such that the tips dig into the work material more efficiently as wear material wears away from and reshapes the tips until the tips ultimately must be replaced.

SUMMARY OF THE DISCLOSURE

In one aspect of the present disclosure, the invention is directed to a ground engaging tip of a tooth assembly for a base edge of a ground engaging implement, wherein the tooth assembly includes an adapter configured for attachment to a base edge of the ground engaging implement and having a forwardly extending adapter nose. The ground engaging tip may include a rear edge, a top outer surface, a bottom outer surface, wherein the top outer surface and the bottom outer surface extend forward from the rear edge and converge at a front edge, oppositely disposed lateral outer surfaces extending downwardly from the top outer surface to the bottom outer surface, wherein the lateral outer surfaces are tapered so that a distance between the lateral outer surfaces decreases as the lateral outer surfaces extend downwardly from the top outer surface toward the bottom outer surface, and an inner surface extending inwardly into the ground engaging tip from the rear edge and defining a nose cavity within the ground engaging tip having a complementary shape to the adapter nose of the adapter for receiving the adapter nose therein.

In another aspect of the present disclosure, the invention is directed to an adapter of a tooth assembly for a base edge of a ground engaging implement. The adapter may include a rearwardly extending top strap, a rearwardly extending bottom strap having a top surface, wherein the top strap and the bottom strap define a gap there between for receiving the base edge of the ground engaging implement, and a forward extending adapter nose. The nose may include a bottom surface extending forward relative to the top strap and the bottom strap, a front surface, a top surface, oppositely disposed side surfaces extending downwardly from the top surface to the bottom surface, wherein the side surfaces are tapered in a vertical direction such that a distance between the side surfaces decreases as the side surfaces extend downwardly from the top surface toward the bottom surface.

In a further aspect of the present disclosure, the invention is directed to a ground engaging tooth assembly for a base edge of a ground engaging implement. The ground engaging tooth assembly may include an adapter having a rearwardly extending top strap, a rearwardly extending bottom strap having a top surface, wherein the top strap and the bottom strap define a gap there between for receiving the base edge of the ground engaging implement, and a forward extending adapter nose having a bottom surface extending forward from the top strap and the bottom strap, a front surface, a top surface, oppositely disposed side surfaces extending downwardly from the top surface to the bottom surface. The ground engaging tooth assembly may further include a ground engaging tip having a rear edge, a top outer surface, a bottom outer surface, wherein the top outer surface and the bottom outer surface extend forward from the rear edge and converge at a front edge, oppositely disposed lateral outer surfaces extending downwardly from the top outer surface to the bottom outer surface, wherein the lateral outer surfaces are tapered so that a distance between the lateral outer surfaces decreases as the lateral outer surfaces extend downwardly from the top outer surface toward the bottom outer surface, and an inner surface extending inwardly into the ground engaging tip from the rear edge and defining a nose cavity within the ground engaging tip having a complementary shape to the adapter nose of the adapter for receiving the adapter nose therein.

Additional aspects of the invention are defined by the claims of this patent.

BRIEF DESCRIPTION OF THE DRAWINGS

FIG. 12 is a top view of the tip of FIG. 10;

FIG. 13 is a bottom view of the tip of FIG. 10;

FIG. 14 is a front view of the tip of FIG. 10;

FIG. 15 is a cross-sectional view of the tip of FIG. 10 taken through line 15-15 of FIG. 12;

DETAILED DESCRIPTION

Although the following text sets forth a detailed description of numerous different embodiments of the invention, it should be understood that the legal scope of the invention is defined by the words of the claims. The detailed description is to be construed as exemplary only and does not describe every possible embodiment of the invention. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
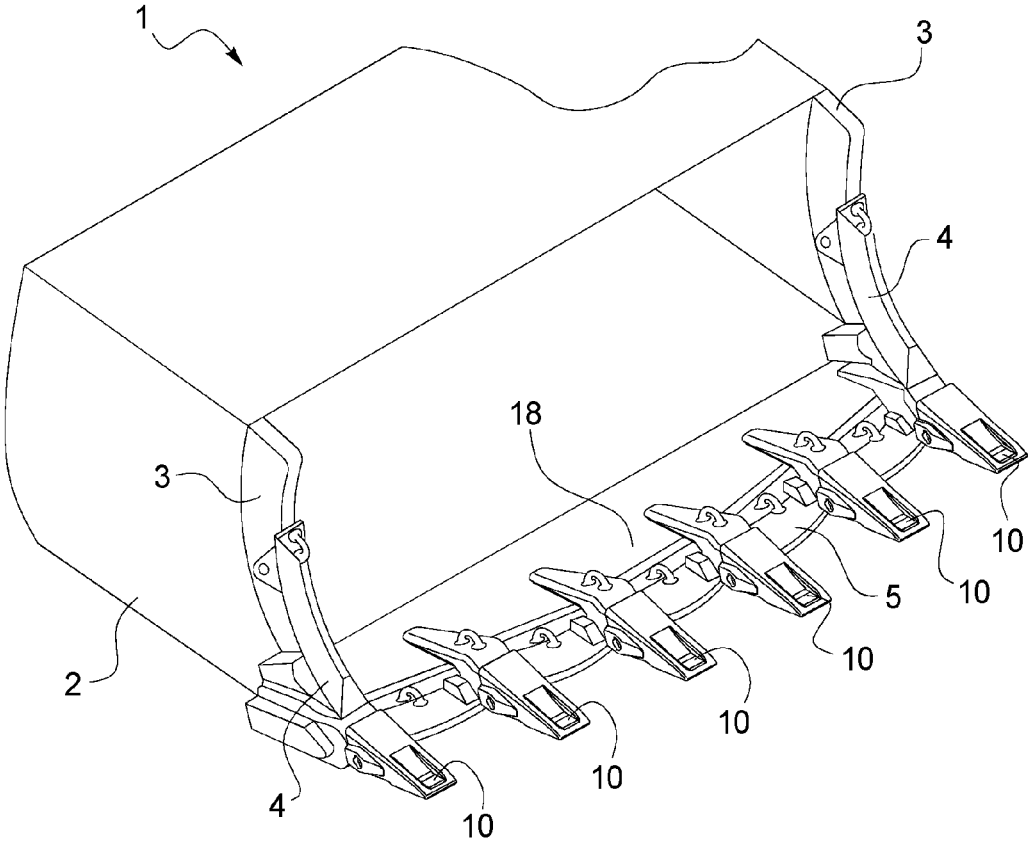
FIG. 1 is an isometric view of a loader bucket having tooth assemblies in accordance with the present disclosure attached at a base edge thereof.
Figure 2:
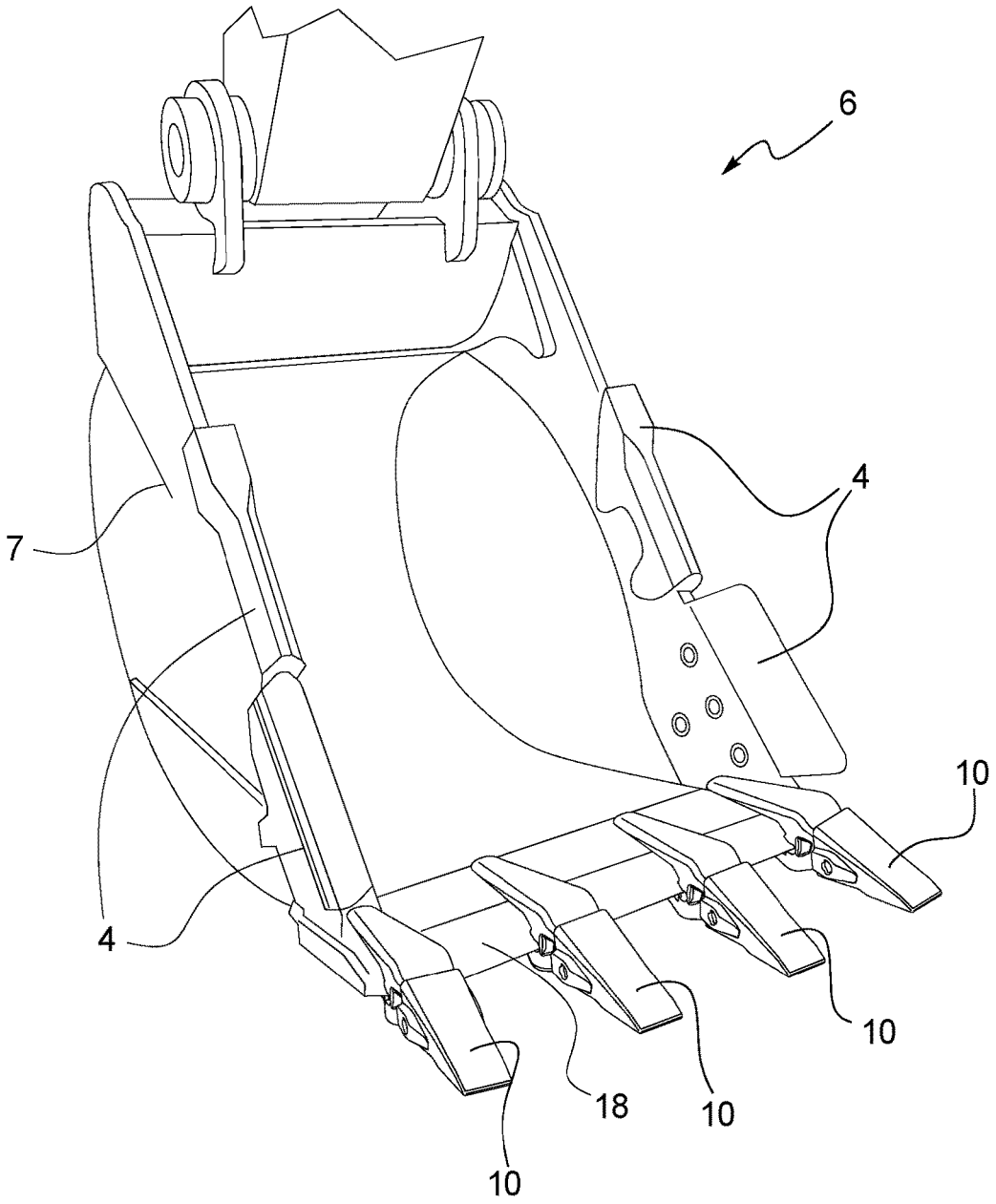
FIG. 2 is an isometric view of an excavator bucket having tooth assemblies in accordance with the present disclosure attached at a base edge thereof.

Referring now to FIG. 1, there is shown an implement for a bottom-wearing application, such as a loader machine, in the form of a loader bucket assembly 1 that incorporates the features of the present disclosure. The loader bucket assembly 1 includes a bucket 2 which is partially shown in FIG. 1. The bucket 2 is used on the loader machine to excavate material in a known manner. The bucket assembly 10 may include a pair of oppositely-disposed support arms 3 on which corresponding corner guards 4 may be mounted. The bucket assembly 1 may further included a number of edge protector assemblies 5 interposed between tooth assemblies 1 in accordance with the present disclosure, with the edge protector assemblies 5 and the tooth assemblies being secured along a base edge 18 of the bucket 2. FIG. 2 illustrates an implement for a top-wearing application, such as an excavator, in the form of an excavator bucket assembly 6. The excavator bucket assembly 6 includes a bucket 7 having corner guards 4 connected on either side, and a plurality of tooth assemblies 10 attached across the base edge 18 of the bucket 7. Various embodiments of tooth assemblies are described herein that may be implemented in bottom-wearing and top-wearing applications. Even where a particular tooth assembly or component embodiment may be described with respect to a particular bottom-wearing or top-wearing application, those skilled in the art will understand that the tooth assemblies are not limited to a particular type of application and may be interchangeable between implements of various applications, and such interchangeability is contemplated by the inventors for tooth assemblies in accordance with the present disclosure.

Figure 3:
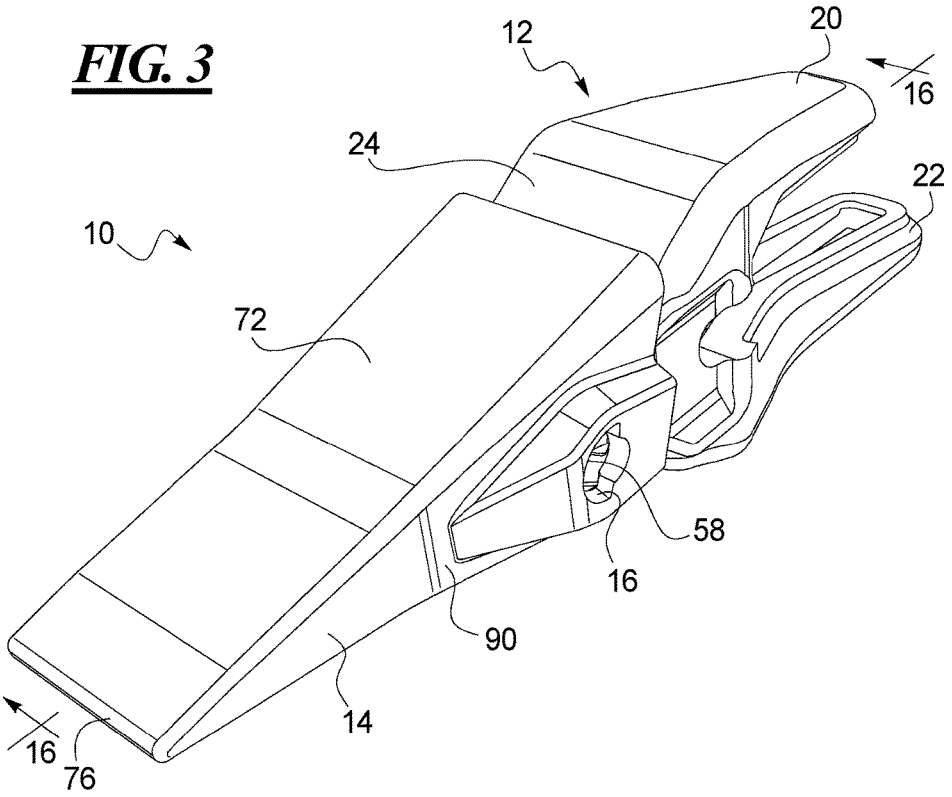
FIG. 3 is an isometric view of a tooth assembly in accordance with the present disclosure.
Figure 4:
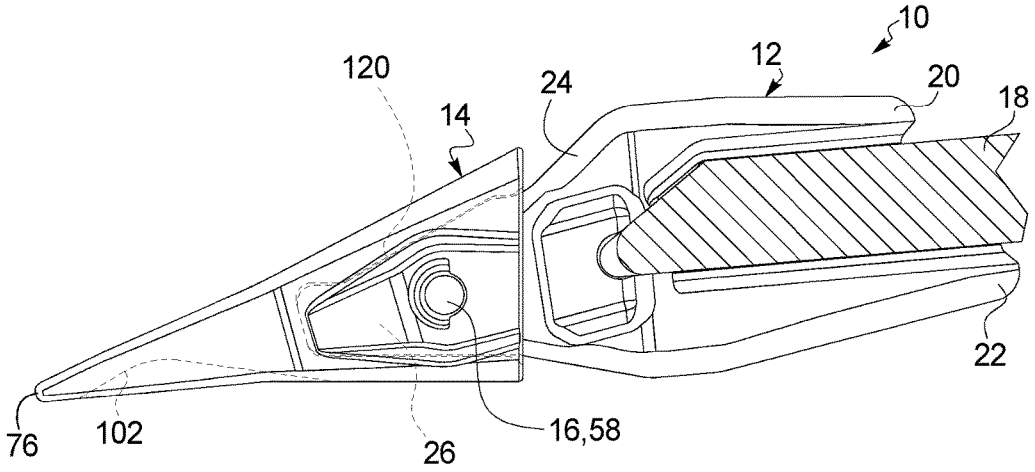
FIG. 4 is a side view of the tooth assembly of FIG. 3.

FIGS. 3 and 4 illustrate an embodiment of a tooth assembly 10 in accordance with the present disclosure that may be useful with earth moving implements, and have particular use in top-wearing applications. The tooth assembly 10 may be used on multiple types of ground engaging implements having base edges 18. The tooth assembly 10 includes an adapter 12 configured for attachment to a base edge 18 of an implement 1, 6 (FIGS. 1 and 2, respectively), and a tip 14 configured for attachment to the adapter 12. The tooth assembly 10 further includes a retention mechanism (not shown) securing the tip 14 to the adapter 12. The retention mechanisms may utilize aspects of the adapter 12 and tip 14, such as retention apertures 16 through the sides of the tip 14, but those skilled in the art will understand that many alternative retention mechanisms may be implemented in the tooth assemblies 10 according to the present disclosure, and the tooth assemblies 10 are not limited to any particular retention mechanism(s). As shown in FIG. 4, once attached to the adapter 12, the tip 14 may extended outwardly from a base edge 18 of the implement 1, 6 for initial engagement with work material (not shown).

Adapter for Top-Wearing Applications (FIGS. 5-9)

Figure 5:
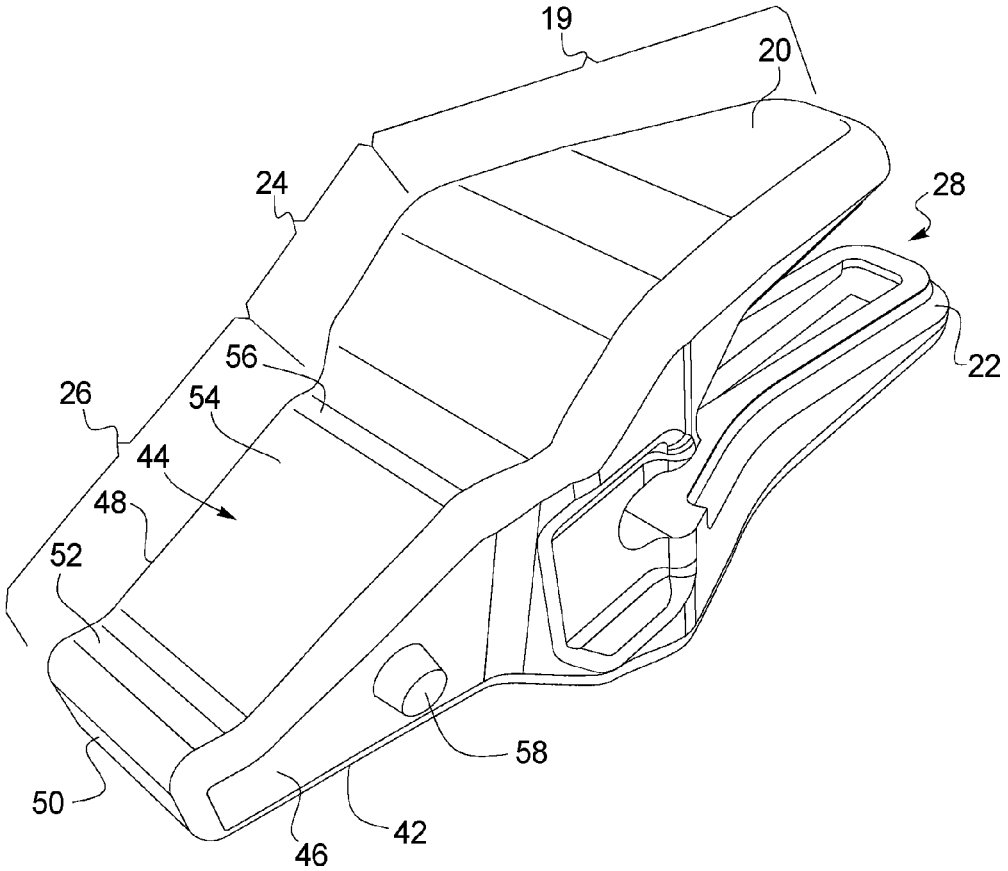
FIG. 5 is an isometric view of an adapter of the tooth assembly of FIG. 3.
Figure 6:
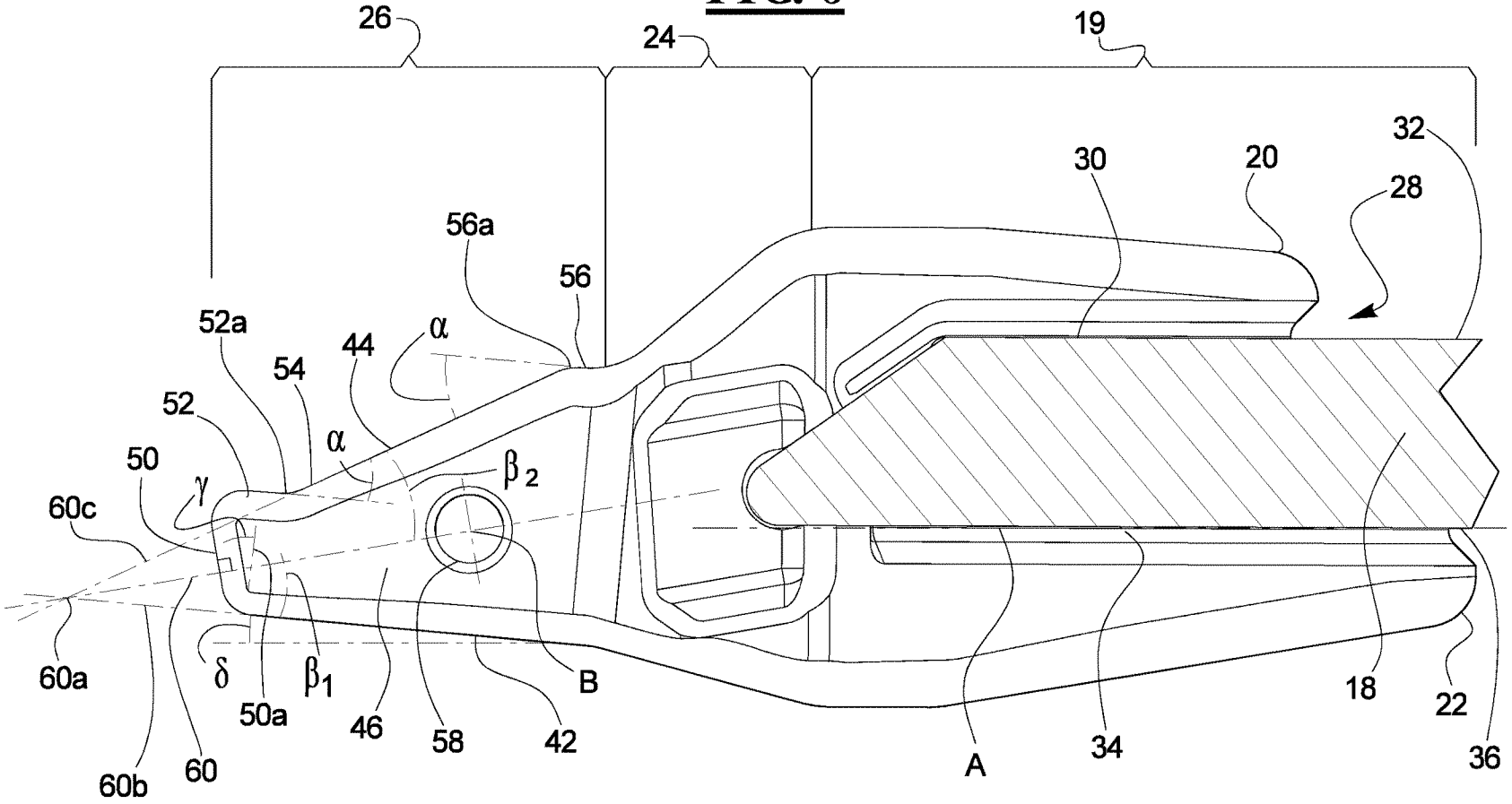
FIG. 6 is a side view of the adapter of FIG. 5 attached to a base edge of an implement.

An embodiment of the adapter 12 is shown in greater detail in FIGS. 5-9. Referring to FIG. 5, the adapter 12 may include a rear portion 19 having a top strap 20 and a bottom strap 22, an intermediate portion 24, and a nose 26 disposed at the front or forward position of the adapter 12 as indicated by the brackets. The top strap 20 and the bottom strap 22 may define a gap 28 there between as shown in FIG. 6 for receiving the base edge 18 of the implement 1, 6. The top strap 20 may have a bottom surface 30 that may face and be disposed proximate to a top surface 32 of the base edge 18, and the bottom strap 22 may have a top surface 34 that may face and engage a bottom surface 36 of the base edge 18.

Figure 7:
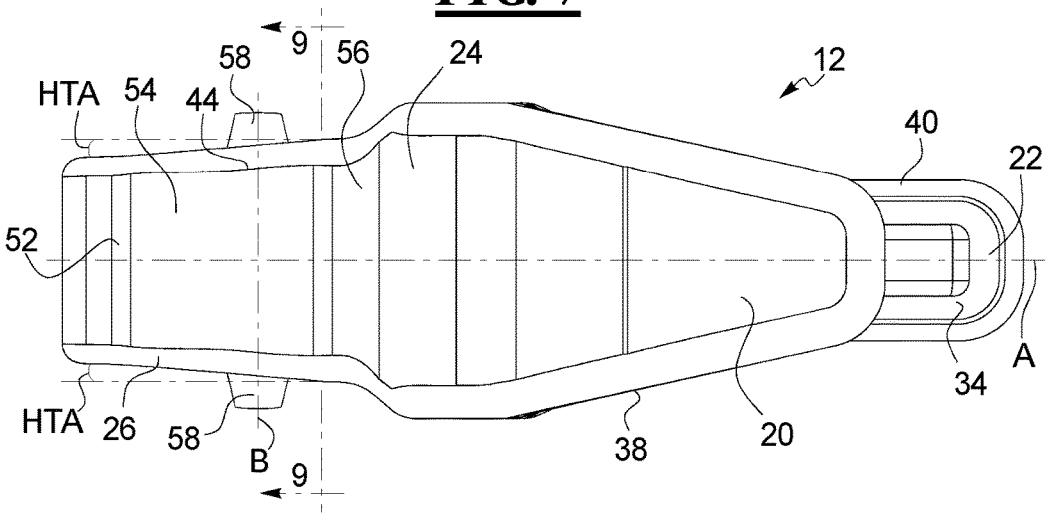
FIG. 7 is a top view of the adapter of FIG. 5.
Figure 8:
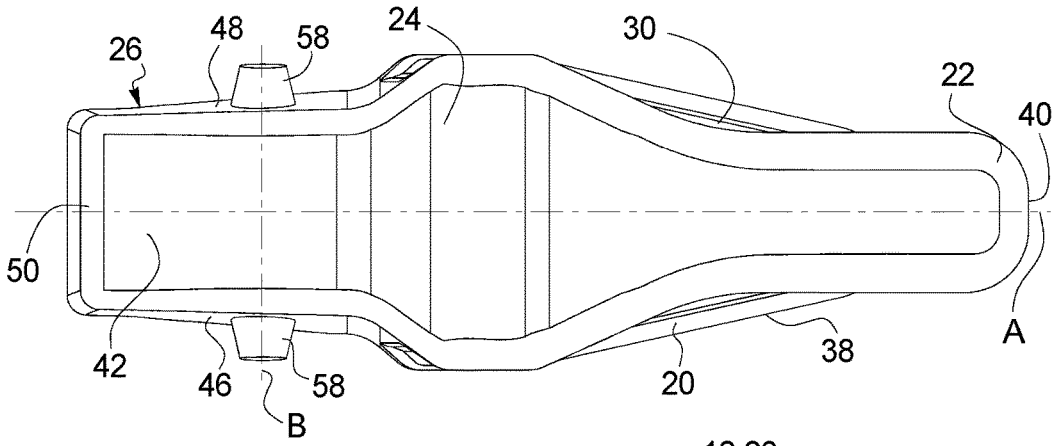
FIG. 8 is a bottom view of the adapter of FIG. 5.
Figure 9:
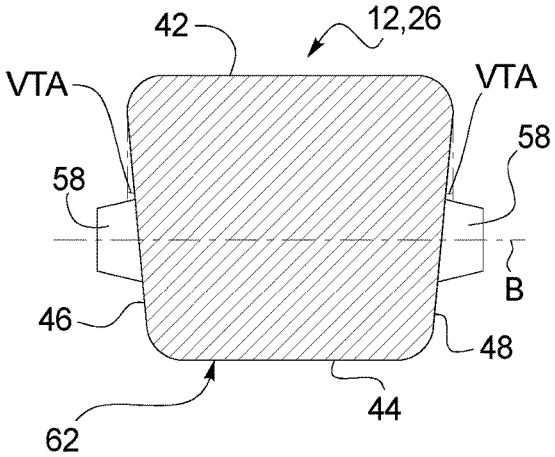
FIG. 9 is a cross-sectional view of the adapter of FIG. 5 taken through line 9-9 of FIG. 7.

The adapter 12 may be secured in place on the base edge 18 of the implement 1, 6 by attaching the top strap 20 and the bottom strap 22 to the base edge 18 using any connection method or mechanism known to those skilled in the art. In one embodiment, the straps 20, 22 and the base edge 18 may have corresponding apertures (not shown) through which fasteners (not shown) such as bolts or rivets may be inserted to hold the adapter 12 in place. Alternatively, the top and bottom straps 20, 22 may be welded to the corresponding top and bottom surfaces 32, 36 of the base edge 18 so that the adapter 12 and the base edge 18 do not move relative to each other during use. To reduce the impact of the top and bottom surface welds on the strength of the metal of the base edge 18, the straps 20, 22 may be configured with different shapes so as to minimize the overlap of the welds formed on the top surface 32 and bottom surface 36 of the base edge 18. As seen in FIGS. 7 and 8, an outer edge 38 of the top strap 20 may have a different shape than an outer edge 40 of the bottom strap 22 so that the top strap 20 may generally be shorter and wider than the bottom strap 22. In addition to the strength maintenance benefits, the additional length of the bottom strap 22 may also provide additional wear material at the bottom surface 36 of the base edge 18 of the implement 1, 6. Additionally, the top strap 20 may be thicker than the bottom strap 22 to provide more wear material on the top of the adapter 12 where a greater amount of abrasion may occur in top-wearing applications.

Those skilled in the art will understand that other connection configurations for the adapter 12 may be provided as alternatives to the top and bottom straps 20, 22 illustrated and described above. For example, the rear portion of the adapter 12 may be provided with a single top strap 20 and no bottom strap 22, with the top strap 20 being attached to the top surface 32 of the base edge 18. Conversely, a single bottom strap 22 and no top strap 20 may be provided, with the bottom strap 22 being attached to the bottom surface 36 of the base edge 18. As a further alternative, a single center strap may be provided on the rear portion of the adapter 12, with the center strap being inserted into a gap in the base edge 18 of the implement 1, 6. Further alternative adapter attachment configurations will be apparent to those skilled in the art, and are contemplated by the inventor as having use in tooth assemblies in accordance with the present disclosure.

Returning to FIG. 5, the intermediate portion 24 of the adapter 12 provides a transition between the straps 20, 22 and the nose 26 extending outwardly from the front end of the adapter 12. The nose 26 is configured to be received by a corresponding nose cavity 120 (FIG. 16) of the tip 14 as will be described more fully below. As shown in FIGS. 5 and 6, the nose 26 may have a bottom surface 42, a top surface 44, opposing side surfaces 46, 48, and a front surface 50. The bottom surface 42 may be generally planar and inclined upwardly relative to the top surface 34 of the bottom strap 22 and, correspondingly, the bottom surface 36 of the base edge 18. An angle of incline δ of the bottom surface 42 may be approximately 5° with respect to a substantially longitudinal axis "A" defined by a major base edge-engaging surface of one of the straps 20, 22 of the adapter 12, such as the top surface 34 of the bottom strap 22, as shown. Depending on the implementation, the angle δ of the bottom surface 42 may be increased by an additional 1°-3° to facilitate the removal of the adapter 12 from a mold or die in which the adapter 12 is fabricated, and the mating of the nose 26 within the nose cavity 120 (FIG. 16) of the tip 14.

The top surface 44 of the nose 26 may be configured to support the tip 14 during use of the implement 1, 6, and to facilitate retention of the tip 14 on the nose 26 when bearing the load of the work material. The top surface 44 may include a first support surface 52 disposed proximate the front surface 50, an intermediate sloped surface 54 extending rearwardly from the first support surface 52 toward the intermediate portion 24, and the second support surface 56 located between the intermediate surface 54 and the intersection with the intermediate portion 24 of the adapter 12. Each of the surfaces 52, 54, 56 may have a generally planar configuration, but may be oriented at angles with respect to each other. In the illustrated embodiment, the first support surface 52 may be approximately parallel to the bottom surface 42, and may have a draft angle with respect to the bottom surface 42 to facilitate removal from a mold or die. The second support surface 56 may also be oriented approximately parallel to the bottom surface 42 and the first support surface 52. Further, relative to the longitudinal axis "A", the second support surface 56 may be disposed at a higher elevation on the adapter 12 than the first support surface 52. The intermediate surface 54 extends between a rear edge 52*a* of the first support surface 52 and a forward edge 56*a* of the second support surface 56, with the distance between the intermediate surface 54 and the bottom surface 42 increasing as the intermediate surface 54 approaches the second support surface 56. In one embodiment, the intermediate surface 54 may be oriented at an angle α of approximately 30° with respect to the bottom surface 42 of the nose 26, the first support surface 52, and the second support surface 56. The slope of the intermediate surface 54 facilitates insertion of the nose 26 into the nose cavity 120 (FIG. 16) of the tip 14, while the breadth of the intermediate surface 54 limits the twisting of the tip 14 once the tip 14 is installed on the nose 26. The first and second support surfaces 52, 56 also assist in maintaining the orientation of the tip 14 on the adapter 12 as will be discussed more fully below.

The side surfaces 46, 48 of the nose 26 may be generally planar and extend upwardly between the bottom surface 42 and the top surface 44. A pair of projections 58, one on each of the side surfaces 46, 48 (only one shown in FIG. 6), are substantially coaxially oriented along an axis "B". The axis "B" is approximately perpendicular to the longitudinal axis "A". The projections 58 function as part of a retention mechanism (not shown) for holding the tip 14 on the nose 26. The projections 58 may be positioned to align with the corresponding apertures 16 (FIG. 3) of the tip 14. The side surfaces 46, 48 may be approximately parallel or angled inwardly at a longitudinal taper angle "LTA" of approximately 3° with respect to the axis "A" (shown in FIG. 7 with respect to a line parallel to the axis "A" for clarity) as they extend forward from the intermediate portion 24 toward the front surface 50 the nose 26, such that the nose 26 is tapered as shown in FIGS. 7 and 8. As best seen in the cross-sectional view of FIG. 9, the side surfaces 46, 48 may be angled so that the distance between the side surfaces 46, 48 decreases substantially symmetrically at vertical taper angles "VTA" of approximately 6° with respect to parallel vertical lines "VL" oriented perpendicular to the axes "A" and "B" as the side surfaces 46, 48 extend downwardly from the top surface 44 toward the bottom surface 42. Configured in this way, and as shown in cross-section in FIG. 9, the nose 26 may have a substantially keystone-shaped contour 62 defined by the bottom surface 42, top surface 44 and side surfaces 44, 46 wherein the nose 26 has a greater amount of material proximate the top surface 44 than proximate the bottom surface 42. This contour 62 may be complementary to contours 93, 131 (FIG. 17) of the tip 14 which may provide additional wear material at the top of the tooth assembly 10 where a greater amount of abrasion occurs in top-wearing applications, and may reduce drag as the tip 14 is pulled through the work material as discussed further below.

The front surface 50 of the nose 26 may be planar as shown in FIG. 6, or may include a degree of curvature. As shown in the illustrated embodiment, the front surface 50 may be generally planar, and may be angled away from the intermediate portion 24 as it extends upwardly from the bottom surface 42. In one embodiment, the front surface 50 may extend forward at an angle γ of approximately 15° with respect to a line 50*a* perpendicular to the bottom surface 42. With the front surface 50 angled as shown, a reference line 60 extending inwardly approximately perpendicular to the front surface 50 and substantially bisecting the projections 58 would create angles $\beta_1$, $\beta_2$, each measuring approximately 15° between the bottom surface 42 and the reference line 60, and also between the intermediate surface 54 of the top surface 44 and the reference line 60. The reference line 60 may also approximately pass through a point of intersection 60*a* of lines 60*b*, 60*c* that are extensions of the bottom surface 42 and intermediate surface 54, respectively. Using the bottom surface 42 as a base reference, the reference line 60 is oriented at angle $\beta_1$ with respect to the bottom surface 42 and bisects the projections 58, the intermediate surface 54 is oriented at angle $\beta_2$ with respect to the reference line 60, and the front surface 50 is approximately perpendicular to the reference line 60. In alternate embodiments, the angle $\beta_1$ may be approximately 16° to provide approximately 1° of draft angle to facilitate removal from a mold or die during fabrication. Similarly, the angle α may be approximately 29° to provide approximately 1° of draft angle.

General Duty Tip for Top-Wearing Applications (FIGS. 10-17)

Figure 10:
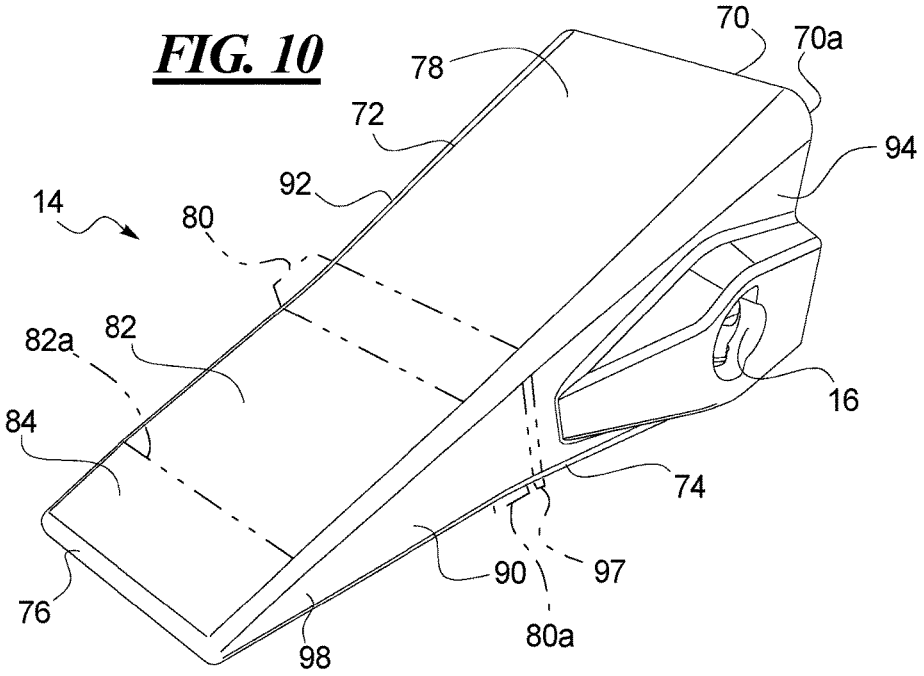
FIG. 10 is an isometric view of a tip of the tooth assembly of FIG. 3.
Figure 11:
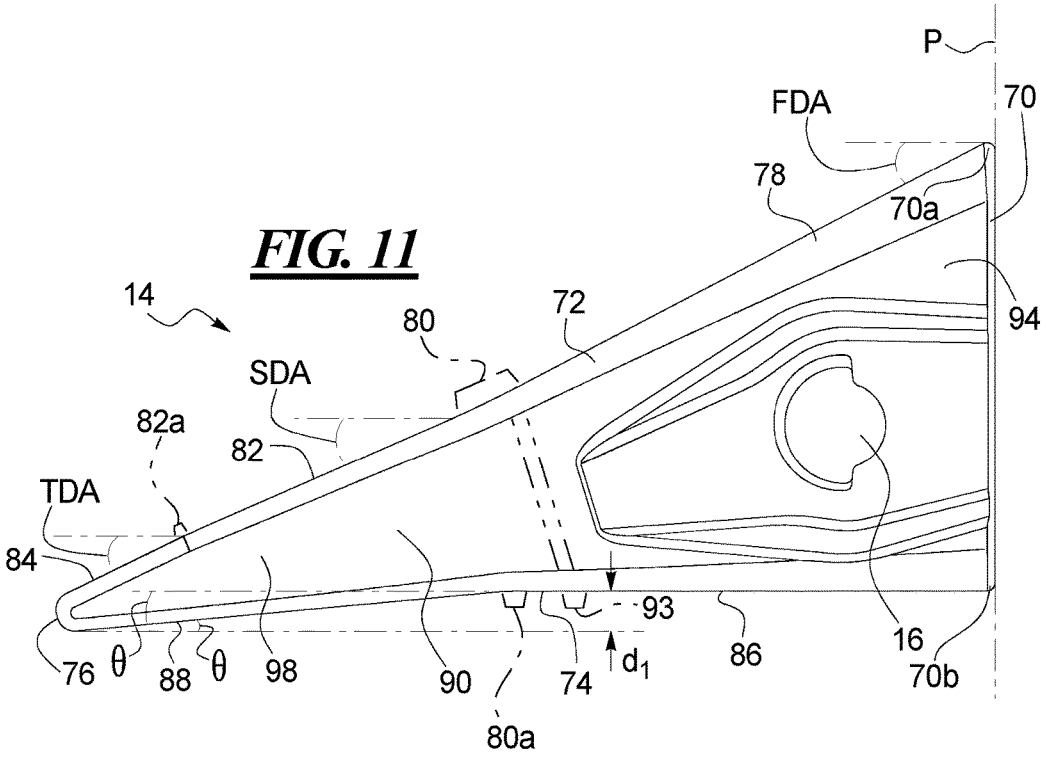
FIG. 11 is a side view of the tip of FIG. 10.

The tip 14 of the tooth assembly 10 is shown in greater detail in FIGS. 10-17. Referring to FIGS. 10 and 11, the tip 14 may be generally wedge-shaped, and may include a rear edge 70 having a top outer surface 72 extending forward from a top edge 70*a* of the rear edge 70, and a bottom outer surface 74 extending forward from a bottom edge 70*b* of the rear edge 70. The top outer surface 72 may be angled downwardly, and the bottom outer surface 74 may extend generally perpendicular to the rear edge 70 such that the top outer surface 72 and the bottom outer surface 74 converge at a front edge 76 at the front of the tip 14. The top outer surface 72 may present a generally planar surface of the tip 14, but may have distinct portions that may be slightly angled with respect to each other. Consequently, the top outer surface 72 may include a rear portion 78 extending from the rear edge 70 to a first top transition area 80 at a first downward angle "FDA" of approximately 29° with respect to a line perpendicular to a plane "P" defined by the rear edge 70, a front portion 82 extending forward from the transition area 80 at a second downward angle "SDA" of approximately 25° with respect to a line perpendicular to the plane "P,", and a tip portion 84 extending from a second tip transition area 82*a* between the front portion 82 and the tip portion 84 at a third downward angle "TDA" of approximately 27° relative to a line perpendicular to the plane "P". The generally planar configuration of the top outer surface 72 may allow work material to slide up the top outer surface 72 and toward the base edge 18 of the implement 1, 6 when the front edge 76 digs into a pile of work material with less resistance to the forward motion of the implement 1, 6 than may be provided if the tooth assembly had a top outer surface with a greater amount of curvature or with one or more recesses redirecting the flow of the work material.

The bottom outer surface 74 may also be generally planar but with an intermediate orientation change at a bottom transition area 80*a* on the bottom outer surface 74. Consequently, a rear portion 86 of the bottom outer surface 74 may extend from the rear edge 70 in approximately perpendicular relation to the plane "P" defined by the rear edge 70 toward the transition area 80*a* until the bottom outer surface 74 transitions to a downward angle at a lower front portion 88. The front portion 88 may be oriented at an angle θ of approximately 3°-5° with respect to the rear portion 86, depending on the sizing of the tooth assembly 10, and may extend to the front edge 76 at an elevation below the rear portion 86 by a distance $d_1$. By lowering the front portion 88 of the bottom outer surface 74, some of the flow and drag relief benefits discussed below that are provided by the substantially keystone-shaped contour of the tip 14 may be realized when the base edge 18 of the implement 1, 6 moves the front edge 76 forward through the work material.

The tip 14 also includes lateral outer surfaces 90, 92 extending between the top outer surface 72 and the bottom outer surface 74 on either side of the tip 14. Each of the lateral outer surfaces 90, 92 may have a corresponding one of the retention apertures 16 extending therethrough in a location between the rear portions 78, 86. As best seen in the bottom view of FIG. 13 the front view of FIG. 14, and the cross-sectional view of FIG. 15, the lateral outer surfaces 90, 92 may be angled so that the distance between the lateral outer surfaces 90, 92 decreases as the lateral outer surfaces 90, 92 extend downwardly from the top outer surface 72 toward the bottom outer surface 74. Configured in this way, the tip 14 may have a substantially keystone-shaped contour 93 in substantial correspondence to the substantially keystone-shaped contour 62 described above for the nose 26.

The tip 14 is provided with a greater amount of wear material proximate the top outer surface 72 where a greater amount of abrasion may occur, and a lesser amount of wear material proximate the bottom outer surface 74 where less abrasion may occur in top-wearing applications. In this configuration, the amount of wear material, and correspondingly the weight and cost of the tip 14, may be reduced or at least be more efficiently distributed, without reducing the useful life of the tooth assembly 10. The tapering of the lateral outer surfaces 90, 92 from top to bottom to produce the substantially keystone-shaped contour 93 of the tip 14 may reduce the amount of drag experienced by the tip 14 as it is pulled through the work material. As the top outer surface 74 is pulled through the work material, the work material flows over the top outer surface 74 outwardly and around the tip 14 as indicated by the arrows "FL" in FIG. 15, with less engagement of the lateral outer surfaces 90, 92 than if the lateral outer surfaces 90, 92 were parallel and maintained a constant width as they extend downwardly from the top outer surface 74.

FIGS. 12-15 further illustrate that the tip 14 may be configured to taper as the lateral outer surfaces 90, 92 extend from the rear edge 70 toward the front edge 76, with the lateral outer surfaces having an intermediate change in the taper of the lateral outer surfaces 90, 92. The lateral outer surfaces 90, 92 may have rear portions 94, 96 extending forward from the rear edge 70 toward the front edge 76 and oriented such that the distance between the rear portions 94, 96 decreases as the rear portions 94, 96 approach a side transition area 97 with a side taper angle "STA" of approximately 3° with respect to a line perpendicular to the plane "P". It should be noted that the side taper angle "STA" is approximately equal to the longitudinal taper angle "LTA" of the nose 26 of the adapter 12. Beyond the transition area 80, the lateral outer surfaces 90, 92 transition to front portions 98, 100 that that may be approximately parallel or converge at a shallower angle relative to a major longitudinal axis "D" defined by the tip 14 as the front portions 98, 100 progress forward to the front edge 76. The reduction in the tapering of the front portions 98, 100 of the lateral outer surfaces 90, 92 behind the front edge 76 may preserve wear material proximate the front edge 76 the front of the tip 14 where the amount of abrasion experienced by the tip 14 is greater than at the area proximate the rear edge 70 of the tip 14.

Figure 16:
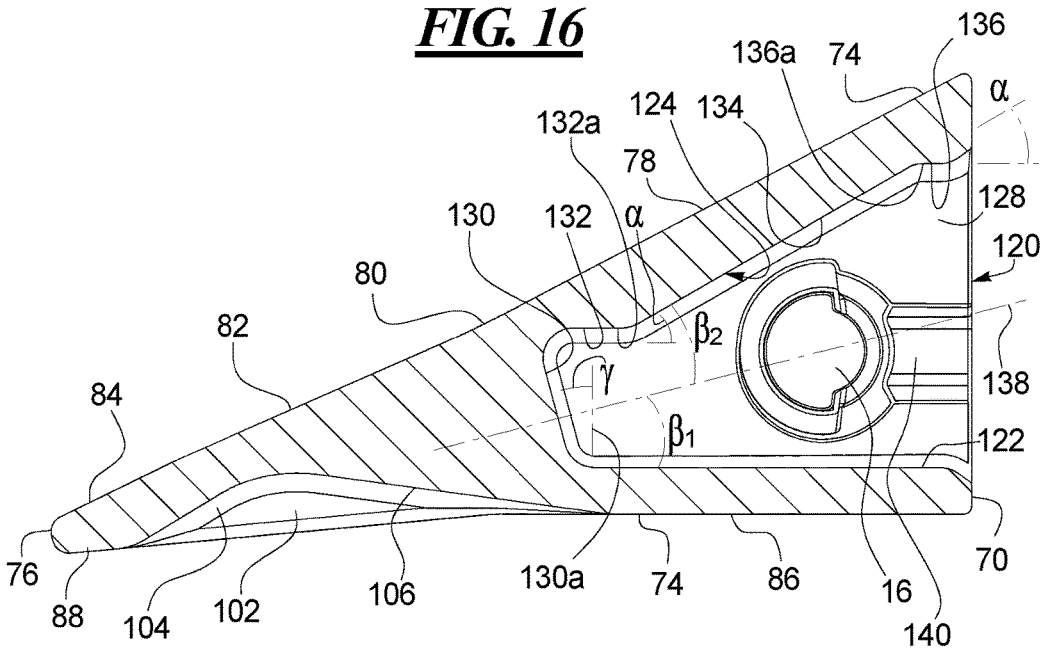
FIG. 16 is a cross-sectional view of the tip of FIG. 10 taken through line 16-16 of FIG. 14.

As shown in FIG. 13, the front portion 88 of the bottom outer surface 74 may include a relief 102. The relief 102 may extend upwardly from the bottom outer surface 74 into the body of the tip 14 to define a pocket "P" in the tip 14. The cross-sectional view of FIG. 16 illustrates the geometric configuration of one embodiment of the relief 102. The relief 102 may include an upward curved portion 104 extending upwardly into the body of the tip 14 proximate the front edge 76. Looking at the relief 102 as it extends from proximate the front edge 76 toward the rear edge 70, as the curved portion 104 of the relief 102 extends upwardly, the relief 102 transitions into a tapered portion 106. The tapered portion 106 may extend downward as it extends rearward toward the rear edge 70, and ultimately terminate at the transition area 80 and the rear portion 86 of the bottom outer surface 74. The illustrated configuration of the relief 102 reduces the weight of the tip 14, reduces resistance of the movement of the tip 14 through the work material, and provides a self-sharpening feature to the tip 14 as will be described more fully below. However, alternative configurations for the relief 102 that would provide benefits to the tip 14 will be apparent to those skilled in the art and are contemplated by the inventors as being within the scope of tooth assemblies 10 that are in accordance with the present disclosure.

Figure 17:
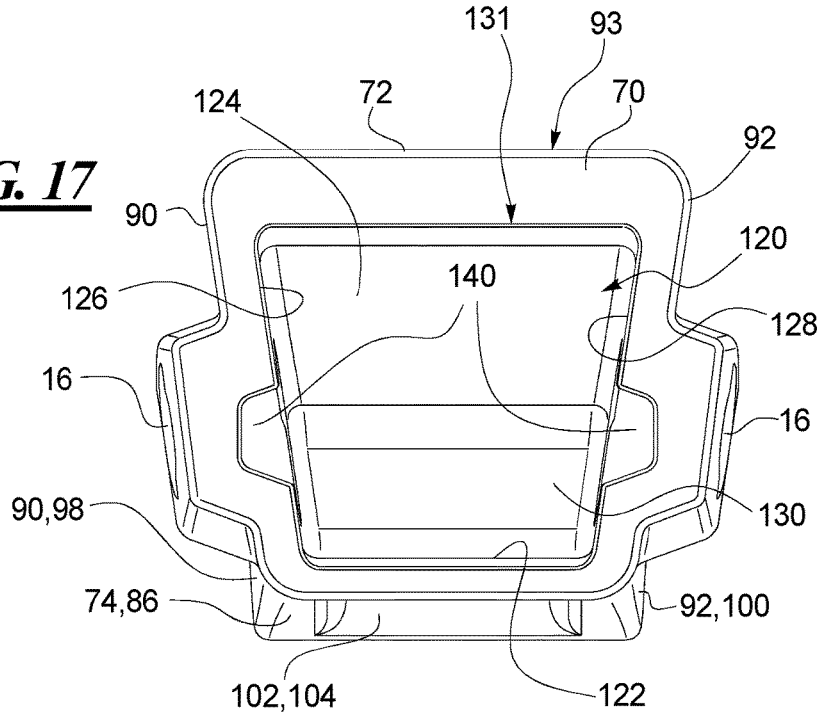
FIG. 17 is a rear view of the tip of FIG. 10.
Figure 18:
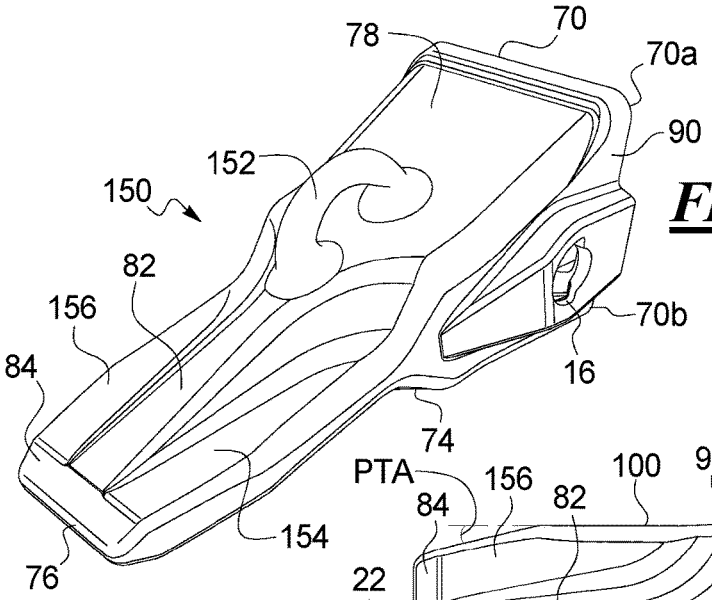
FIG. 18 is an isometric view of an alternative embodiment of a tip for a tooth assembly in accordance with the present disclosure.

The tip 14 may be configured to be received onto the nose 26 of the adapter 12. In the rear view of the tip 14 in FIG. 17, a nose cavity 120 may be defined within the tip 14. The nose cavity 120 may have a complementary configuration relative to the nose 26 of the adapter 12, and may include a bottom inner surface 122, a top inner surface 124, a pair of opposing side inner surfaces 126, 128, and a front inner surface 130. As seen from behind, the nose cavity 120 may have a substantially keystone-shaped contour 131 in a manner complementary to the contour 93 of the exterior of the tip 14 and the contour 62 of the nose 26 of the adapter 12. The distances between the top outer surface 72 and top inner surface 124, and between the bottom outer surface 74 and bottom inner surface 122, may be constant in the lateral direction across the tip 14. The side inner surfaces 126, 128 may be angled inwardly so that the distance between the side inner surfaces 126, 128 decreases as the side inner surfaces 126, 128 extend downwardly from the top inner surface 124 toward the bottom inner surface 122. Oriented in this way, the side inner surfaces 126, 128 mirror the lateral outer surfaces 90, 92 and a constant thickness is maintained between the side inner surfaces 126, 128 of the nose cavity 120 and the lateral outer surfaces 90, 92, respectively, on the exterior of the tip 14. FIG. 17 further illustrates that the nose cavity 120 may include recesses 140 in the side inner surfaces 126, 128 that may be configured to receive the projections 58 of the nose 26 of the adapter 12 when the nose 26 is inserted into nose cavity 120. Once received, the retention mechanism (not shown) of the tooth assembly 10 may engage the projections 58 to secure the tip 14 on the adapter 12.

The cross-sectional view of FIG. 16 illustrates the correspondence between the nose cavity 120 of the tip 14 and the nose 26 of the adapter 12 as shown in FIG. 6. The bottom inner surface 122 may be generally planar and approximately perpendicular to the rear edge 70. The bottom inner surface 122 may also be generally parallel to the rear portion 86 of the bottom outer surface 74. If the bottom surface 42 of the adapter 12 has an upward draft angle, the bottom inner surface 122 of the tip 14 may have a corresponding upward slope to match the draft angle.

The top inner surface 124 may be shaped to mate with the top surface 44 of the nose 26, and may include a first support portion 132, a sloped intermediate portion 134, and a second support portion 136. The first and second support portions 132, 136 may be generally planar and approximately parallel to the bottom inner surface 122, but may have a slight downward slope corresponding to the orientation that may be provided in the first and second support surfaces 52, 56 of the top surface 44 of the nose 26 to facilitate removal from a mold or die. The intermediate portion 134 of the top inner surface 124 may extend between a rear edge 132*a* of the first support portion 132 and a forward edge 136*a* of the second support portion 136, with the distance between the intermediate portion 134 and the bottom inner surface 122 increasing in a similar manner as between the intermediate surface 54 and the bottom surface 42 of the nose 26 of the adapter 12. Consistent with the relationship between the bottom surface 42 and intermediate surface 54 of the nose 26 of the adapter 12, the intermediate portion 134 of the nose cavity 120 of the tip 12 may be oriented at an angle $\alpha$ of approximately 30° with respect to the bottom inner surface 122 and the first and second support portions 132, 136.

The front inner surface 130 of the nose cavity 120 has a shape corresponding to the front surface 50 of the nose 26, and may be planar as shown or have the necessary shape to be complementary to the shape of the front surface 50. As shown in FIG. 16, the front inner surface 130 may be angled toward the front edge 76 at an angle $\gamma$ of approximately 15° with respect to a line 130*a* perpendicular to the bottom inner surface 122. A reference line 138 may extend inwardly substantially perpendicular to the front inner surface 130 and substantially bisect the retention aperture 16. To match the shape of the nose 26, the reference line 138 may be oriented at an angle $\beta_1$ of approximately 15° with respect to the bottom inner surface 122 of the nose cavity 120, and at an angle $\beta_2$ of approximately 15° with respect to the intermediate portion 134 of the top inner surface 124. The shapes of the nose 26 and nose cavity 120 are exemplary of one embodiment of the tooth assembly 10 in accordance with the present disclosure. Those skilled in the art will understand that variations in the relative angles and distances between the various surfaces of the nose 26 and nose cavity 120 may be varied from the illustrated embodiment while still producing a nose and nose cavity having complementary shapes, and such variations are contemplated by the inventors as having use in tooth assemblies 10 in accordance with the present disclosure.

Figure 21:
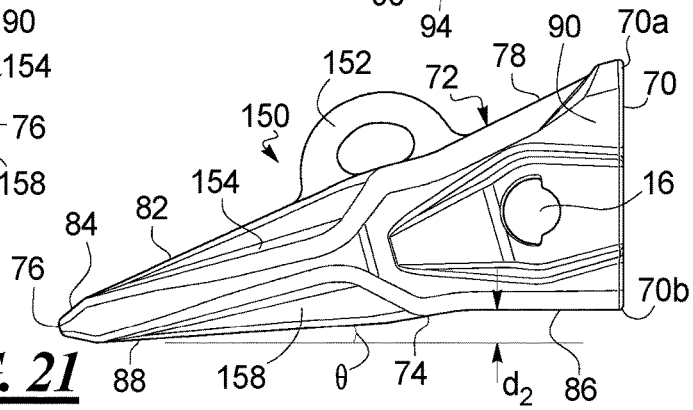
FIG. 21 is a side view of the tip of FIG. 18.
Figure 22:
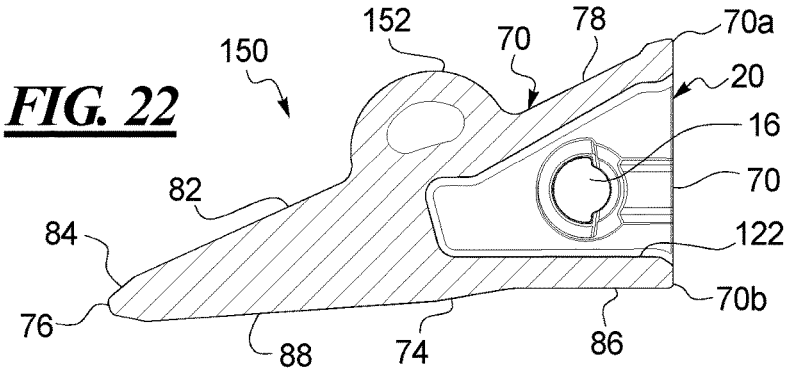
FIG. 22 is a cross-sectional view of the tip of FIG. 18 taken through line 22-22 of FIG. 19.

Penetration Tip for Top-Wearing Applications (FIGS. 18-22)

Where the tooth assemblies 10 are being used in rocky environments where a greater ability to penetrate the work material may be required, it may facilitate excavation by providing a tip having a sharper penetration end for breaking up the work material. Referring to FIGS. 18-22, a penetration tip 150 is illustrated wherein surfaces and other elements of the tip 150 that are similar or correspond to elements of the tip 14 are identified by the same reference numerals, and may include a rear edge 70, a top outer surface 72 and a bottom outer surface 74, with the top outer surface 72 and bottom outer surface 74 extending forward from the rear edge 70 and converging to a front edge 76. Lateral outer surfaces 90, 92 may include retention apertures 16 as described above. The top outer surface 74 may have a rear portion 78 and a front portion 82, and the bottom outer surface 76 having a rear portion 86 and a front portion 88. As with the tip 14, the rear portion 86 of the bottom outer surface 74 may be approximately perpendicular to the rear edge 70 and approximately parallel to the bottom inner surface 122 of the nose cavity 120 (FIGS. 21 and 22). The front portion 88 may be oriented at angle $\theta$ in the range of 8°-10°, and may be approximately 9°, with respect to the rear portion 86, depending on the sizing of the tooth assembly 10, and may extend to the front edge 76 at an elevation below the rear portion 86 by a distance $d_2$. The sizing of the tip assembly 10 may also determine whether the tip outer surface 72 includes a hook 152 extending therefrom that may be used to lift and position the tip 150 during installation.

Figure 19:
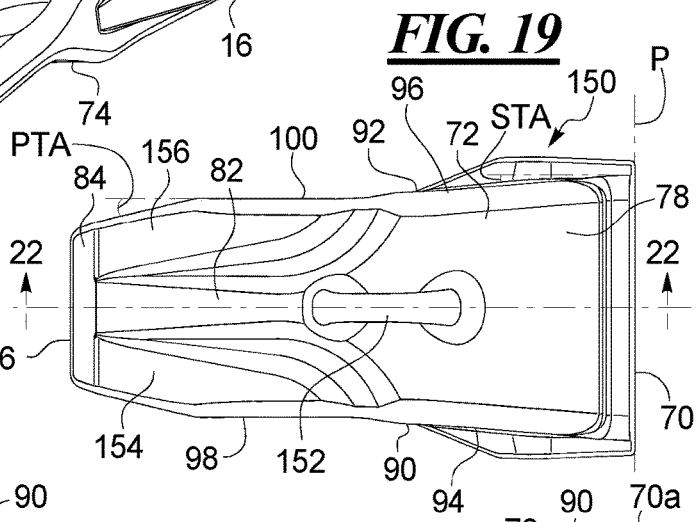
FIG. 19 is a top view of the tip of FIG. 18.
Figure 20:
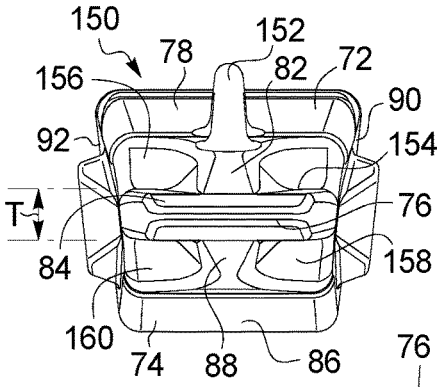
FIG. 20 is a front view of the tip of FIG. 18.

The rear portions 78, 86 may extend forward from the rear edge 70 with the rear portions 94, 96 of the lateral outer surfaces 90, 92 being tapered and converging as the lateral outer surfaces 90, 92 extend from the rear edge 70 at the side taper angle "STA" of approximately 3°. As the rear portions 78, 86 approach the front edge 76, the top and bottom outer surfaces 72, 74 may transition into the front portions 82, 88. The lateral outer surfaces 90, 92 may transition into the front portions 98, 100 that may initially be approximately parallel and then further transition as the front portions 98, 100 approach the front edge 76 to having a greater taper at a penetration taper angle "PTA" of approximately 20° with respect to a line perpendicular to the plane "P" to converge at a greater rate than the convergence within the rear portions 94, 96. Consequently, the front edge 76 may be narrower in relation to the general width of the penetration tip 150 as best seen in FIG. 19 than in the embodiment of the tip 14 as shown in FIG. 12. The narrow front edge 76 of the tip 150 may provide a smaller surface area for engaging the rocky work material, but increase the force per unit of contact area applied to the rocky work material by the series of tooth assemblies 10 attached at the base edge 18 of the implement 1, 6 to break up the rocky work material.

In addition to narrowing the width of the front edge 76 of the tip 150, the ability of the tip 150 to penetrate rocky work material as wear material wears away from the tip 150 over time may be further enhanced by reducing the overall vertical thickness of the tip 150. In the illustrated embodiment, reliefs 154, 156 may be provided on either side of the front portion 82 of the top outer surface 72, and reliefs 158, 160 may be provided on either side of the front portion 88 of the bottom outer surface 74. The reliefs 154, 156, 158, 160 may extend rearwardly from the front edge 76 and tip portion 84. As wear material wears away from the front 76 of the tip 150 toward the rear edge 70 of the tip 14 over time, a thickness T of the remaining work material-engaging surface of the tip 150 may initially increase as the material of the tip portion 84 wears away. When the wear material wears away and the work material-engaging surface reaches the reliefs 154, the thickness T may remain relatively constant with the exception of the areas of the front portions 82, 88 between the reliefs 154, 156, 158, 160 where the thickness will gradually increase as the wear material continues to wear away in the direction of the rear portions 78, 86.

Figure 23:
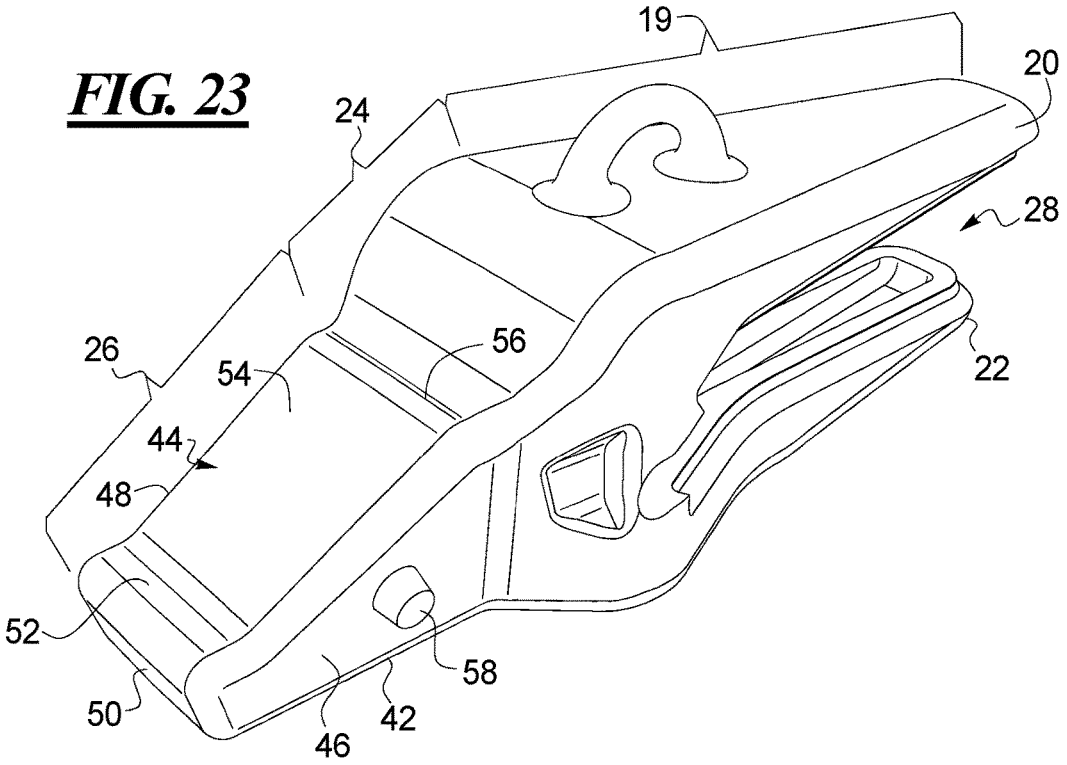
FIG. 23 is an isometric view of an alternative embodiment of an adapter for an tooth assembly in accordance with the present disclosure.
Figure 25:
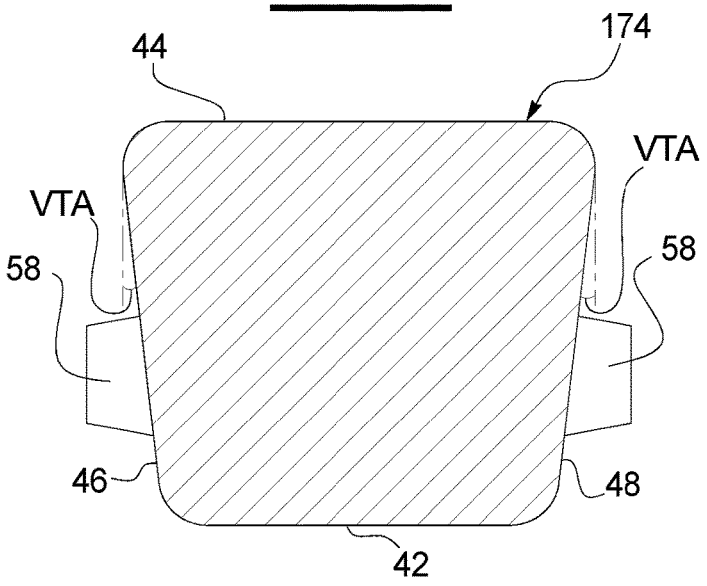
FIG. 25 is a cross-sectional view of the adapter of FIG. 23 taken through line 25-25 of FIG. 24.
Figure 24:
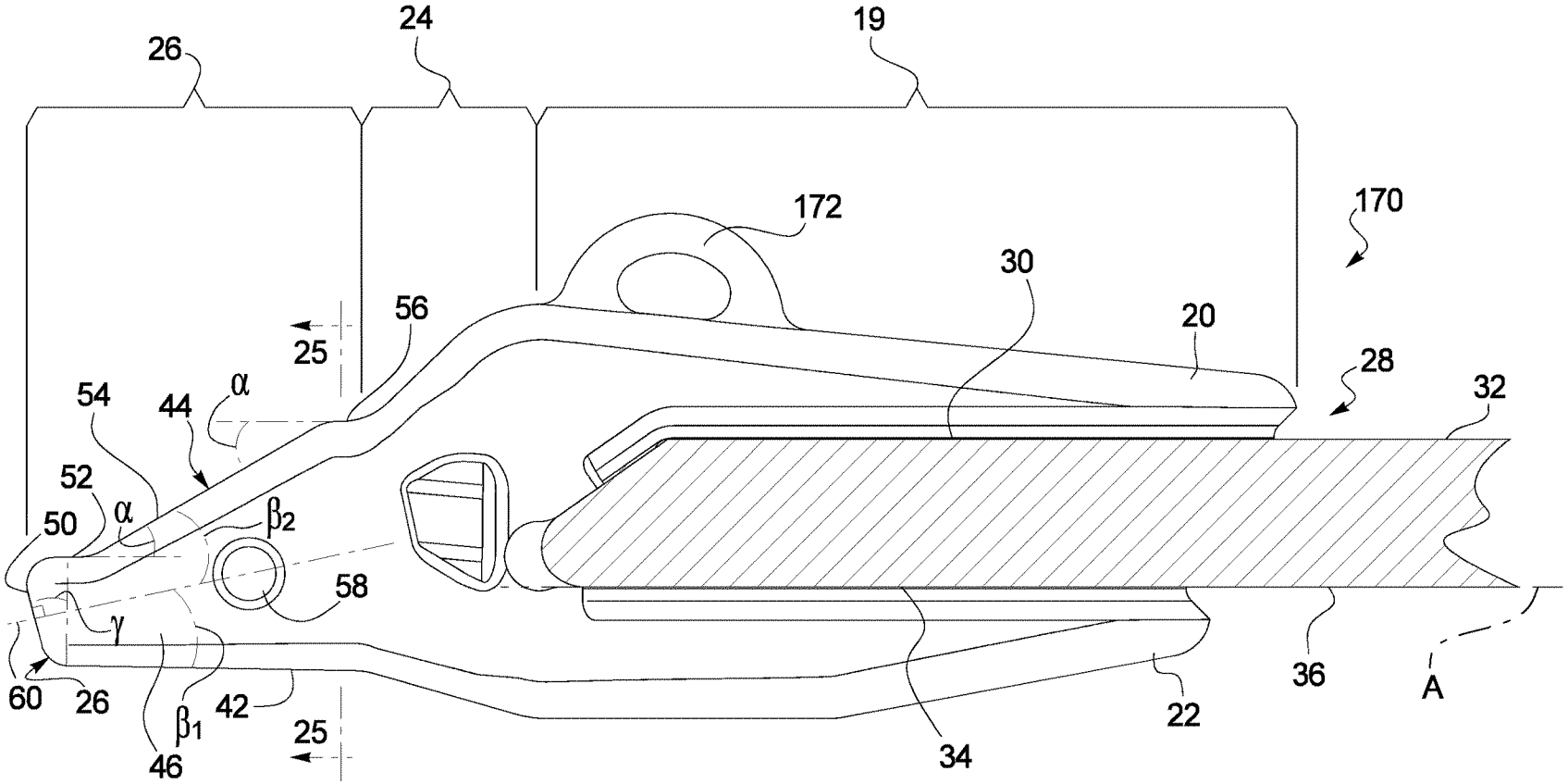
FIG. 24 is a side view of the adapter of FIG. 23.

Adapter for Bottom-Wearing Applications (FIGS. 23-25)

As mentioned above, bottom-wearing applications may involve differing operating conditions than top-wearing applications and, consequently, may present differing design requirements for the adapters and tips of tooth assemblies that may result in more efficient digging and loading of the work material. For example, it may be desirable to align bottom surfaces of bottom-wearing tips parallel to the ground and parallel to the bottom surface of the implement 1 to facilitate moving along the ground to collect work material, whereas it may be desirable for top-wearing tips as described above to more closely extend the shape of the implement 6 to facilitate scooping work material into the bucket 7 of the implement 6. The differing design requirements may lead to differences in the designs of both the adapters and the tips of the tooth assemblies.

FIGS. 23-25 illustrate an embodiment of an adapter 170 of tooth assembly 10 in accordance with the present disclosure that may have particular use on an implement 1 for a bottom-wearing application as well as other types of ground engaging implements 1, 6 having base edges 18. The surfaces and other elements of the adapter 170 that are similar or correspond to elements of the adapter 12 as described above are identified by the same reference numerals. Referring to FIGS. 23 and 25, the adapter 170 may include a top strap 20, a bottom strap 22, an intermediate portion 24, and a nose 26, with the top strap 20 and the bottom strap 22 defining a gap 28 therebetween for receiving the base edge 18 of the implement 1, 6. The top strap 20 may have a bottom surface 30 that may face and be disposed proximate to a top surface 32 of the base edge 18, and the bottom strap 22 may have a top surface 34 that may face and engage a bottom surface 36 of the base edge 18. Depending on the size of the application and, correspondingly, the tooth assembly 10, the adapter 170 may include a hook 172 extending upwardly from the top strap 20 for attachment of a lifting device (not shown) that may be used to lift and position the adapter 170 on the base edge 18 during installation. The adapter 12 as described above may similarly be provided with hook 172 if necessary in larger applications.

The straps 20, 22 of the adapter 170 may be configured similar to the adapter 12 with different shapes so as to minimize the overlap of the welds formed on the top surface 32 and bottom surface 36 of the base edge 18. In bottom-wearing applications, though, it may be desirable to make the top strap 20 longer than the bottom strap 22, and to make the bottom strap 22 thicker than the top strap 20 to provide additional wear material on the bottom of the adapter 170 where additional abrasion may occur as the adapter scrapes along the ground in bottom-wearing applications.

The nose 26 may also have the same general configuration as the nose 26 of the adapter 12 and be configured to be received by corresponding nose cavities 120 of tips that will be described more fully below. The nose 26 may have a bottom surface 42, a top surface 44, opposing side surfaces 46, 48, and a front surface 50, with the top surface 44 having first and second support surfaces 52, 56 and intermediate surface 54 extending therebetween. The side surfaces 46, 48 of the nose 26 may be generally planar and extend vertically between the bottom surface 42 and the top surface 44 as best seen in FIG. 25, and may be approximately parallel or angled inwardly as they extend from the intermediate portion 24 so that the nose 26 is tapered from rear to front. The side surfaces 46, 48 may be angled so that the distance between the side surfaces 46, 48 decreases as the side surfaces 46, 48 extend downwardly from the top surface 44 toward the bottom surface 42 due to the vertical taper angle "VTA" to define a substantially keystone-shaped contour 174 similar to those described above. The substantially keystone-shaped contour 174 of the adapter 170 may be complementary to the contours of the tips described below.

Relative to the nose 26 of the adapter 12 for top-wearing applications, the nose 26 of the adapter 170 may be oriented downwardly with respect to the straps 20, 22 to make the angle $\delta$ (top-wearing version shown in FIG. 4) approximately 0°. At this orientation, the bottom surface 42 may be generally planar and approximately parallel to the top surface 34 of the bottom strap 22 and, correspondingly, the bottom surface 36 of the implement 1, 6. Further, relative to the substantially longitudinal axis "A," the bottom surface 42 may be disposed lower on the adapter 12 than the top surface 34 of the bottom strap 22. The remaining relative positioning of the surfaces of the adapter 12 may be maintained. Consequently, using the bottom surface 42 as a base reference, the reference line 60 is oriented at angle $\beta_1$ with respect to the bottom surface 42 and bisects the projections 58, the intermediate surface is oriented at angle $\beta_2$ with respect to the reference line 60, and the front surface 50 is approximately perpendicular to the reference line 60. The angles $\beta_1$, $\beta_2$ may each be approximately 15°, the intermediate surface 54 may be oriented at an angle $\alpha$ of approximately 30° with respect to the bottom surface 42 of the nose 26, the top surface 34 of the bottom strap 22, and the first and second support surfaces 52, 56, and the front surface 50 may extend forward at an angle $\gamma$ of approximately 15° with respect to a line 50*a* perpendicular to the bottom surface 42 or top surface 34 of the bottom strap 22. The orientation of the nose 26 of the adapter 12 with respect to the straps 20, 22 coupled with the configurations of the tips described below may align the bottom outer surfaces of the tips approximately parallel to the bottom of the implement 1, 6 and the ground in order to enable the overall bottom of the tooth assembly 10 to slide along the surface of the ground and into the work material to load the implement 1, 6.

General Duty Tip for Bottom-Wearing Applications (FIGS. 26-30)

Figures 26, 27, 28, 29, 30:
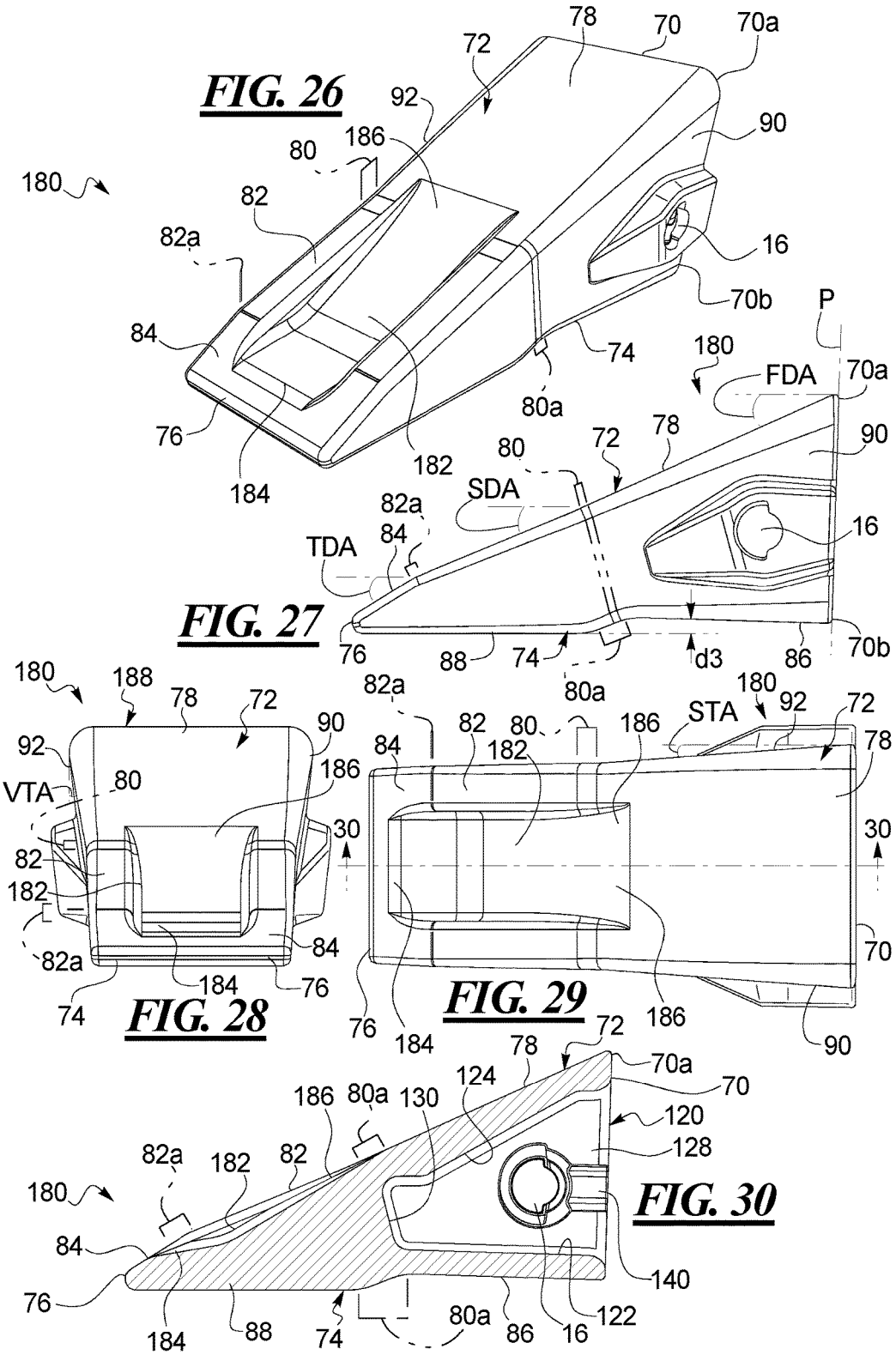
FIG. 26 is an isometric view of an alternative embodiment of a tip for a tooth assembly in accordance with the present disclosure.
FIG. 27 is a side view of the tip of FIG. 26.
FIG. 28 is a front view of the tip of FIG. 26.
FIG. 29 is a top view of the tip of FIG. 26.
FIG. 30 is a cross-sectional view of the tip of FIG. 26 taken through line 30-30 of FIG. 29.

In addition to the adapter 170, tips of the tooth assembly 10 may be configured for improved performance in bottom-wearing applications. One example of a general duty tip 180 for use with the adapter 170 is shown in greater detail in FIGS. 26-30 where similar surfaces and components as previously discussed with respect to tip 14 are identified by the same reference numerals. Referring to FIGS. 26 and 27, the tip 180 may be generally wedge-shaped with top and bottom outer surfaces 72, 74 extending forward from a top and bottom edges 70*a*, 70*b*, respectively, of the rear edge 70 and converging at front edge 76. The top outer surface 72 may be angled downwardly similar to the tip 14, and the rear portion 78 may have a first downward angle "FDA" of approximately 29°, the front portion 82 may have a second downward angle "SDA" of approximately 25°, and the tip portion 84 may have a third downward angle "TDA" of approximately 27°. The generally planar configuration of the top outer surface 72 may allow the work material to slide up the top outer surface 72 and into the bucket (not shown) of the machine (not shown) when the front edge 76 digs into a pile of work material. As best seen in FIG. 28, the lateral outer surfaces 90, 92 may be angled so that the distance between the lateral outer surfaces 90, 92 decreases as the lateral outer surfaces 90, 92 extend downwardly from the top outer surface 72 toward the bottom outer surface 74 at vertical taper angles "VTA" of approximately 3° to define a substantially keystone-shaped contour 188 complimentary to the contour 174 described above for the nose 26 of the adapter 170

The bottom outer surface 74 may also be generally planar but with an intermediate elevation change at transition area 80*a*. The rear portion 86 of the bottom outer surface 74 may extend forward approximately perpendicular to the rear edge 70 to the transition area 80 where the bottom outer surface 74 transitions to lower front portion 88. Front portion 88 may also be oriented approximately perpendicular to the rear edge 70, and may extend to the front edge 76 at an elevation below the rear portion 86 by a distance $d_3$. When the tooth assembly 10 of an implement 1, 6 digs into the work material, a majority of the abrasion between the tip 180 and the work material occurs at the front edge 76, tip portion 84 of the top outer surface, and the front portion 88 of the bottom outer surface 74 of the tip 14. By lowering the front portion 88 of the bottom outer surface 74, additional wear material is provided at the high abrasion area to extend the useful life of the tooth assembly 10.

The top outer surface 72 of the tip 180 may include a relief 182 extending across the front portion 82 and adjacent parts of the rear portion 78 and tip portion 84. As seen in FIGS. 28-30, the relief 182 may extend downwardly from the top outer surface 72 into the body of the tip 180 to define a pocket in the tip 180. The cross-sectional view of FIG. 30 illustrates the geometric configuration of one embodiment of the relief 182. The relief 182 may include a downward curved portion 184 extending downwardly into the body of the tip 180 proximate the tip portion 84 and the front edge 76. As the curved portion 184 extends downwardly, the relief 182 may turn rearward toward the rear edge 70 and transition into a rearward tapered portion 186. The tapered portion 186 may extend upward as it extends rearward toward the rear edge 70, and ultimately intersect with the transition area 80 and the rear portion 78 of the top outer surface 72. The illustrated configuration of the relief 182 reduces the weight of the tip 180, reduces resistance of the movement of the tip 180 through the work material, and provides a self-sharpening feature to the tip 180 as will be described more fully below. However, alternative configurations for the relief 182 providing benefits to the tip 180 will be apparent to those skilled in the art and are contemplated by the inventors as having use in tooth assemblies 10 in accordance with the present disclosure.

The tip 180 may be configured to be received onto the nose 26 of the adapter 170 by providing the nose cavity 120 with a complementary configuration relative to the nose 26 of the adapter 170 similar to the nose cavity 120 of the tip 14, including a keystone-shaped contour that is complementary to the contour of the exterior of the adapter 170. The cross-sectional view of FIG. 30 illustrates the correspondence between the nose cavity 120 of the tip 180 and the nose 26 of the adapter 170. The bottom inner surface 122 may be generally planar and approximately perpendicular to the rear edge 70, and may also be generally parallel to the rear portion 86 and front portion 88 of the bottom outer surface 74 to orient the bottom outer surface 74 approximately parallel to the base edge 18 of the implement 1, 6 when the tip 180 is assembled on the adapter 170. In other respects, the top inner surface 124, side inner surfaces 126, 128 and front inner surface 130 may have complementary shapes to the corresponding surfaces of the nose 26 so that the surfaces face and engage when the tip 180 is assembled on the adapter 170.

Abrasion Tip for Bottom-Wearing Applications (FIGS. 31-36)

Figure 31:
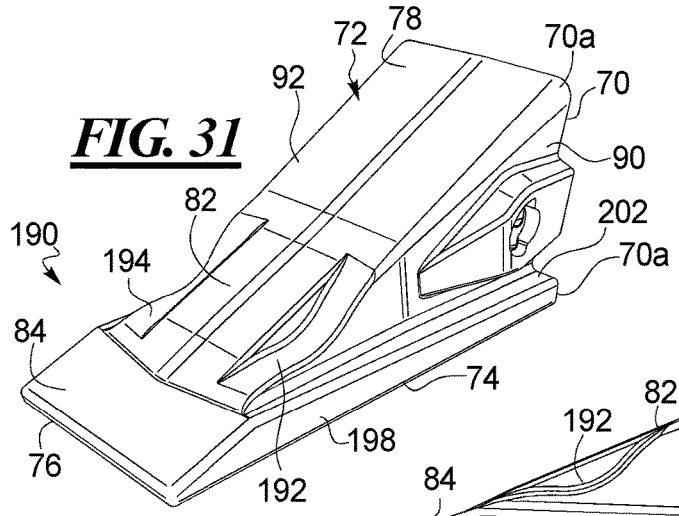
FIG. 31 is an isometric view of a further alternative embodiment of a tip for a tooth assembly in accordance with the present disclosure.
Figure 32:
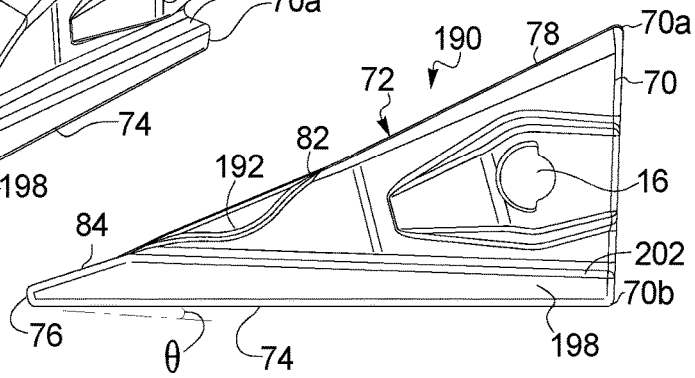
FIG. 32 is a side view of the tip of FIG. 31.
Figure 33:
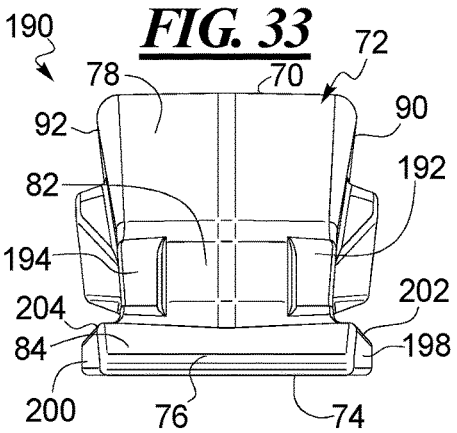
FIG. 33 is a front view of the tip of FIG. 31.
Figure 34:
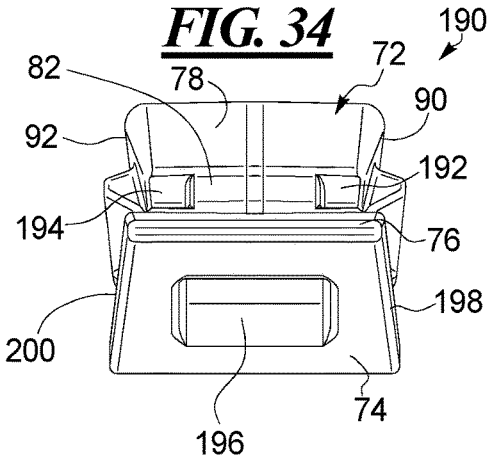
FIG. 34 is a front view of the tip of FIG. 31 with the front edge partially elevated to show the bottom outer surface.

Depending on the particular earth moving environment in which the tooth assemblies 10 are being used, the tip 180 of the tooth assembly 10 as illustrated and described above with respect to FIGS. 26-30 may be modified as necessary. For example, where the machine may be operating on work materials that are highly abrasive and may wear down tips at a much greater rate, it may be desirable to provide more wear material at the front and on the bottom of the tip. FIGS. 31-36 illustrate one embodiment of a tip 190 having use in loading abrasive work materials. The tip 190 may have the same general wedge-shaped configuration as discussed above for the tip 180 with the top and bottom outer surfaces 72, 74 extending forward from the rear edge 70 and converging to the front edge 76 as shown in FIGS. 31 and 32. To reduce weight in lower wear areas and to provide a measure of self-sharpening performance, the front portion 82 of the tip outer surface 72 may be provided with reliefs 192, 194 on either side (FIGS. 33 and 34). The reliefs 192, 194 may extend rearwardly proximate the tip portion 84. As wear material wears away from the front of the tip 190 over time, the height of the material-engaging surface of the tip 150 proximate the outer edges of the front portion 82 of the top outer surface 72 may remain relatively constant. To further reduce the weight of the tip 190, a further relief 196 may be provided in the bottom outer surface 74. The relief 196 may extend upwardly into the body of the tip 190, and may be disposed further rearward than the top reliefs 192, 194 so as not to remove too much wear material from the high abrasion areas at the proximate the front edge 76.

Figure 35:
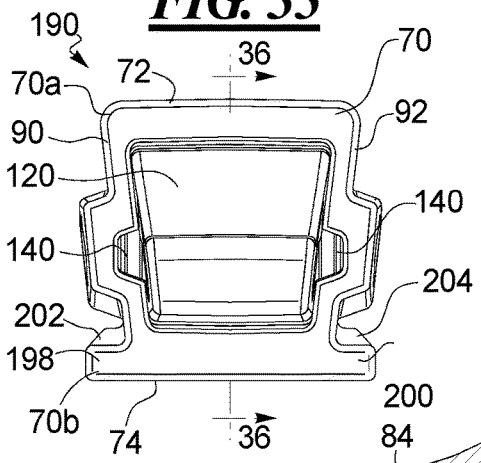
FIG. 35 is a rear view of the tip of FIG. 31.
Figure 36:
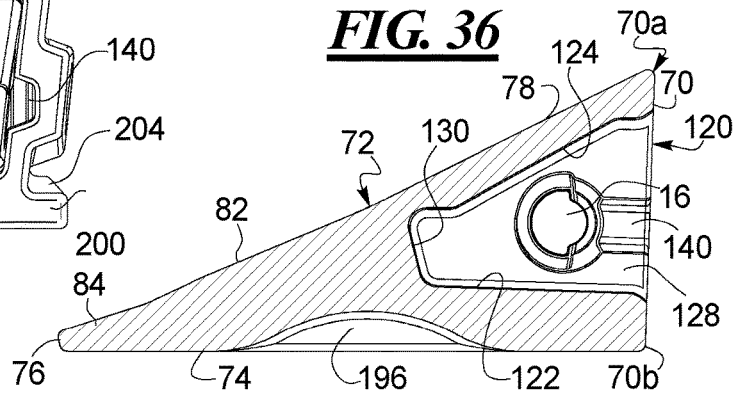
FIG. 36 is a cross-sectional view of the tip of FIG. 31 taken through line 36-36 of FIG. 35.
Figure 37:
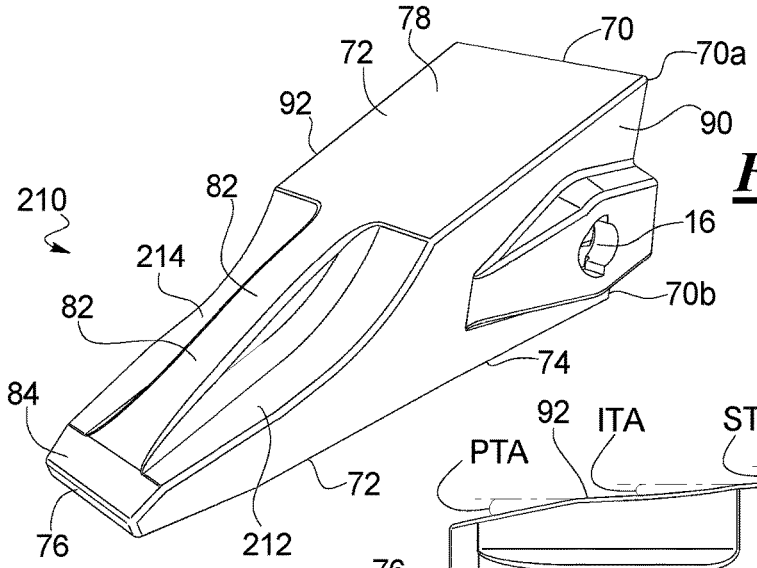
FIG. 37 is an isometric view of an additional alternative of a tip for a tooth assembly in accordance with the present disclosure.
Figure 38:
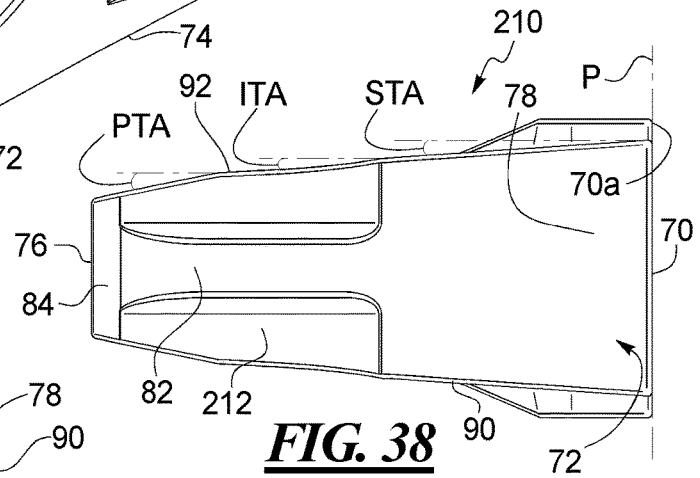
FIG. 38 is a top view of the tip of FIG. 37.
Figure 39:
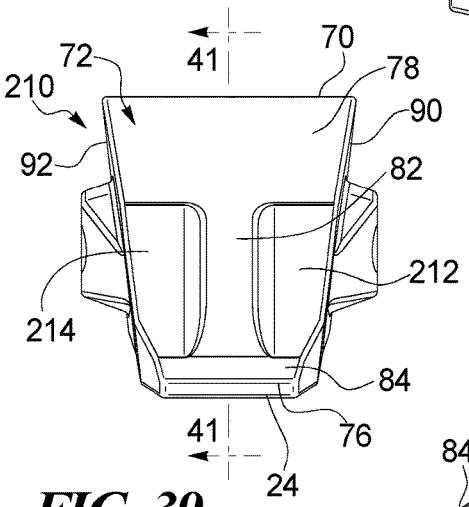
FIG. 39 is a front view of the tip of FIG. 37.

To compensate for the greater abrasion experienced by the tip 190, the bottom outer surface 74 may be widened to provide additional wear material. As best seen in FIGS. 33 and 35, the upper portion of the tip 190 has a similar keystone-shaped contour as the tips discussed above that is complimentary to the contour of the adapter nose 26. Proximate the intersection of the lateral outer surfaces 90, 92 with the bottom outer surface 74, side flanges 198, 200 extend laterally from the lateral outer surfaces 90, 92, respectively, to widen the bottom outer surface 74. The side flanges 198, 200 may extend the entire length of the tip 190 from the rear edge 70 to the front edge 76. Top flange surfaces 202, 204 may extend forward approximately perpendicular to the rear edge 70 of the tip 190, and the bottom outer surface 74 is also a bottom flange surface, and may be angled downwardly relative to the top flange surfaces 202, 204 at the angle θ in the range of 1°-3°, and may be approximately 2°. More specifically, the angle θ is between the bottom outer surface 74 and a line approximately perpendicular to the rear edge 70 and approximately parallel to the top flange surfaces 202, 204 as shown in FIGS. 32 and 35. With this configuration, the distance between the bottom outer surface 74 and the top flange surfaces 202, 204 may increase as the side flanges 198, 200 extend forward from the rear edge 70 toward the front edge 76 until the top flange surfaces 202, 204 intersect the tip portion 84 of the top outer surface 72, which in turn is converging with the bottom outer surface 74 toward the front edge 76. With this arrangement, the side flanges 198, 200 provide additional wear material at the front and bottom of the tip 190 where maximum abrasion may occur. With further reference to FIG. 36, the nose cavity 120 as illustrated is similar in configuration to the nose cavities 120 as described above and complimentary to the nose 26 of the adapter 170, with the bottom inner surface 122 being approximately perpendicular to the rear edge 70.

Penetration Tip for Bottom-Wearing Applications (FIGS. 37-41)

Where the tooth assemblies 10 are being used in rocky environments where a greater ability to penetrate the work material may be required, it may be required to provide the tip having a sharper penetration end for breaking up the work material. Referring to FIGS. 37-41, a penetration tip 210 is illustrated with the top outer surface 72 and bottom outer surface 74 extending forward from the rear edge 70 and converging to the front edge 76. The top outer surface 72 may include reliefs 212, 214 on either side of the front portion 82 similar to the reliefs 192, 194 described above. The rear portion 78 of the top outer surface 72 may extend forward from the rear edge 70 with the lateral outer surfaces 90, 92 being approximately parallel or slightly tapered at a side taper angle "STA" of approximately 3° to match the taper of the nose 26 of the adapter 170 and converging as the lateral outer surfaces 90, 92 extend from the rear edge 70. As the rear portion 78 approaches the front edge 76, the top outer surface 72 may transition into the front portion 82. The lateral outer surfaces 90, 92 having a greater taper such that the lateral outer surfaces 90, 92 may transition into the front portions 98, 100 that may initially be approximately parallel of have an intermediate taper angle "ITA" of approximately 0.8° and then further transition as the front portions 98, 100 approach the front edge 76 to have a greater taper at a penetration taper angle "PTA" of approximately 10° with respect to a line perpendicular to the plane "P" to converge at a greater rate than the convergence within the rear portion 78. Consequently, the front edge 76 may be narrower in relation to the general width of the penetration tip 210 than in the other embodiments of the tip 180, 190. The narrow front edge 76 may provide a smaller surface area for engaging the rocky work material, but increase the force per unit of contact area applied to the rocky work material by the series of tooth assemblies 10 attached at the base edge 18 of the implement 1, 6 to break up the rocky work material.

Figure 40:
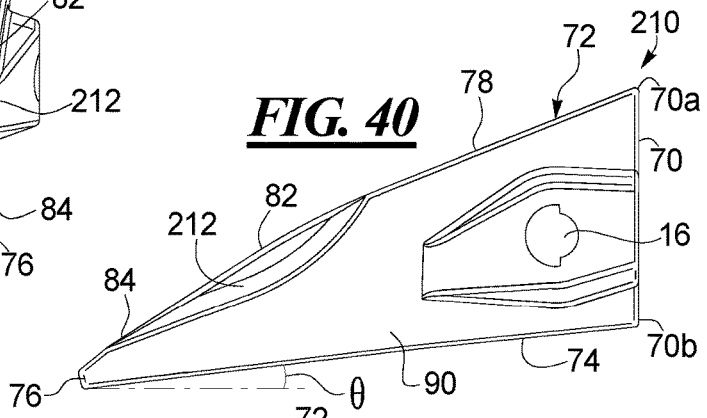
FIG. 40 is a side view of the tip of FIG. 37.
Figure 41:
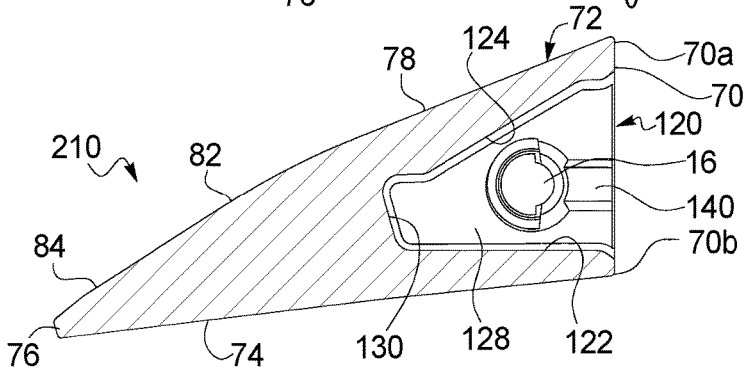
FIG. 41 is a cross-sectional view of the tip of FIG. 37 taken through line 41-41 of FIG. 39.

While wear material may be removed from the penetration tip 210 by narrowing the front edge 76, additional wear material still may be provided to the bottom outer surface 74 by angling the bottom outer surface 74 downwardly as it extends from the rear edge 70 as shown in FIGS. 40 and 41. The nose cavity 120 has the configuration described above with the bottom inner surface 122 extending approximately perpendicular to the rear edge 70 of the tip 210. The bottom outer surface 74 may be angled downwardly relative to a line approximately parallel to the bottom inner surface 122 and approximately perpendicular to the rear edge 70 at angle θ that is in the range of 6°-8°, and may be approximately 7°.

Unitary Tooth for Top-Wearing Applications (FIGS. 42-45)

The tooth assemblies discussed above are each comprised of an adapter and a tip attached thereto. In some applications, it may be desirable to attach a unitary component to the implement 1, 6 to, for example, eliminate the risk of failure of the retention mechanism attaching a tip to an adapter nose. To accommodate such implementations, the various combinations of adapters and tips set forth above may be configured as unitary components providing operational benefits described herein. As an example, FIGS. 42-45 illustrate an integrally formed unitary general duty tooth 270 for top-wearing applications having characteristics of the adapter 12 and the tip 14. The tooth 270 may include rear top and bottom straps 272, 274, respectively, and a front tip portion 276 connected by an intermediate portion 278. The tip portion 276 may include a top outer surface 280 and a bottom outer surface 282 extending forward from the intermediate portion 278 and converging at a front edge 284. The top and bottom outer surfaces 280, 282 may have generally the same geometries as the top and bottom outer surfaces 72, 74, respectively, of the tip 14, and the bottom outer surface 282 may include a relief (not shown). The tip portion 276 may further include oppositely disposed lateral outer surfaces 286, 288 extending between the top outer surface 280 and the bottom outer surface 282.

Figure 43:
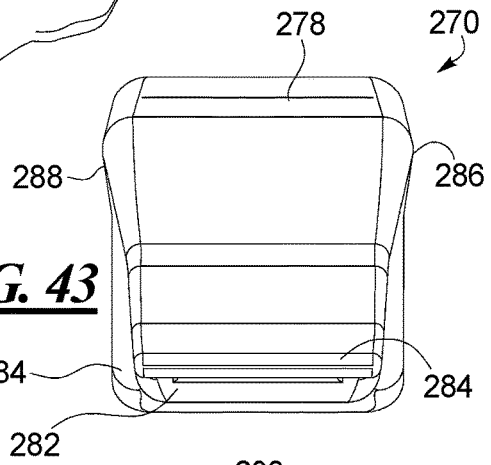
FIG. 43 is a front view of the tooth of FIG. 42.

As best seen in FIG. 43, the lateral outer surfaces 286, 288 may be angled so that the distance between the lateral outer surfaces 286, 288 increases as the lateral outer surfaces 286, 288 extend vertically from the bottom outer surface 282 toward the top outer surface 280. Configured in this way, the tip portion 276 may have a similar keystone-shaped contour as the tip 14 to provide a greater amount of wear material proximate the top surface 280 than proximate the bottom surface 282 where a greater amount of abrasion and wear occur in top-wearing applications. Due to the geometric similarities, the tip portion 276 may have wear material wear away over time in a similar manner as the tip 14 as illustrated in FIGS. 63-70 and described in the accompanying text.

Figure 42:
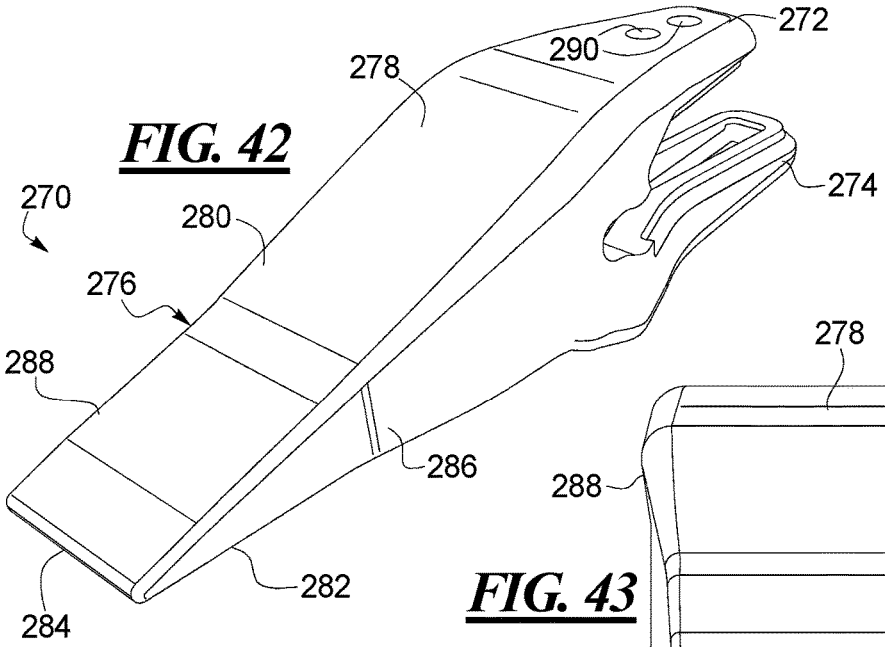
FIG. 42 is an isometric view of a top-wearing application tooth in accordance with the present disclosure.
Figure 44:
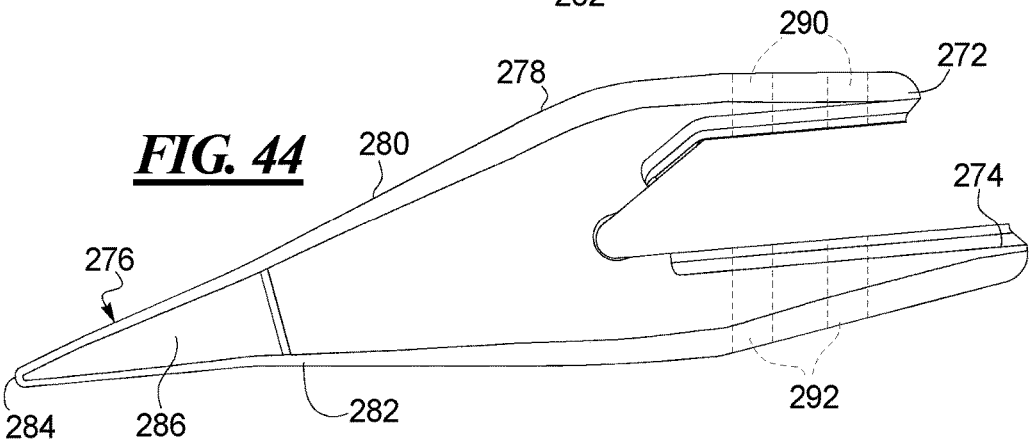
FIG. 44 is a side view of the tooth of FIG. 42.
Figure 45:
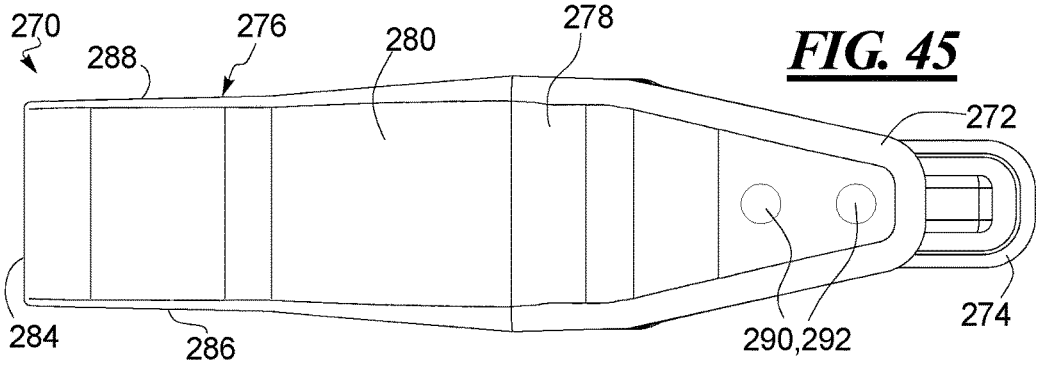
FIG. 45 is a top view of the tooth of FIG. 42.

In order for the tooth 270 to be replaceable, the tooth 270 may be bolted or similarly demountably fastened to the base edge 18 of the implement 1, 6 instead of being welded to the surface. The straps 272, 274 may be configured for such attachment to the base edge 18 by providing apertures 290, 292 through the straps 272, 274, respectively, as seen in FIGS. 42, 44 and 45. During assembly, the apertures 290, 292 may be aligned with corresponding apertures of the base edge 18, and appropriate connection hardware may be inserted to retain the tooth 270 on the base edge 18 of the implement 1, 6. After the tip portion 276 wears down to the point of requiring replacement, the connection hardware may be disconnected and the remains of the tooth 270 may be removed and replaced by a new tooth 270.

Unitary Tooth for Bottom-Wearing Applications (FIGS. 46-49)

Figure 46:
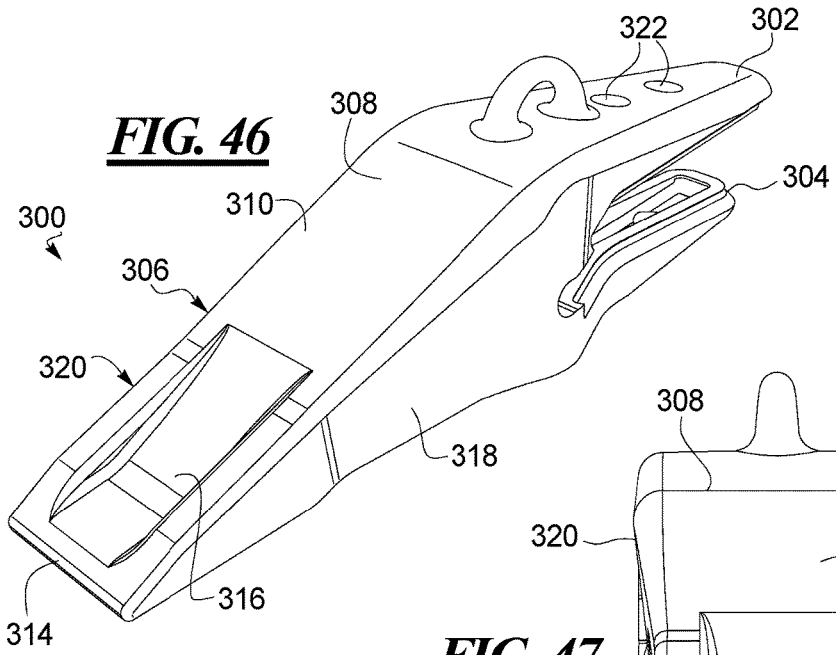
FIG. 46 is an isometric view of a bottom-wearing application tooth in accordance with the present disclosure.
Figure 47:
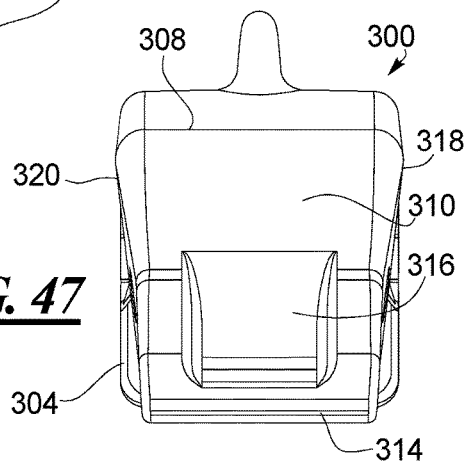
FIG. 47 is a front view of the tooth of FIG. 46.

It may also be desirable in bottom-wearing implementations, such as loader buckets, to attach a unitary component to the base edge 18 of the implement 1, 6. FIGS. 46-49 illustrate an integrally formed unitary general duty tooth 300 for bottom-wearing applications having characteristics of the adapter 170 and general duty tip 180. The tooth 300 may include rear top and bottom straps 302, 304, respectively, and a front tip portion 306 connected by an intermediate portion 308. The tip portion 306 may include a top outer surface 310 and a bottom outer surface 312 extending forward from the intermediate portion 308 and converging at a front edge 314. The top and bottom outer surfaces 310, 312 may have generally the same geometries as the top and bottom outer surfaces 72, 74, respectively, of the tip 180, and the top outer surface 312 may include a relief 316. The tip portion 306 may further include oppositely disposed lateral outer surfaces 318, 320 extending between the top outer surface 310 and the bottom outer surface 312. As best seen in FIG. 47, the lateral outer surfaces 318, 320 may be angled so that the distance between the lateral outer surfaces 318, 320 increases as the lateral outer surfaces 318, 320 extend vertically from the bottom outer surface 312 toward the top outer surface 310. Due to the geometric similarities, the tip portion 306 may have wear material wear away over time in a similar manner as the tip 180 as illustrated in FIGS. 70-75 and described in the accompanying text.

Figure 48:
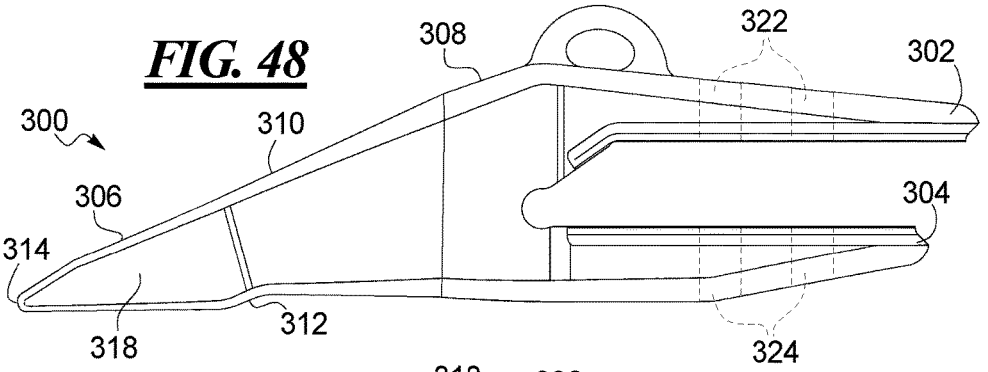
FIG. 48 is a side view of the tooth of FIG. 46.
Figure 49:
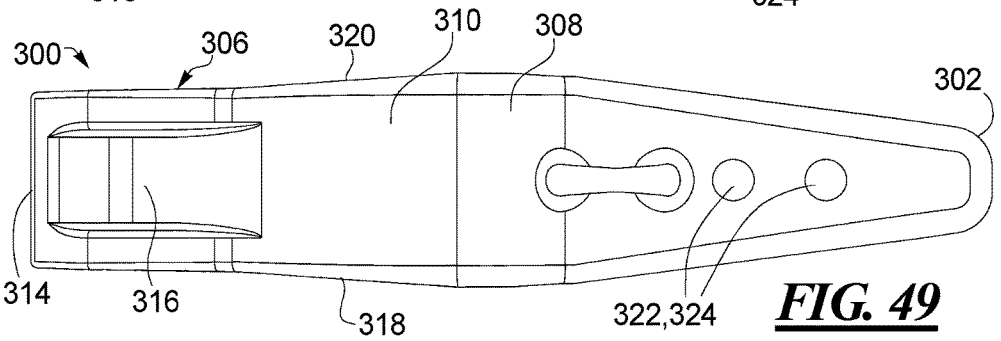
FIG. 49 is a top view of the tooth of FIG. 46.

In order for the tooth 300 to be replaceable, the tooth 300 may be bolted or similarly demountably fastened to the base edge 18 of the implement 1, 6 instead of being welded to the surface. The straps 302, 304 may be configured for such attachment to the base edge 18 by providing apertures 322, 324 through the straps 302, 304, respectively, as seen in FIGS. 46, 48 and 49. During assembly, the apertures 322, 324 may be aligned with corresponding apertures of the base edge 18, and appropriate connection hardware may be inserted to retain the tooth 300 on the base edge 18 of the implement 1, 6. After the tip portion 306 wears down to the point of requiring replacement, the connection hardware may be disconnected and the remains of the tooth 300 may be removed and replaced by a new tooth 300.

INDUSTRIAL APPLICABILITY

Tooth assemblies 10 in accordance with the present disclosure incorporate features that may extend the useful life of the tooth assemblies 10 and improve the efficiency of the tooth assemblies 10 in penetrating into the work material. As discussed above, the substantially keystone-shaped contour 93 of the tip 14, for example, places a greater amount of wear material towards the top of the tip 14 where a greater amount of abrasion occurs in top-wearing applications. At the same time, wear material is removed from the lower portion of the tip 14 where less abrasion occurs, thereby reducing the weight and the cost of the tip 14, though in some implementations the top strap 20 may need to be thicker than dictated by abrasion to provide sufficient strength and help prevent breakage due to the loading forces. In bottom-wearing applications, the tips 180, 190, 210 may be provided with additional wear material proximate the bottom of the tips 180, 190, 210 where a greater amount of wear occurs as the tips 180, 190, 210 scrape along the ground.

The design of the tooth assemblies 10 in accordance with the present disclosure may also reduce the stresses applied to the projections 58 and the retention mechanism connecting the tips 14, 150, 180, 190, 210 to the adapters 12, 170. Using the adapter 12 and tip 14 for illustration in FIGS. 51 and 52, based on the machining tolerances required in the retention apertures 16, the projections 58 and the corresponding components of a retention mechanism (not shown), the tip 14 may experience movement relative to the adapter 12, and in particular to the nose 26, during use of the machine. The relative movement may cause shear stresses in the components of the retention mechanism as the adapter 12 and tip 14 move in opposite directions. In prior tooth assemblies where a nose of an adapter may have a triangular shape in cross-section, or may have a more rounded shape than the substantially keystone-shaped contour 62 of the nose 26, facing surfaces of the nose of the adapter and the nose cavity of the tip may separate and allow the tip to rotate about a longitudinal axis of the tooth assembly relative to the adapter. The twisting of the tip may cause additional shear stresses on the components of the retention mechanism.

Figure 50:
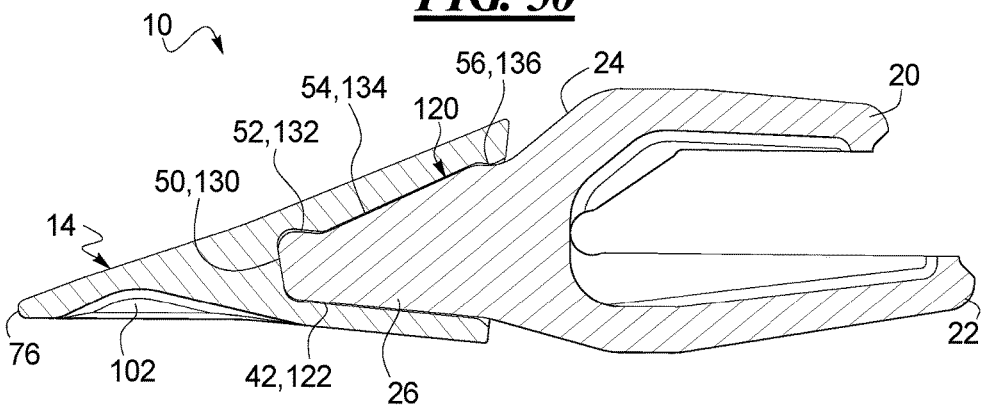
FIG. 50 is a cross-sectional view of the tooth assembly of FIG. 3 taken through line 50-50 with the tip as shown in FIG. 16 installed on the adapter of FIG. 6.

In contrast, in the tooth assemblies 10 in accordance with the present disclosure, the support surfaces 52, 56 of the adapter nose 26 may be engaged by the corresponding support portions 132, 136 that define the nose cavity 120. As shown in the cross-sectional view of FIG. 50, when the tip 14 is installed on the adapter nose 26 and disposed at a maximum engagement position, the planar surfaces of the nose 26 are engaged by the corresponding planar portions of the surfaces that define the nose cavity 120 of the tip 14. Consequently, the bottom surface 42 of the adapter 12 may face and engage the bottom inner surface 122 of the tip 14, the support surfaces 52, 54, 56 of the top surface 44 of the adapter 12 may face and engage the corresponding portions 132, 134, 136 of the top inner surface 124 of the tip 14 and the front surface 50 of the adapter 12 may face and engage the front inner surface 130 of the tip 14. Though not shown, the side surfaces 46, 48 of the nose 26 of the adapter 12 may face and engage the side inner surfaces 126, 128, respectively, of the nose cavity 120 of the tip 14. With the surfaces engaging, the tip 14 may remain relatively stationary with respect to the nose 26 of the adapter 12.

Figure 51:
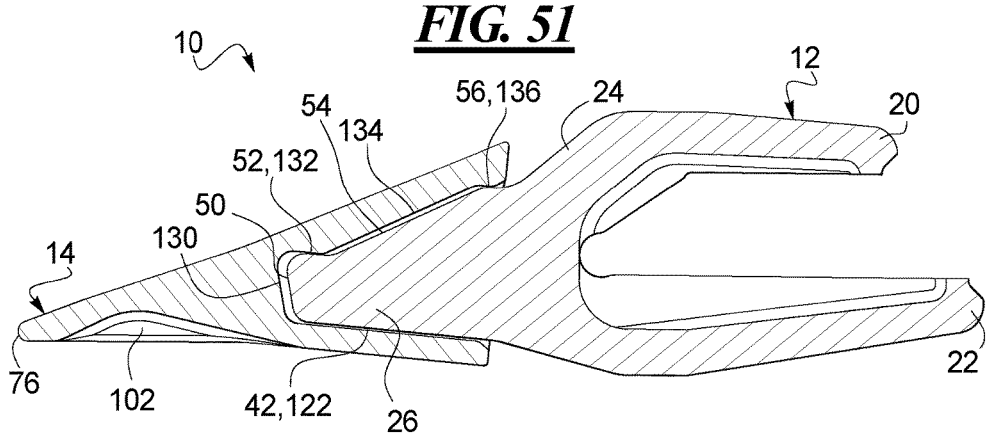
FIG. 51 is the cross-sectional view of the tooth assembly of FIG. 50 with the tip moved forward due to tolerances within a retention mechanism.

Due to the tolerances within the retention mechanism, the tip 14 may be able to slide forward on the nose 26 of the adapter 12 is illustrated in FIG. 51. As the tip 14 slides forward, some of the facing surfaces of the nose 26 of the adapter 12 and the nose cavity 120 of the tip 14 may separate and disengage. For example, the intermediate portion 134 of the top inner surface 124 of the tip 14 may disengage from the intermediate surface 54 of the nose 26 of the adapter 12, and the front inner surface 130 of the tip 14 may disengage from the front surface 50 of the adapter 12. Because the distance between the side surfaces 46, 48 of the nose 26 of the adapter 12 may narrow as the nose 26 extends outward from the intermediate portion 24 of the adapter 12 as shown in FIGS. 7 and 8, the side inner surfaces 126, 128 of the tip 14 may separate from the side surfaces 46, 48, respectively. Despite the separation of some surfaces, engagement between the nose 26 of the adapter 12 and nose cavity 120 of the tip 14 may be maintained over the range of movement of the tip 14 caused by the tolerances within the retention mechanism. As discussed previously, the bottom surface 42 and support surfaces 52, 56 of the nose 26 of the adapter 12, and the bottom inner surface 122 and support portions 132, 136 of the top inner surface 124 of the tip 14, may be generally parallel. Consequently, the tip 14 may have a direction of motion substantially parallel to, for example, the bottom surface 42 of the nose 26 of the adapter 12, with the bottom surface 42 maintaining contact with the bottom inner surface 122 of the nose cavity 120 of the tip 14, and the support portions 132, 136 of the top inner surface 124 of the tip 14 maintaining contact with the support surfaces 52, 56 of the adapter 12, respectively. With the planar surfaces remaining in contact, the tip 14 may be constrained from substantial rotation relative to the nose 26 that may otherwise cause additional shear stresses on the retention mechanism components. Even where draft angles may be provided in the bottom surface 42, the bottom inner surface 122, the support surfaces 52, 56 and the support portions 132, 136, and a slight separation may occur between the facing surfaces, the rotation of the tip 14 may be limited to an amount less than that at which shear stresses may be applied to the components of the retention mechanism. By reducing the shear stresses applied to the retention mechanism, it is anticipated that the rate of failure of the retention mechanisms, and correspondingly the instances of the breaking off of the tips 14 prior to the end of their useful lives, may be reduced.

The configuration of the tooth assemblies 10 according to the present disclosure may also facilitate a reduction in the shear stresses on the retention mechanisms when forces are applied that may otherwise tend to cause the tips 14, 150, 180, 190, 210, 220 (FIGS. 57 and 58) to slide off the nose 26 of the adapters 12, 170. Because adapter noses known in the art typically have a generally triangular configuration and taper laterally as the noses extend forward away from the straps, forces applied during use may generally influence the tips to slide off the front of the adapter noses. Such movement is resisted by the retention mechanism, thereby causing shear stresses. The noses 26 of the adapters 12, 170 in accordance with the present disclosure may at least in part counterbalance to forces tending to cause the tips 14, 150, 180, 190, 210, 220 to slide off the adapter noses 26.

Figures 52A, 52B, 52C, 52D, 52E, 52F:
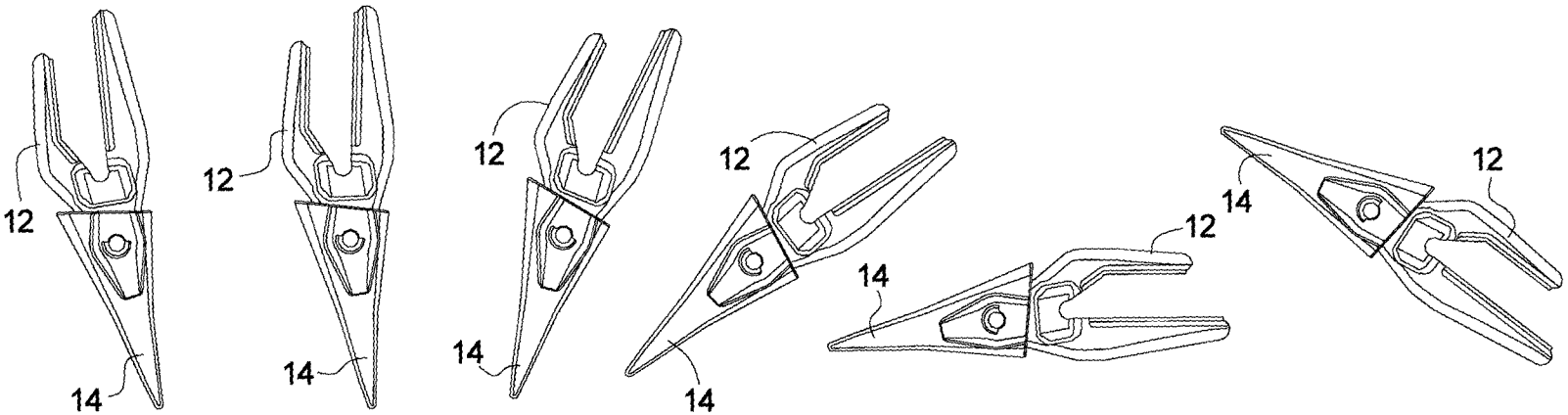
FIGS. 52A, 52B, 52C, 52D, 52E, and 52F are schematic illustrations of the sequence of orientations of the tooth assembly of FIG. 3 when an excavator implement gathers a load of work material.

FIGS. 52A, 52B, 52C, 52D, 52E, and 52F illustrate the orientations of the tooth assembly 10 formed by the adapter 12 and the tip 14 as the implement of a top-wearing application, such as the excavator bucket assembly 6, digs into the work material and scoops out a load. The adapter 12 and tip 14 are used for illustration in FIGS. 52-56, but those skilled in the art will understand that the various combinations of the adapters 12, 170 and the tips 14, 150, 180, 190, 210, 220 would interact in a similar manner as described hereinafter. The front edge 76 of the tooth assembly 10 initially penetrates the work material downwardly with an orientation slightly past vertical as shown in FIG. 52A. After the initial penetration, the implement 6 and tooth assemblies 10 may be rotated rearward and drawn toward the earth moving machine by the boom of the machine, thereby rotating through the orientations shown in FIGS. 52B, 52C, and 52D. During this movement through the work material, the top outer surfaces 72 of the tips 14 form the primary engagement surface with the work material, and the tips 14 may encounter the greatest forces as they break through the work material. The tips 14 also experience the greatest abrasion on the top outer surfaces 72. The substantially keystone-shaped contour 93 of the tips 14 provides additional wear material at the top outer surfaces 72 to prolong the useful life of the tips 14. The substantially keystone-shaped contour 93 also facilitates the movement of the tips 14 through the work material, as the work material will flow around the edges of the top outer surfaces 72 with less engagement of the tapering lateral outer surfaces 90, 92.

The implement 6 eventually rotates the tooth assembly 10 to the horizontal orientation shown in FIG. 52E. At this point, the implement 6 is drawn further rearward toward the machine, with the front edge 76 leading the tooth assembly 10 through the work material. Finally, after further rotation of the implement 6 to the position shown in FIG. 52F, the tooth assembly 10 may be oriented upwardly, and the implement 6 may be lifted out of the work material with the excavated load.

Figure 53:
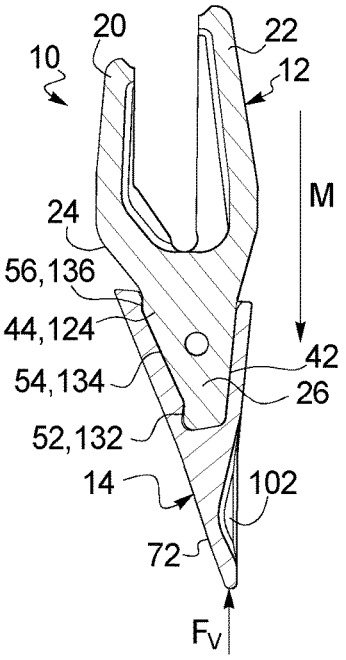
FIG. 53 is the cross-sectional view of the tooth assembly of FIG. 50 with the section lines removed and showing a force applied to the tooth assembly when the excavator implement is in the orientation of FIG. 52A.

FIG. 53 illustrates the tooth assembly 10 with the generally vertical orientation of FIG. 52A that may occur when the implement 6 is being driven downward into a pile or surface of work material in the direction indicated by arrow "M". The work material may resist penetration of the tooth assembly 10, resulting in the application of a vertical force $F_V$ against the front edge 76. The force $F_V$ may push the tip 14 toward the adapter 12 and into tighter engagement with the nose 26 of the adapter 12 without increasing the shear stresses on the retention mechanism.

Figure 54:
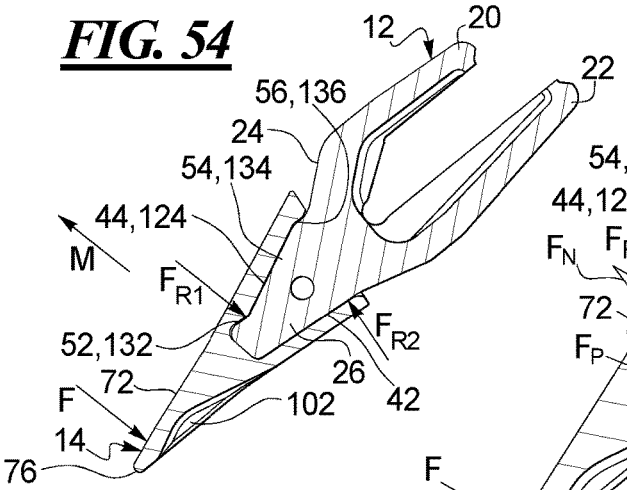
FIG. 54 is the cross-sectional view of the tooth assembly of FIG. 53 showing a force applied to the tooth assembly when the excavator implement is in the orientation of FIG. 52C.

In FIG. 54, the tooth assembly 10 is illustrated in the position of FIG. 52C wherein the implement 6 may be partially racked upwardly as the machine draws the implement 6 rearward and upward to further break and gather a load of work material as indicated by the arrow "M". As the implement 6 is drawn through the work material, a force F may be applied to the top outer surface 72 of the tip 14. The force F may be a resultant force acting on the front portion 82 and/or the tip portion 84 of the tip 14 that may be a combination of the weight of the work material and resistance of the work material from being dislodged. The force F may be transmitted through the tip 14 to the adapter nose 26 and the top inner surface 124 of the nose cavity 120 of the tip 14 for support, and thereby yielding a first resultant force $F_{R1}$ on the front support surface 52 of the adapter 12. Because the line of action of the vertical force $F_V$ is located proximate the front edge 76, the vertical force $F_V$ tends to rotate the tip 14 in a counterclockwise direction as shown about the nose 26 of the adapter 12, with the first support surface 52 of the adapter 12 acting as the fulcrum of the rotation. The moment created by the vertical force $F_V$ causes a second resultant force $F_{R2}$ acting on the bottom surface 42 of the adapter 12 proximate the intermediate portion 24 of the adapter 12.

Figure 55:
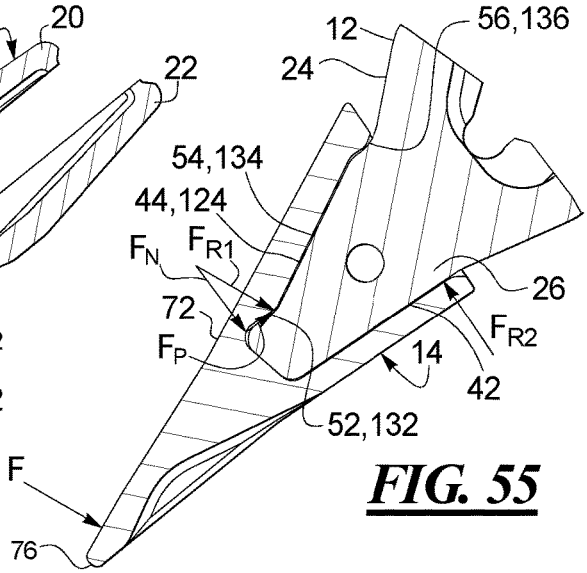
FIG. 55 is an enlarged view of the tooth assembly of FIG. 54 illustrating forces acting on the nose of the adapter and the nose cavity surfaces of the tip.

In previously known tip assemblies having continuously sloping top surfaces of the noses, the first resultant force $F_{R1}$ would tend to cause the tip to slide off the front of the nose, and thereby cause additional strain on the retention mechanism. In contrast, the orientation of the front support surface 52 of the adapter 12 with respect to the intermediate surface 54 of the adapter 12 causes the tip 14 to slide into engagement with the nose 26. FIG. 55 illustrates an enlarged portion of the adapter nose 26 and the tip 14, and shows the resultant forces tending to cause movement of the tip 14 relative to the adapter nose 26. The first resultant force $F_{R1}$ acting on the front support surface 52 of the adapter 12 and first support portion 132 of the tip 14 has a first normal component $F_N$ acting perpendicular to the front support surface 52, and a second component $F_P$ acting parallel to the front support surface 52 and the first support portion 132. Due to the orientation of the front support surface 52 of the adapter 12 and first support portion 132 of the tip 14 relative to the intermediate surface 54 of the adapter 12 and intermediate portion 134 of the tip 14, the parallel component $F_P$ or the first resultant force $F_{R1}$ tends to cause the tip 14 to slide rearward and into engagement with the nose 26 of the adapter 12. The parallel component $F_P$ tending to slide the tip 14 onto the nose 26 reduces the shear stresses applied on the components of the retention mechanism and correspondingly reduces the incidence of failure of the retention mechanism.

Figure 56:
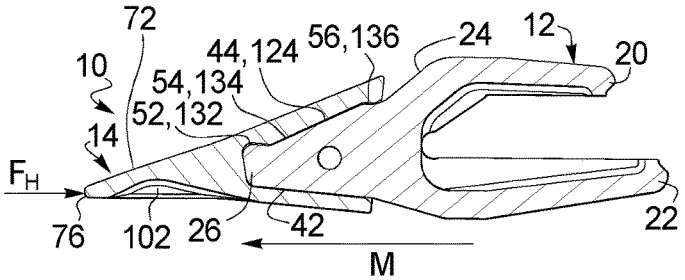
FIG. 56 is the cross-sectional view of the tooth assembly of FIG. 53 showing a force applied to the tooth assembly when the excavator implement is in the orientation of FIG. 52E.

FIG. 56 illustrates the tooth assembly 10 in the generally horizontal orientation shown in the FIG. 52E as may occur when the implement 6 is being drawn rearward toward the machine in the generally horizontal direction of arrow "M". The work material may resist the movement of the tooth assembly 10, resulting in the application of a horizontal force $F_H$ against the front edge 76. Similar to the vertical force $F_V$ in FIG. 53, the horizontal force $F_H$ may push the tip 14 toward the adapter 12 and into tighter engagement with the nose 26 without increasing the shear stresses on the retention mechanism.

Figure 57:
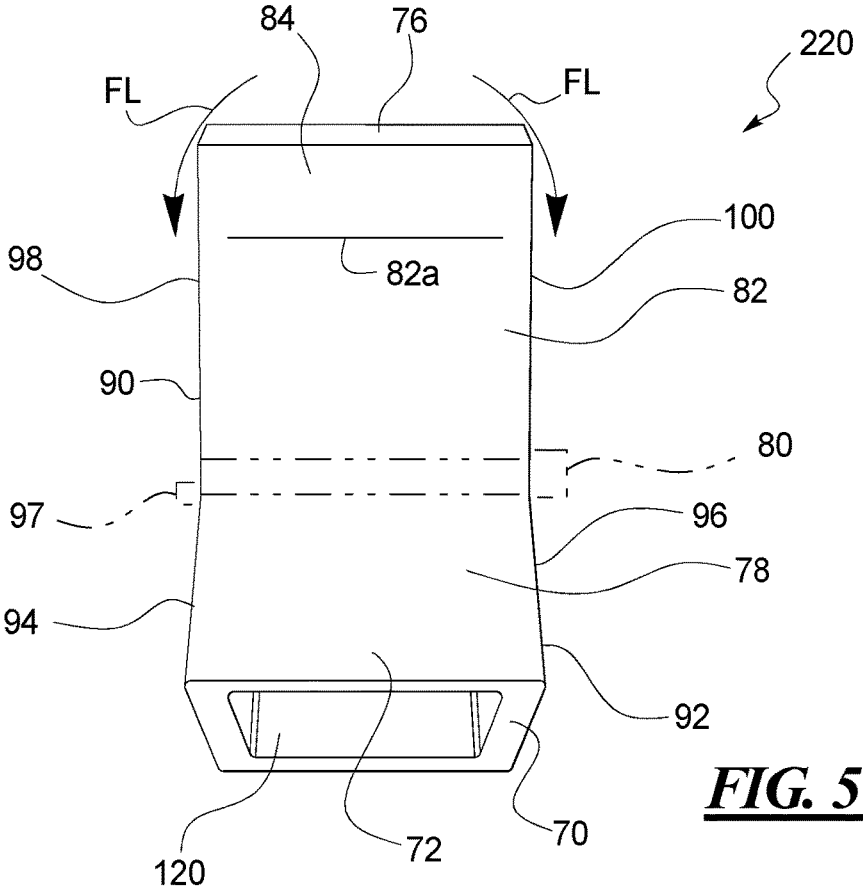
FIG. 57 is a top view of an alternative embodiment of a tooth assembly in accordance with the present disclosure.
Figure 58:
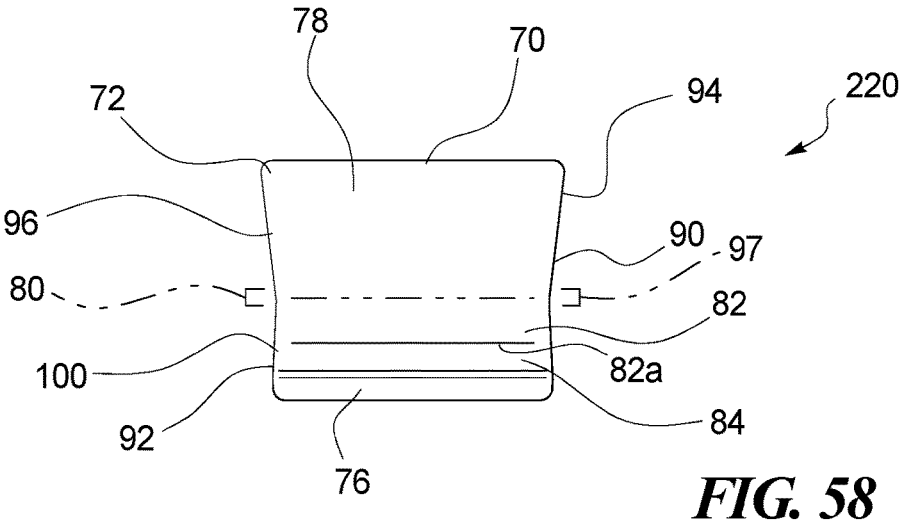
FIG. 58 is a front view of the tooth assembly of FIG. 57.

As discussed above, the substantially keystone-shaped contour 93 of the tip 14 may provide soil flow with reduced drag when the tip 14 moves through the work material with the top outer surface 72 leading as in FIGS. 52B, 52C, and 52D. However, this benefit of the substantially keystone-shaped contour 93 may be minimal when the tooth assembly 10 of FIG. 3 is oriented as in FIGS. 52A, 52E, and 52F and moving though the work material with the front edge 76 leading. FIGS. 57 and 58 illustrate an alternative embodiment of a tip 220 configured to reduce drag from soil flow as the front edge 76 leads the tip 220 through the work material. In this embodiment, similar elements are indicated by the same reference numerals as used it the discussion of the tip 14. The tip 220 may be longitudinally configured with a substantially hourglass-shaped contour. The rear portions 94, 96 of the lateral outer surfaces 90, 92 may taper inwardly as they extend forward from the rear edge 70 such that the distance between the rear portions 94, 96 decreases as the rear portions 94, 96 approach the side transition area 97. Beyond the transition area 97, the front portions 98, 100 may diverge as the front portions 98, 100 progress forward to a maximum width proximate the front edge 76. The tapering of the front portions 98, 100 of the lateral outer surfaces 90, 92 behind the front edge 76 may reduce the amount of drag experienced by the tip 220 as it passes through the work material. As the front edge 76 digs into the work material, the work material on the sides flows outwardly and around the tip 220 as indicated by the arrows "FL" in FIG. 57, with less engagement of the lateral outer surfaces 90, 92 than if the front portions 98, 100 were parallel and maintained a constant width as the front portions 98, 100 extend toward the rear edge 70 from the front edge 76.

Figure 59:
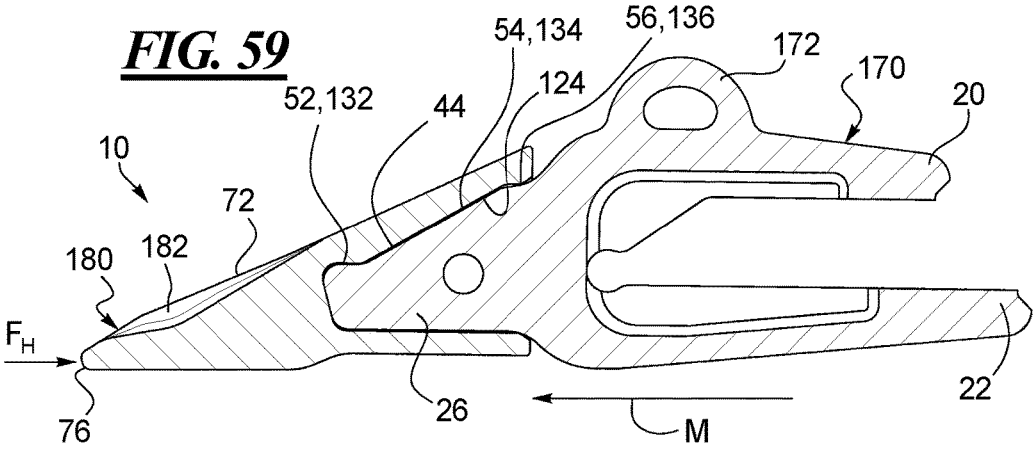
FIG. 59 is the cross-sectional view of the tooth assembly formed by the adapter of FIG. 23 and the tip of FIG. 26 and showing a force applied to the tooth assembly when a loader implement digs into a pile of work material.

The discussion of FIGS. 52-56 above set forth the performance of the components of the tooth assemblies 10 in accordance with the present disclosure during the range of motion of an implement 6 in a top-wearing application. The adapter nose 26 in accordance with the present disclosure may similarly counterbalance forces tending to cause the tips 14, 150, 180, 190, 210, 220 to slide off the adapter noses 26 of the adapters 12, 170 in bottom-wearing applications, such as during the loading sequence shown in FIGS. 59-61. FIG. 59 illustrates the tooth assembly 10 formed by the adapter 170 and tip 180 with a generally horizontal orientation as may occur when the machine is being driven forward into a pile of work material as indicated by arrow "M". The work material may resist penetration of the tooth assembly 10 into the pile, resulting in the application of a horizontal force $F_H$ against the front edge 76. The force $F_H$ may push the tip 14 toward the adapter 12 and into tighter engagement with the nose 26 without increasing the shear stresses on the retention mechanism.

Figure 60:
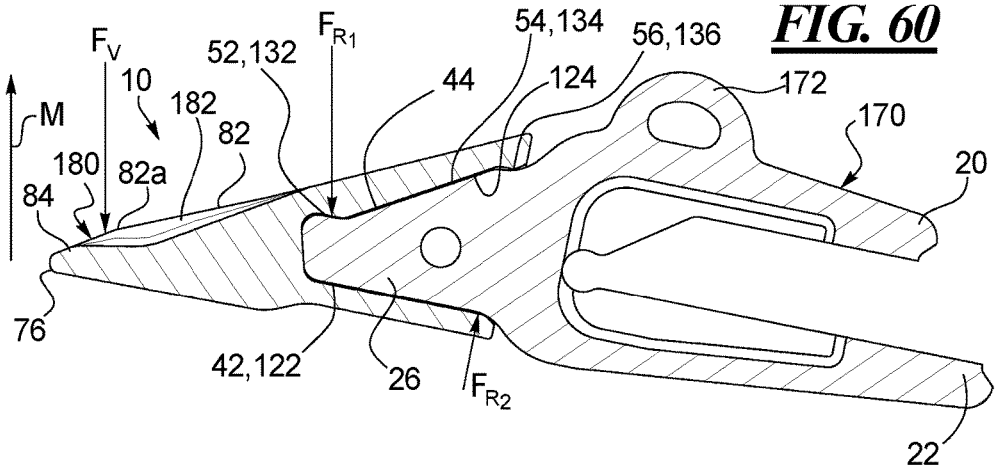
FIG. 60 is the cross-sectional view of the tooth assembly of FIG. 59 with the tooth assembly and loader implement directed partially upward and showing forces applied to the tooth assembly when the loader implement is raised up through the pile of work material.

In FIG. 60, the tooth assembly 10 is illustrated in a position wherein the implement 1 may be partially racked upwardly as the machine begins to lift a load of work material out of the pile in the direction indicated by arrow "M". As the implement 1 is lifted out of the work material, a vertical force $F_V$ may be applied to the top outer surface 72 of the tip 180. The vertical force $F_V$ may be a resultant force acting on the front portion 82 and/or tip portion 84 that may be a combination of the weight of the work material and resistance of the work material from being dislodged from the pile. The vertical force $F_V$ may be transmitted through the tip 180 to the adapter nose 26 for support, and thereby yielding a first resultant force $F_{R1}$ on the front support surface 52 of the adapter nose 26. Because the line of action of the vertical force $F_V$ is located proximate the front edge 76, the vertical force $F_V$ tends to rotate the tip 180 in a counterclockwise direction as shown about the nose 26 of the adapter 170, with the first support surface 52 of the nose 26 acting as the fulcrum of the rotation. The moment created by the vertical force $F_V$ causes a second resultant force $F_{R2}$ acting on the bottom surface 42 proximate the intermediate portion 24 of the adapter 170. In previously known tip assemblies having continuously sloping top surfaces of the noses, the first resultant force $F_{R1}$ would tend to cause the tip to slide off the front of the nose, and thereby cause additional strain on the retention mechanism.

Figure 61:
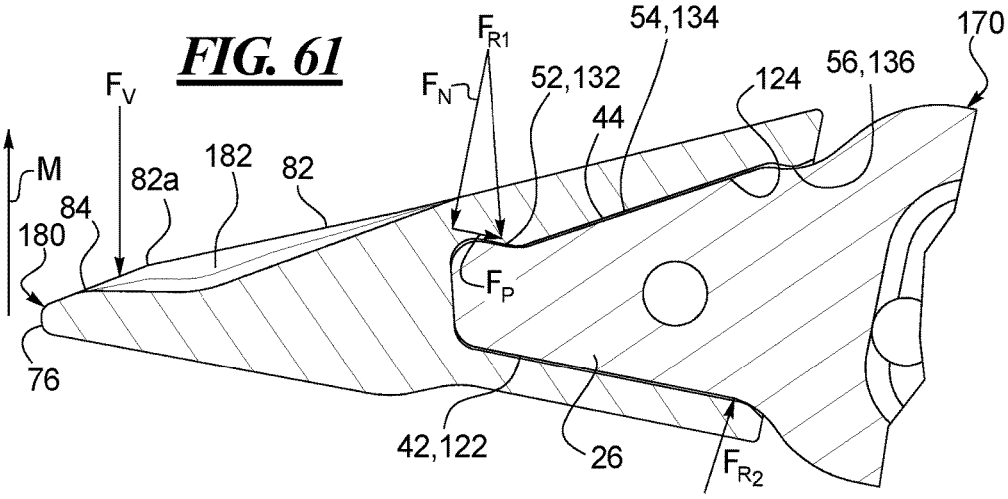
FIG. 61 is an enlarged view of the tooth assembly of FIG. 60 illustrating forces acting on the nose of the adapter and the nose cavity surfaces of the tip.

In contrast, the orientation of the front support surface 52 with respect to the intermediate surface 54 causes the tip 180 to slide into engagement with the nose 26. FIG. 61 illustrates an enlarged portion of the nose 26 of the adapter 170 and the tip 180, and shows the resultant forces tending to cause movement of the tip 180 relative to the nose 26. The first resultant force $F_{R1}$ acting on the front support surface 52 of the adapter 170 and the first support portion 132 of the tip 180 has a first normal component $F_N$ acting perpendicular to the front support surface 52, and a second component $F_P$ acting parallel to the front support surface 52 and first support portion 132. Due to the orientation of the front support surface 52 and first support portion 132 relative to the intermediate surface 54 of the adapter 170 and the intermediate portion 134 of the tip 180, the parallel component $F_P$ of the first resultant force $F_{R1}$ tends to cause the tip 180 to slide rearward and into engagement with the nose 26 of the adapter 170. The parallel component $F_P$ tending to slide the tip 180 onto the nose 26 reduces the shear stresses applied on the components of the retention mechanism, and correspondingly reduces the incidence of failure of the retention mechanism.

Figure 62:
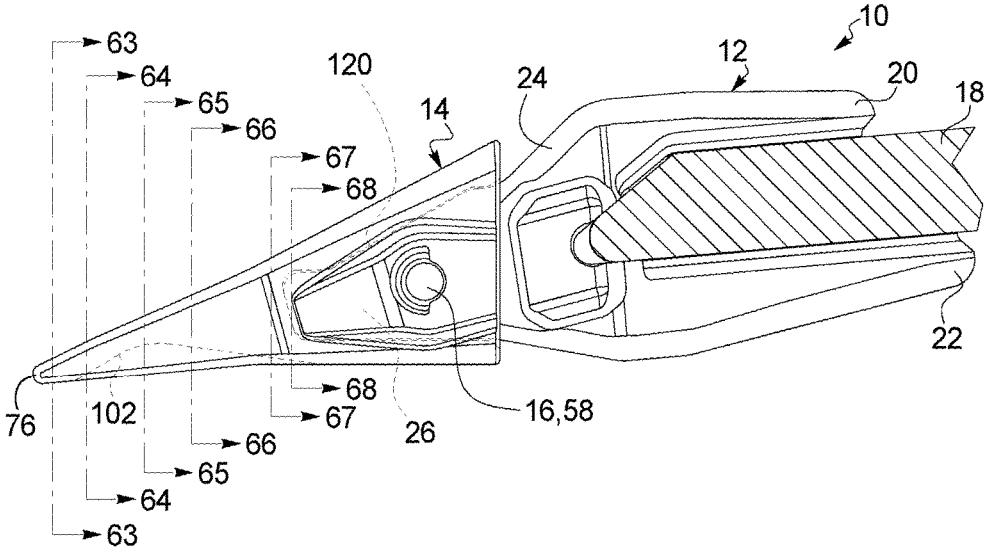
FIG. 62 is a side view of the tooth assembly of FIG. 3.
Figure 63:
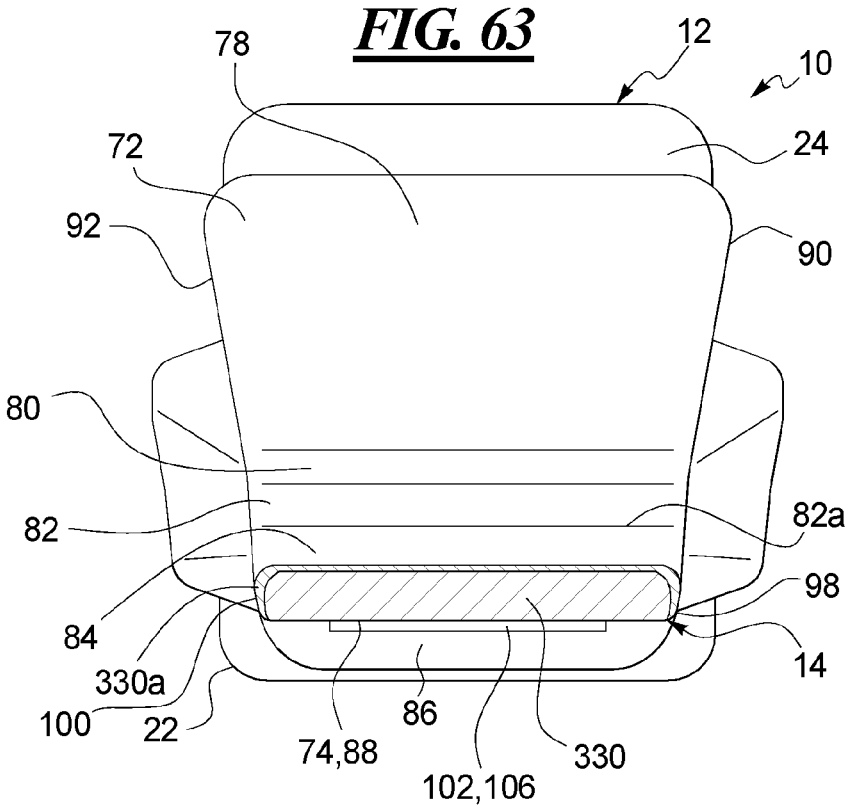
FIG. 63 is a cross-sectional view of the tooth assembly of FIG. 62 taken through line 63-63.

In addition to the retention benefits of the configuration of the noses 26 of the adapters 12, 170 and the nose cavities 120 of the tips 14, 150, 180, 190, 210, 220 as discussed above, the tooth assemblies 10 may provide benefits in during use in top-wearing and bottom-wearing applications. The geometric configurations of the tips 14, 150, 190 of the tooth assemblies 10 in accordance with the present disclosure may provide improved efficiency in penetrating work material in top-wearing applications over the useful life of the tips 14, 150, 190 as compared to tips previously known in the art. As wear material is worn away from the front of the tips 14, 150, 180, 190, 210, the reliefs 102, 158, 160, 196 may provide self-sharpening features to the tips 14, 150, 190 providing improved penetration where previously known tips may become blunted and shaped more like a fist than a cutting tool. Using the tip 14 as an example for purposes of illustrating the self-sharpening feature, the front view of the tip 14 in FIG. 14 shows the front edge 76 forming a leading cutting surface that initially enters the work material. FIG. 62 is a reproduction of FIG. 4 showing the tooth assembly 10 formed by the adapter 12 and tip 14, and the cross-sectional views shown in FIGS. 63-68 illustrate changes in the geometry of the cutting surface as wear material wears away from the front of the tip 14. FIG. 63 shows a cross-sectional view of the tooth assembly 10 of FIG. 62 with the section taken between the front edge 76 and the relief 102. After abrasion wears away the tip 14 to this point, a cutting surface 330 of the tip 14 now presents a cross-sectional area engaging the work material that is less sharp than the front edge 76 as the machine digs the implement 1 into the work material. It will be apparent to those skilled in the art that abrasion from engagement with the work material may cause the outer edges of the cutting surface 330 to become rounded, and for the portions 78, 82, 84 of the top outer surface 72 to wear away as indicated by the cross-hatched area 330*a* and thereby reduce the thickness of the cutting surface 330.

Figure 64:
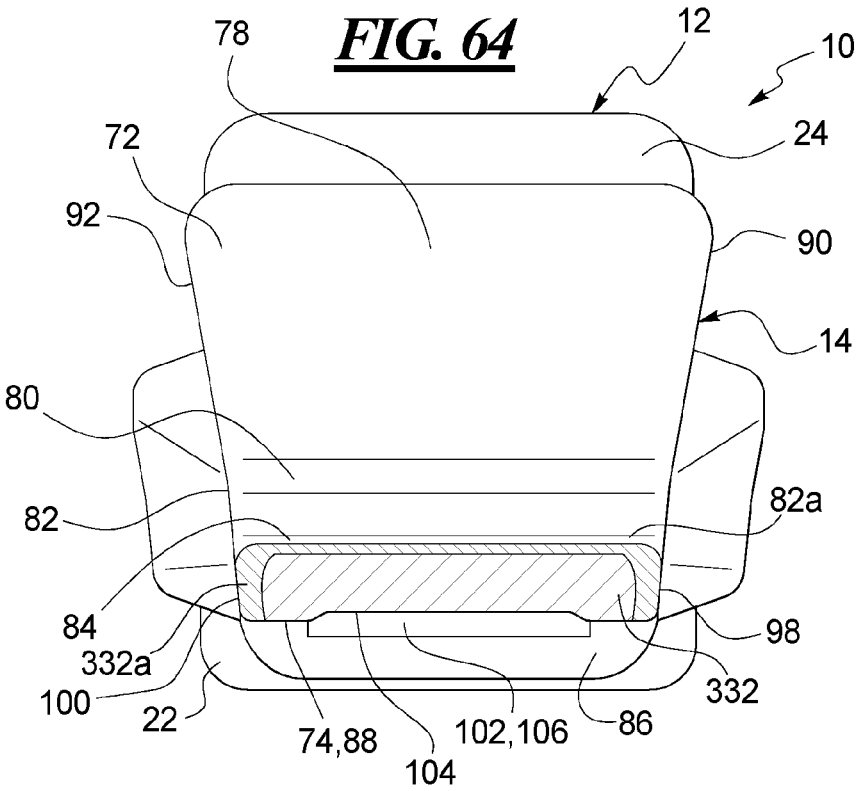
FIG. 64 is a cross-sectional view of the tooth assembly of FIG. 62 taken through line 64-64.
Figure 65:
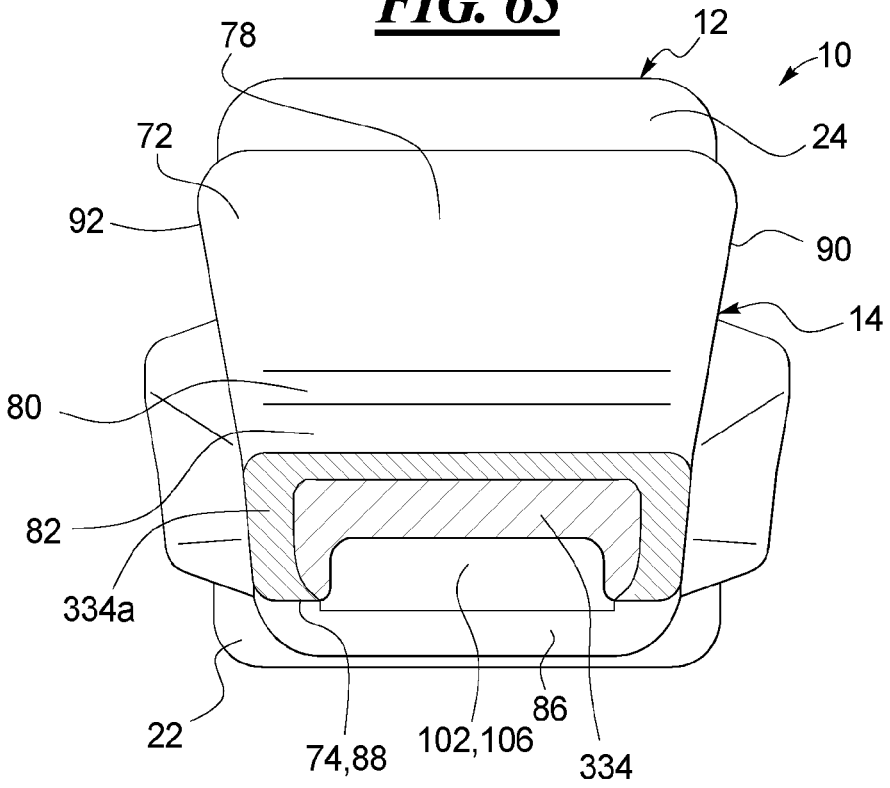
FIG. 65 is a cross-sectional view of the tooth assembly of FIG. 62 taken through line 65-65.
Figure 66:
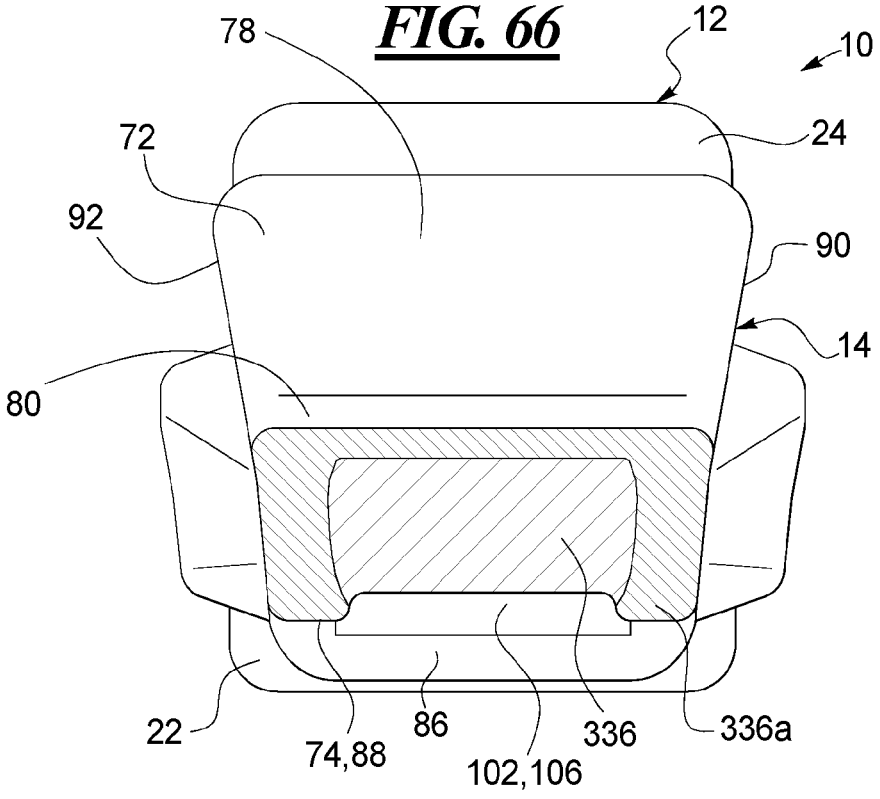
FIG. 66 is a cross-sectional view of the tooth assembly of FIG. 62 taken through line 66-66.

The wear material of the tip 14 continues to wear away rearwardly toward the relief 102. FIG. 64 illustrates a cross-section of the tooth assembly 10 at a position where the front of the tip 14 may have worn away into the portion of the tip 14 providing the relief 102 to form a cutting surface 332. At this point, the tip 14 may have worn through the curved portion 104 of the relief 102 so that the cutting surface 332 includes an intermediate area of reduced thickness. The area of reduced thickness may cause the cutting surface 332 to have a slight inverted U-shape. The wear material removed from the cutting surface 332 by the relief 102 reduces the cross-sectional area of the leading cutting surface 332 of the tip 14 to "sharpen" the tip 14, and correspondingly reduces the resistance experienced as the tips 14 of the implement 1 enter the work material. Wear material continues to wear away from portions 78, 82, 84 as indicated at cross-hatched area 332*a* to further reduce the thickness of the tip 14. At the same time, wear material wears away from the front portions 98, 100 of the lateral outer surfaces 90, 92, respectively, to reduce the width at the front of the tip 14. The tapered portion 106 of the relief 102 allows the work material to flow through the relief surface 102 with less resistance than if the rear portions of the relief 102 were flat or rounded and facing more directly toward the work material. The tapering of the tapered portion 106 reduces forces acting normal to the surface that may resist the flow of the work material and the penetration of the tip 14 into the work material.

Figure 75:
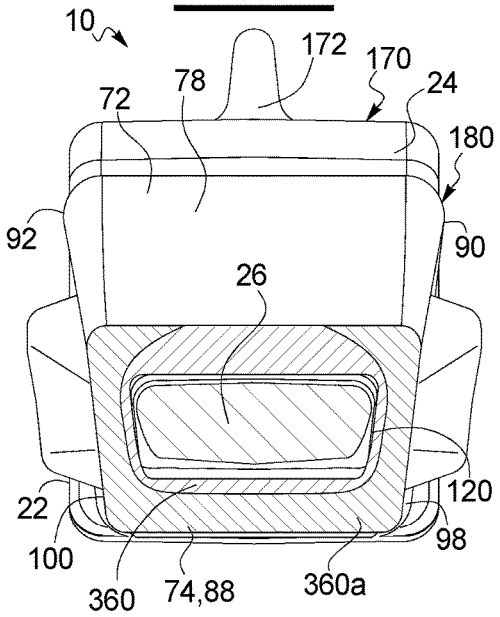
FIG. 75 is a cross-sectional view of the tooth assembly of FIG. 69 taken through line 75-75.

FIGS. 75 and 76 illustrate further iterations of cutting surfaces 334, 336, respectively, as wear material continues to wear away from the front end of the tip 14 and from the portions 78, 82 of the top outer surface 72, and the front portions 98, 100 of the lateral outer surfaces 90, 92, as denoted by the cross-hatched areas 334*a*, 336*a*. Due to the shape of the relief 102, the portions of the cutting surfaces 334, 336 carved out by the relief 102 may initially increase as the leading edge of the tip 14 progresses rearwardly to the cutting surface 334, and eventually decrease as wear continues to progress to the cutting surface 336. Eventually, wear material wears away from the front of the tip 14 toward the rearward limits of the relief 102.

Figure 67:
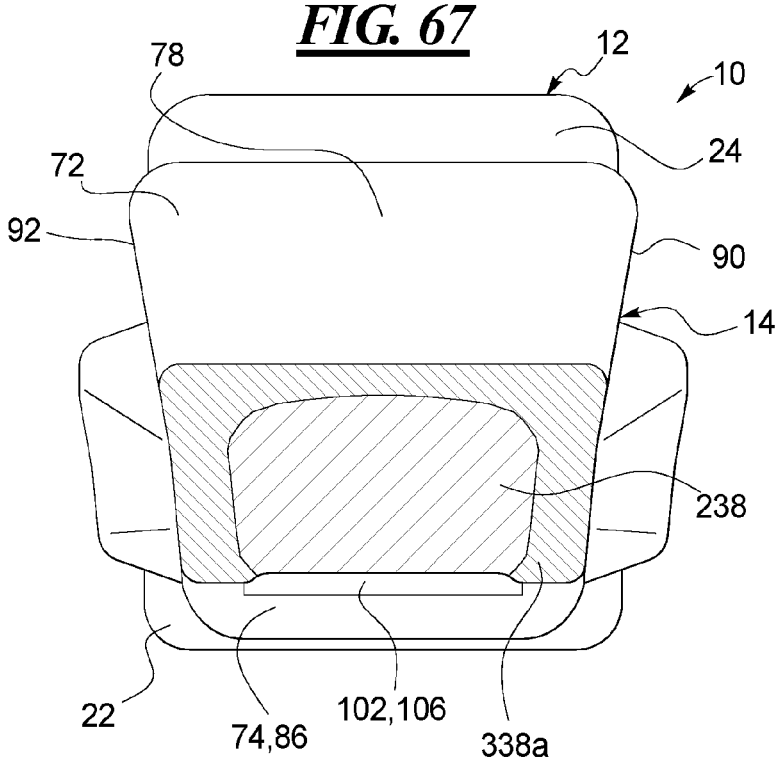
FIG. 67 is a cross-sectional view of the tooth assembly of FIG. 62 taken through line 67-67.
Figure 68:
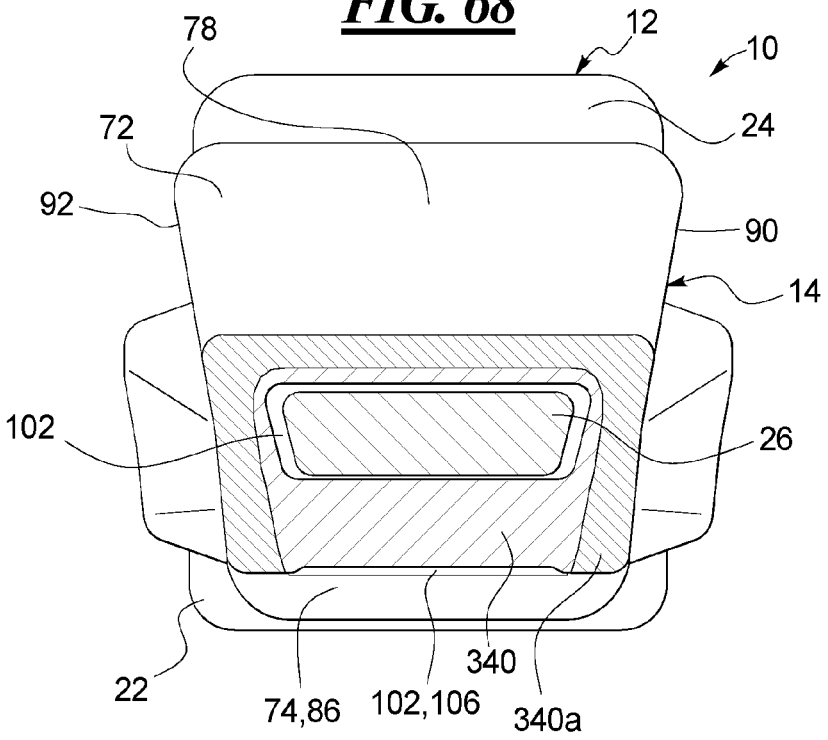
FIG. 68 is a cross-sectional view of the tooth assembly of FIG. 62 taken through line 68-68

As shown in FIG. 67, a cutting surface 338 closely approximates the cross-sectional area of the tip 14 near the rearward end of the relief 102, thereby creating a relatively large surface area for attempted penetration of the work material. The large surface area may be partially reduced by wear indicated by the cross-hatched area 338*a*. The tip 14 begins to function less efficiently at cutting into the work material as the tip 14 nears the end of its useful life. Wearing away of the tip 14 toward the end of the relief 102 may provide a visual indication for replacement of the tip 14. Continued use of the tip 14 causes further erosion of the wear material at the front of the tip 14, and may ultimately lead to a breach of the nose cavity 120 at a cutting surface 340 as shown in FIG. 68. Wear progressing inwardly from the outer surfaces 72, 74, 90, 92 as indicated by the cross-hatched area 340*a* may eventually cause further breaches of the nose cavity 120 with continued use of the tooth assembly 10. At this point, the nose 26 of the adapter 12 may be exposed to the work material, and may begin to wear away, possibly to the point where the adapter 12 must also be removed from the base edge 18 of the implement 1 and replaced.

Figure 69:
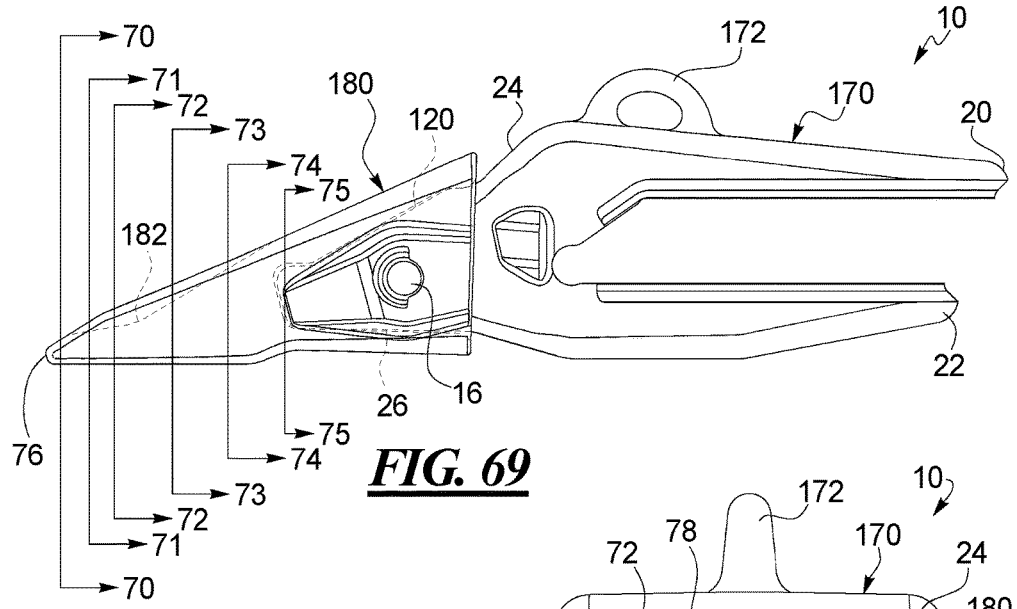
FIG. 69 is a side view of the tooth assembly formed by the adapter of FIG. 23 and the tip of FIG. 26.
Figure 70:
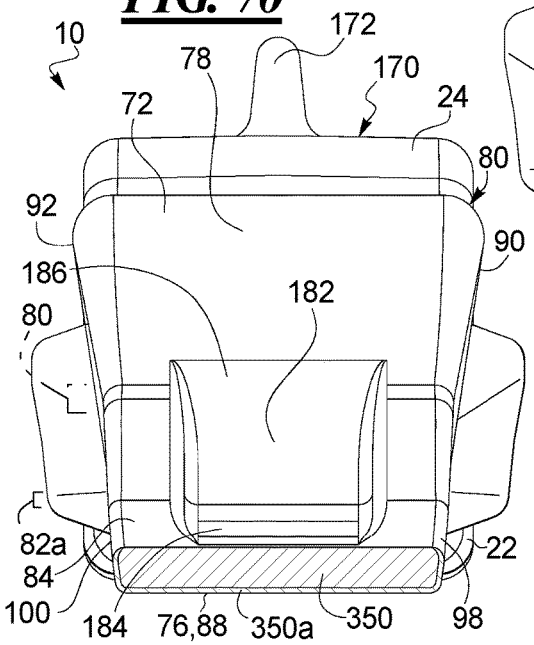
FIG. 70 is a cross-sectional view of the tooth assembly of FIG. 69 taken through line 70-70.
Figure 71:
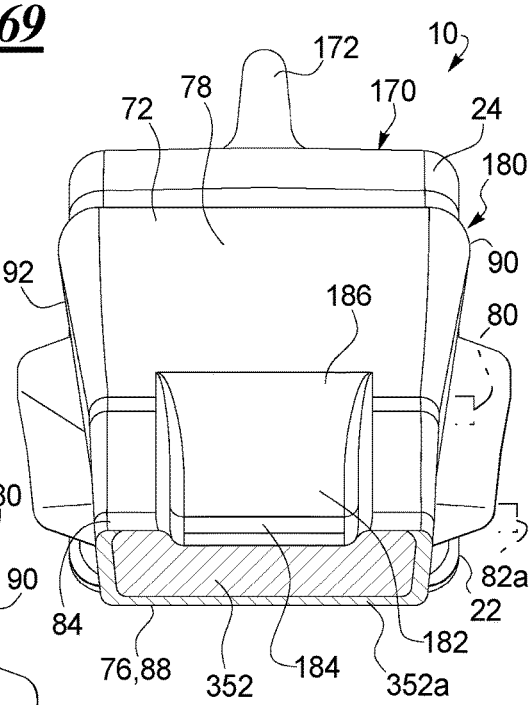
FIG. 71 is a cross-sectional view of the tooth assembly of FIG. 69 taken through line 71-71.

The geometric configurations of the tips 150, 180, 190, 210 may also provide improved efficiency in penetrating work material over the useful life of the tips 150, 180, 190, 210. The reliefs 154, 156, 182, 192, 194, 212, 214 on the top outer surfaces 72 may provide a self-sharpening features to the tips 150, 180, 190, 210 providing improved penetration as wear material is worn away from the front of the tip. As an example, FIG. 69 illustrates the tooth assembly 10 that may be formed by the adapter 170 and the general duty tip 180, and the cross-sectional views shown in FIGS. 70-75 illustrate changes in the geometry of the cutting surface as wear material wears away from the front of the tip 180. FIG. 71 shows a cross-sectional view of the tooth assembly 10 of FIG. 69 with the section taken between the front edge 76 and the relief 182. After abrasion wears away the tip 180 to this point, a cutting surface 350 of the tip 180 now presents a cross-sectional area engaging the work material as the machine drives forward that is less sharp than the front edge 76. It will be apparent to those skilled in the art that abrasion from engagement with the work material may cause the outer edges of the cutting surface 350 to become rounded, and for the front portion 88 of the bottom outer surface 74 to wear away as indicated by the cross-hatched area 350*a* and thereby reduce the thickness of the cutting surface 350.

The wear material of the tip 180 continues to wear away rearwardly toward the relief 182. FIG. 71 illustrates a cross-section of the tooth assembly 10 at a position where the front of the tip 180 may have worn away into the portion of the tip 180 providing the relief 182 to form a cutting surface 352. At this point, the tip 180 may have worn through the curved portion 184 of the relief 182 such that the cutting surface 352 includes an intermediate area of reduced thickness. The area of reduced thickness may cause the cutting surface 352 to have slight U-shape. The wear material removed from the cutting surface 352 by the relief 182 reduces the cross-sectional area of the leading cutting surface 352 of the tip 180 to "sharpen" the tip 180, and correspondingly reduces the resistance experienced as the tips 180 of the implement 1 enter the work material. Wear material continues to wear away from the front portion 88 of the bottom outer surface 76 to reduce the thickness of the cutting surface 352, and wear material wears away from the front portions 98, 100 of the lateral outer surfaces 90, 92, respectively, to reduce the width at the front of the tip 180, as indicated at cross-hatched area 352*a*. The tapered portion 186 of the relief 182 allows the work material to flow through the relief 182 with less resistance than if the rear portions of the relief 182 were flat or rounded and facing more directly toward the work material. The tapering of the tapered portion 186 reduces forces acting normal to the surfaces that may resist the flow of the work material and the penetration of the tip 180 into the work material.

Figure 72:
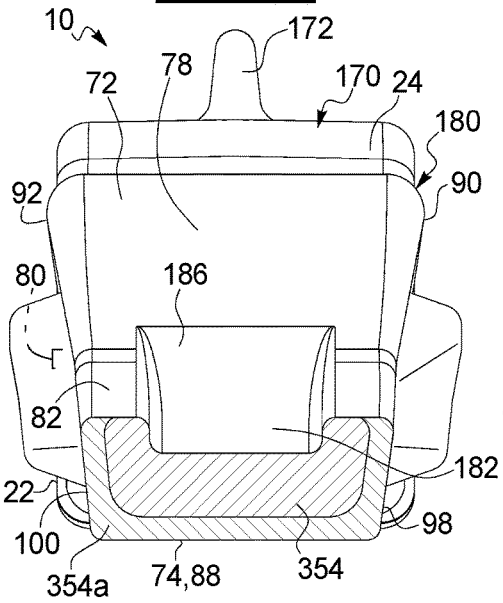
FIG. 72 is a cross-sectional view of the tooth assembly of FIG. 69 taken through line 72-72.
Figure 73:
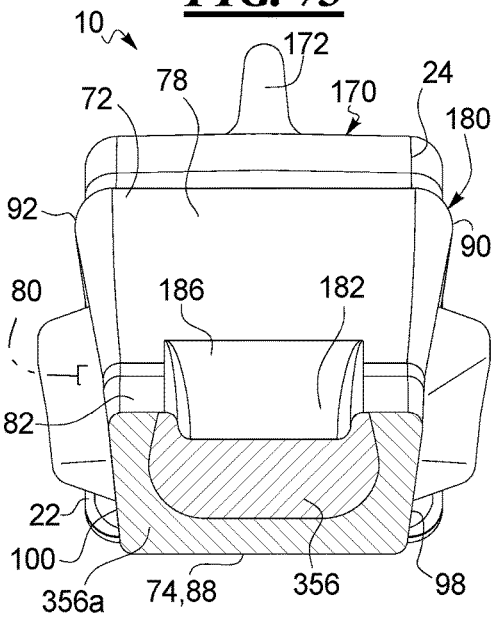
FIG. 73 is a cross-sectional view of the tooth assembly of FIG. 69 taken through line 73-73.
Figure 74:
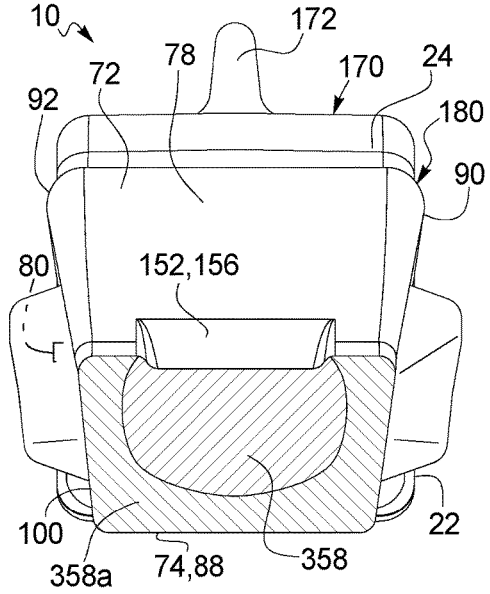
FIG. 74 is a cross-sectional view of the tooth assembly of FIG. 69 taken through line 74-74.

FIGS. 72 and 73 illustrate further iterations of cutting surfaces 354, 356, respectively, as wear material continues to wear away from the front edge 76 of the tip 180 and from the front portion 88 of the bottom outer surface 74 of the tip 180 and the front portions 98, 100 of the lateral outer surfaces 90, 92 of the tip 180, as denoted by the cross-hatched areas 354*a*, 356*a*. Due to the shape of the relief 182, the portions of the cutting surfaces 354, 356 carved out by the relief 182 may initially increase as the leading edge of the tip 180 progresses rearwardly to the cutting surface 354, and eventually decrease as wear continues to progress to the cutting surface 356. Eventually, wear material wears away to the rearward limits of the relief 182.

As shown in FIG. 7, a cutting surface 358 closely approximates the cross-sectional area of the tip 180 behind the relief 182, thereby creating a relatively large surface area for attempted penetration of the work material. The large surface area may be partially reduced by wear indicated by the cross-hatched area 358*a*. The tips 180 begin to function less efficiently at cutting into the work material as the tips 180 near the end of their useful life. Wearing away of the tips 180 beyond the relief 182 may provide a visual indication for replacement of the tips 180. Continued use of the tips 180 causes further erosion of the wear material at the front of the tips 180, and may ultimately lead to a breach of the nose cavity 120 at a cutting surface 360 as shown in FIG. 75. Wear progressing inwardly from the outer surfaces 72, 74, 90, 92 as indicated by the cross-hatched area 360*a* may eventually cause further breaches of the nose cavity 120 with continued use of the tooth assembly 10. At this point, the nose 26 of the adapter 170 may be exposed to the work material, and may begin to wear away, possibly to the point where the adapter 170 must also be removed from the base edge 18 of the implement 1 and replaced.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, not impossible. Numerous alternative embodiments could be implemented, using either current technology or technology developed after the filing date of this patent, which would still fall within the scope of the claims defining the invention.

What is claimed is:

1. A ground engaging tooth assembly for a base edge of a ground engaging implement, the ground engaging tooth assembly comprising:

an adapter, comprising:

a rearwardly extending top strap, a rearwardly extending bottom strap having a top surface, wherein the top strap and the bottom strap define a gap therebetween for receiving the base edge of the ground engaging implement, and a forward extending adapter nose, comprising:

a bottom surface extending forward from the top strap and the bottom strap, a front surface, a top surface, oppositely disposed side surfaces extending downwardly from the top surface to the bottom surface, and a ground engaging tip, comprising:

a rear edge, a top outer surface, a bottom outer surface, wherein the top outer surface and the bottom outer surface extend forward from the rear edge and converge at a front edge, oppositely disposed lateral outer surfaces extending downwardly from the top outer surface to the bottom outer surface, wherein the lateral outer surfaces are tapered so that a distance between the lateral outer surfaces decreases as the lateral outer surfaces extend downwardly from the top outer surface toward the bottom outer surface, and wherein each of the lateral outer surfaces includes a projecting portion extending outwardly therefrom, and an inner surface extending inwardly into the ground engaging tip from the rear edge and defining a nose cavity within the ground engaging tip having a complementary shape to the adapter nose of the adapter for receiving the adapter nose therein.

2. The ground engaging tooth assembly of claim 1, wherein each of the lateral outer surfaces and a vertical line define a vertical taper angle, and wherein the vertical taper angles defined by the lateral outer surfaces are equal.

3. The ground engaging tooth assembly of claim 2, wherein the vertical taper angles defined by the lateral outer surfaces are approximately 3°.

4. The ground engaging tooth assembly of claim 2, wherein the vertical taper angles defined by the lateral outer surfaces are approximately 6°.

5. The ground engaging tooth assembly of claim 1, wherein the inner surface comprises:

a bottom inner surface extending inwardly from the rear edge and oriented approximately perpendicular to the rear edge of the ground engaging tip;

a front inner surface;

a top inner surface; and oppositely disposed side inner surfaces extending downwardly from the top inner surface to the bottom inner surface, wherein the bottom inner surface, the top inner surface and the side inner surfaces face and engage the bottom surface, the top surface and the side surfaces, respectively, of the adapter nose when the adapter nose is fully inserted into the nose cavity.

6. The ground engaging tooth assembly of claim 5, wherein the side inner surfaces of the inner surface are parallel to the lateral outer surfaces of the ground engaging tip.

7. The ground engaging tooth assembly of claim 1, wherein each of the lateral outer surfaces comprises a rear portion and a front portion, and wherein the front portions of the lateral outer surfaces are tapered with respect to each other so that a distance between the front portions of the lateral outer surfaces increases as the front portions extend forward from the rear portions of the lateral outer surfaces.

8. The ground engaging tooth assembly of claim 1, wherein the rear portions of the lateral outer surfaces are tapered so that a distance between the rear portions of the lateral outer surfaces decreases as the rear portions extend forward from the rear edge of the ground engaging tip.

* * * * *